US010079139B2

(12) United States Patent
Voorhees et al.

(10) Patent No.: US 10,079,139 B2
(45) Date of Patent: Sep. 18, 2018

(54) METAL OXIDE LASER IONIZATION-MASS SPECTROMETRY

(76) Inventors: Kent J. Voorhees, Golden, CO (US); Casey R. McAlpin, Golden, CO (US); Ryan M. Richards, Golden, CO (US)

( * ) Notice: Subject to any disclaimer, the term of this patent is extended or adjusted under 35 U.S.C. 154(b) by 0 days.

(21) Appl. No.: 13/424,212

(22) Filed: Mar. 19, 2012

(65) Prior Publication Data

US 2012/0261567 A1 Oct. 18, 2012

Related U.S. Application Data

(60) Provisional application No. 61/453,617, filed on Mar. 17, 2011.

(51) Int. Cl.

| | |
|---|---|
| ***H01J 49/26*** | (2006.01) |
| ***H01J 27/24*** | (2006.01) |
| ***H01J 49/16*** | (2006.01) |
| ***H01J 49/04*** | (2006.01) |

(52) U.S. Cl.
CPC ..... *H01J 49/164* (2013.01); *H01J 49/0418* (2013.01)

(58) Field of Classification Search
CPC .... H01J 49/0418; H01J 49/161; H01J 49/162; H01J 49/164
USPC ..... 250/281–300
See application file for complete search history.

(56) References Cited

U.S. PATENT DOCUMENTS 5,424,542 A * 6/1995 Chimenti ..... G01N 21/359 250/339.12
5,427,993 A * 6/1995 Perry ..... B01J 37/349 204/157.41
7,122,792 B2 * 10/2006 Chen et al. ..... 250/288
7,755,038 B2 * 7/2010 Niu et al. ..... 250/288
2004/0094705 A1 * 5/2004 Wood ..... H01J 49/164 250/288
2004/0118703 A1 * 6/2004 Wang et al. ..... 205/780.5
2006/0145068 A1 * 7/2006 Chen et al. ..... 250/282
2006/0246225 A1 * 11/2006 Moritz et al. ..... 427/376.2

(Continued)

FOREIGN PATENT DOCUMENTS

WO WO2007048635 A1 * 5/2007 ..... A61N 5/06

OTHER PUBLICATIONS

Aminlashgari et al., "Nanocomposites as novel surfaces for laser desorption ionization mass spectrometry", RSC Publishing, Nov. 15, 2010, pp. 1-13.*

(Continued)

*Primary Examiner* — Michael Logie
(74) *Attorney, Agent, or Firm* — Dorsey & Whitney LLP

(57) ABSTRACT

Disclosed herein are metal oxides, metal oxide surfaces, and methods of using metal oxides and metal oxide surfaces for matrix-free analysis, identification, and characterization of small molecular mass compounds. The disclosed compounds and methods may be used with laser desorption/ionization-mass spectrometry. The disclosed surfaces may aid in producing mass/charge spectra having low or no interference found with traditional matrices. In some aspects, the method may be used to produce molecular ions. The disclosed compounds, surfaces, and methods may be used to analyze complex mixtures including fuels, vegetable shortening, lipid extracts from a variety of organic sources such as animals, plants, bacteria, algae, viruses, etc.

13 Claims, 37 Drawing Sheets

(56) References Cited

U.S. PATENT DOCUMENTS

| | | | | |
|---|---|---|---|---|
| 2006/0266941 | A1* | 11/2006 | Vestal | 250/288 |
| 2008/0132401 | A1* | 6/2008 | Watanabe et al. | 501/54 |
| 2008/0261321 | A1* | 10/2008 | Patton et al. | 436/104 |
| 2008/0305555 | A1* | 12/2008 | Bouvier et al. | 436/173 |
| 2009/0045332 | A1* | 2/2009 | Yoshimura et al. | 250/288 |
| 2009/0050839 | A1* | 2/2009 | Chen et al. | 252/62.58 |
| 2009/0155472 | A1* | 6/2009 | Grasse | C04B 14/301 427/385.5 |
| 2009/0186776 | A1* | 7/2009 | Webb et al. | 506/12 |
| 2009/0244678 | A1* | 10/2009 | Hagood et al. | 359/230 |
| 2010/0087008 | A1* | 4/2010 | Tao | 436/86 |
| 2010/0093102 | A1* | 4/2010 | Jin et al. | 436/86 |
| 2010/0184962 | A1* | 7/2010 | Chen et al. | 530/412 |
| 2010/0206959 | A1* | 8/2010 | Oki et al. | 239/3 |
| 2010/0207051 | A1* | 8/2010 | Fonnum et al. | 252/62.51 R |
| 2010/0248388 | A1* | 9/2010 | Liu et al. | 436/173 |
| 2010/0294977 | A1* | 11/2010 | Larsson et al. | 252/62.51 R |
| 2011/0036201 | A1* | 2/2011 | Tetsumoto | C21C 5/5217 75/10.59 |
| 2011/0315930 | A1* | 12/2011 | Pope et al. | 252/364 |
| 2012/0041240 | A1* | 2/2012 | Nunez Isaza | C08L 91/06 585/16 |
| 2012/0104243 | A1* | 5/2012 | Verbeck et al. | 250/282 |
| 2014/0242299 | A1* | 8/2014 | Okamura et al. | 427/595 |
| 2016/0023187 | A1* | 1/2016 | Hedlund | B01D 53/228 502/64 |

OTHER PUBLICATIONS

Magnesium oxide. (2011). In the Editors of the American Heritage Dictionaries & TheEditorsoftheAmericanHeritageDictionaries (Eds. ), The American Heritage Dictionary of the English language. Boston, MA: Houghton Mifflin. Retrieved from http://search.credoreference.com/content/entry/hmdictenglang/magnesium_oxide/0.*

Kinumi et al., "Matrix-assisted laser desorption/ionization time-of-flight mass spectrometry using an inorganic particle matrix for small molecule analysis", J. Mass Spectrom. 35, 417-422 (2000).*

McAlpin et al. "Matrix-Free Laser Desorption/Ionization of Lipid Analytes on Metal Oxide Surfaces", American Society of Mass Spectrometry and Allied Topics, Jun. 2011.*

Li, Derwent translation of CN 103215030 A, published Jul. 2013.*

Arnold et al., "Mechanism of the Pyrolysis of Esters", J. Org. Chem., 15 (1950) pp. 1256-1260.

Barshick et al., "Differentiation of Microorganism based on Ion-trap Mass Spectrometry using Chemical Ionization", Anal. Chem., 71 (1999) pp. 633-641.

Basile et al., "Direct Mass Spectrometric Analysis of in situ Thermally Hydrolyzed and Methylated Lipids for Whole Cell Bacteria", Anal. Chem., 70 (1998) pp. 1555-1562.

Basile et al., "Microorganism Gram-Type Differentiation based on Py-MS of Bacterial Fatty Acid Ester Extracts", J. Appl. Environ. Microbiol., 61 (1995) pp. 1534-1539.

Beverly et al., "Direct Mass Spectrometric Analysis of Bacillus Spores", Rapid Commun. in Mass Spectrom., 13 (1999) pp. 2320-2326.

Bond et al., "Integrated Catalytic Conversion of y-Valerolactone to Liquid Alkenes for Transportation Fuels" Science 2010, 327, pp. 1110-1114.

Challinor et al., "Review: the Development and Applications of Thermally Assisted Hydrolysis and Methylation Reactions", J. Anal. Appl. Pyrol., 61, (2001) pp. 3-34.

Chen et al., "Molecularly Imprinted TiO2-Matrix-Assisted Laser Desorption/Ionization Mass Spectrometry for Selectively Detecting r-Cyclodextrin" Anal. Chem. 2004, 76, pp. 1453-1457.

Cody et al., "Versatile New Ion Source for the Analysis of Materials in Open Air under Ambient Conditions", Anal. Chem., 77 (2005) pp. 2297-2302.

Dove, A., "Mass Spectrometry Raises the Bar", Science 2010, 328, pp. 920-922.

Duncan et al., "Quantitative matrix-assisted laser desorption/ionization mass spectrometry", Briefings in Functional Proteomics 2008, v. 7, No. 5, pp. 355-370.

Evans et al., "Proton Affinities of Saturated Aliphatic Methyl Esters", J. Am. Soc. Mass Spectrom. 2000, 11, pp. 789-796.

Fox, A., "Mass Spectrometry for Species or Strain Identification after Culture or without Culture: Past, Present, and Future", J. Clin. Microbiol., 44 (2006) pp. 2677-2680.

Harvey, D. J., "Matrix-assisted Laser Desorption/Ionization Mass Spectrometry of Carbohydrates and Glycoconjugates", Int. J. Mass Spectrom. 2003, 226, pp. 1-35.

Harvey, D.J., "Matrix-assisted Laser Desorption/Ionization Mass Spectrometry of Carbohydrates", Mass Spectrom. Reviews, 18 (1999) pp. 349-451.

Hübner et al., "Orientation of specifically $^{13}$C==O labeled phosphatidylcholine multilayers from polarized attenuated total reflection FT-IR spectroscopy", Biophys. J. 1991, 59, pp. 1261-1272.

Ingólfsson et al., "Photodetachment from anions in a drift cell. Application to $SF_6^-$ at 337 nm", Intl. Mass Spectrom. Ion Proc. 1994, 139, pp. 103-110.

Ishida et al., "Rapid analysis of intact phospholipids from whole bacterial cells by matrix-assisted laser desorption/ionization mass spectrometry combined with on-probe sample pretreatment", Rapid Commun. Mass Spectrom. 2002, 16, pp. 1877-1882.

Jeevanandam et al., "A Study on Adsorption of Surfactant Molecules on Magnesium Oxide Nanocrystals Prepared by an Aerogel Route" J. Langmuir 2002, 18, pp. 5309-5313.

Kakkar et al., "First Principles Density Functional Study of the Adsorption and Dissociation of Carbonyl Compounds on Magnesium Oxide Nanosurfaces" J. Phys. Chem. B 2006, 110, pp. 25941-25949.

Karas et al., "Matrix-Assisted ultraviolet laser desorption on non-volatile compounds", Int.J. Mass Spectrom. Ion Proc. 1987, 78, pp. 53-68.

Kassis et al., "An Investigation into the Importance of Polymer—Matrix Miscibility Using Surfactant Modified Matrix-assisted Laser Desorption/Ionization Mass Spectrometry", Rapid Commun. Mass Spectrom. 1997, 11, pp. 1462-1466.

Khaleel et al., "Nanocrystals as Stoichiometric Reagents with Unique Surface Chemistry: New Adsorbents for air Purification", Nanosruct. Mat., 12 (1999) pp. 463-466.

Kinumi et al., "Matrix-assisted laser desorption/ionization time-of-flight mass spectrometry using an inorganic particle matrix for small molecule analysis", J. Mass Spectrom. 2000, 35, pp. 417-422.

Koper et al., "Destructive Adsorption of Chlorinated Hydrocarbons on Ultrafine (Nanoscale) Particles of Calcium Oxide. 3. Chloroform, Trichloroethene, and Tetrachloroethene", J. Chem. Mater. 1997, 9, pp. 2481-2485.

Kumari et al., "Synthesis, characterization and optical properties of Mg(OH)2 micro-/nanostructure and its conversion to MgO", Ceramics International 2009, 35, pp. 3355-3364.

Kunkes et al., "Catalytic Conversion of Biomass to Monofunctional Hydrocarbons and Targeted Liquid-Fuel Classes", Science, 2008, 322, pp. 417-421.

Li et al., "Analysis of Single Mammalian Cell Lystates by Mass Spectrometry", J. Amer. Chem. Soc. 118 (1996) pp. 11662-11663.

Li et al., "Nanoscale Metal Oxide Particles as Chemical Reagents. Destructive Adsorption of a Chemical Agent Simulant, Dimethyl Methylphosphonate, on Heat-Treated Magnesium", J. Langmuir 1991, 7, pp. 1388-1393.

Lin et al., "Thermally Activated Magnesium Oxide Surface Chemistry. Adsorption and Decomposition of Phosphorus Compounds", J. Langmuir 1985, 1, pp. 600-605.

Mackrodt et al., "Bulk and (100) surface d—d excitation energies in NiO from first-principles Hartree—Fock calculations", Surface Science 2000, 457, L386-L390.

Madonna et al., "Detection of *E. coli* using Immunomagnetic separation and Bacteriophage Amplification Coupled with MALDI-TOF-MS", Rapid Commun. in Mass Spectrom., 17 (2003) pp. 257-263.

(56) References Cited

OTHER PUBLICATIONS

McLean et al., "Size-Selected (2-10 nm) Gold Nanoparticles for Matrix Assisted Laser Desorption Ionization of Peptides", J. Am. Chem. Soc. 2005, 127, pp. 5304-5305.
Moon et al., "Temperature of Peptide Ions Generated by Matrix-Assisted Laser Desorption Ionization and their Dissociation kinetic Parameters", J. Phys. Chem., 113 (2009) pp. 2071-2076.
Ostman et al., "Minimum proton affinity for efficient ionization with atmospheric pressure desorption/ionization on silicon mass spectrometry", Rapid Commun. Mass Spectrom. 2006, 20, pp. 3669-3673.
Pierce et al., "Ambient Generation of Fatty Acid Methyl Ester ions from Bacterial Whole Cells by Direct Analysis in Real Time Mass Spectrometry", Chem. Commun., (2007) pp. 807-809.
Schiller et al., "Lipid Analysis by Matrix Assisted Desorption and Ionization Mass Spectrometry: A Methodological Approach", Anal. Biochem., 267 ( 1999) pp. 46-56.
Schiller et al., "Matrix-assisted Desorption and Ionization Time-of-Flight (MALDI-TOF) Mass Spectrometry in Lipid and Phospholipid Research", Prog. Lipid Res., 43 (2004) pp. 449-488.
Shadkami et al., "Recent Applications in Analytical Thermochemolysis", J. Anal. Appl. Pyrol., 89 (2010) pp. 2-18.
Sherman, D.M., "Electronic structures of iron(III) and manganese(IV) (hydr)oxide minerals: Thermodynamics of photochemical reductive dissolution in aquatic environments", Geochimica et Cosmochimica Acta (2005), 69, pp. 3249-3255.
Sunner et al., "Graphite Surface-Assisted Laser Desorption/Ionization Time-of-Flight Mass Spectrometry of Peptides and Proteins from Liquid Solutions", Anal. Chem. 1995, 67, pp. 4335-4342.
Taubes, G., "The Soft Science of Dietary Fat" Science Mar. 30, 2001, vol. 291, pp. 2536-2545.
Truong et al., "Adsorption of Formaldehyde on Nickel Oxide Studied by Thermal Programmed Desorption and High-Resolution Electron Energy Loss Spectroscopy", J. Am. Chem. Soc. 1993, 115, pp. 3647-3653.
Vieler et al., "The lipid composition of the unicellular green alga *Chlamydomonas reinhardtii* and the diatom *Cyclotella meneghiniana* investigated by MALDI-TOF MS and TLC", J. Chem. Phys. Lipids 2007, 150, pp. 143-155.
Voorhees et al., "Identification of Chemical Biomarkers in Bacteria and Other Compounds by Pyrolysis-Tandem Mass Spectrometry", J. Anal. Appl. Pyrol., 24 (1992) pp. 1-21.
Wallace et al., "2,5-Dihydroxybenzoic acid: laser desorption/ionization as a function of elevated temperature", Int. J. Mass Spectrom. 2005, 242, pp. 13-22.
Watanabe et al., "Surface-assisted laser desorption/ionization mass spectrometry (SALDI-MS) of low molecular weight organic compounds and synthetic polymers using zinc oxide (ZnO) nanoparticles", J. Mass Spectrom. 2000, 43, pp. 1063-1071.
Wei et al., "Desorption—ionizationmass spectrometry on porous silicon", Nature 1999, 399, pp. 243-246.
Wen et al., "Small-Molecule Analysis with Silicon-Nanoparticle-Assisted Laser Desorption/ Ionization Mass Spectrometry", Anal. Chem. 2007, 79, pp. 434-444.
Wenk, M.R., "The Emerging Field of Lipidomics", Nat Rev Drug Discov. Jul. 2005, vol. 4, pp. 594-610.
Wong et al., "Methylation Artifacts in Gas Chromatography of Serum Extracts", J. Chromatogr., 116 (1976) pp. 321-331.
Work et al., "Increased Lipid Accumulation in the Chamydomonas reinhardtii sta7-10 Starchless Isoamylase Mutant and Increased Carbohydrate Synthesis in Complemented Strains", Eukaryot. Cell, vol. 9, No. 8, (2010) pp. 1251-1261.
Wu et al., "Time-of-Flight Mass Spectrometry of Underivatired Single-Stranded DNA Oligomers by Matrix-Assisted Laser Desorption", Anal. Chem. 1994, 66, pp. 1637-1645.
Xu et al., "Differentiation and Classification of User-Specified Bacterial Groups by in situ Thermal Hydrolysis/Methylation of Whole Bacterial Cells by tert-Butyl Bromide Cl Ion Trap MS", Anal. Chim. Acta., 418 (2000) pp. 119-128.
Yanes et al., "Nanostructure Initiator Mass Spectrometry: Tissue Imaging and Direct Biofluid Analysis", Anal. Chem. 2009, 81, pp. 2969-2975.
Zhao et al., "Triblock Copolymers Synthesis of Mesoporous Silica with Periodic 50 to 300 Angstrom pores", Science, 279 (1998) pp. 548-552.

* cited by examiner poly-ala proton source

Fig. 34A
IONIZING AN ANALYTE
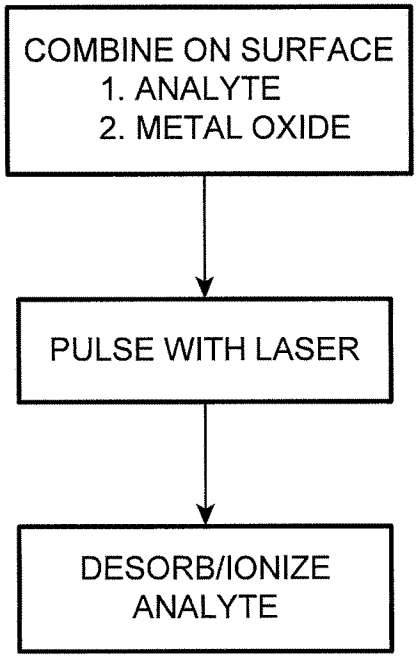
Fig. 34B
CHARACTERIZE AN ANALYTE
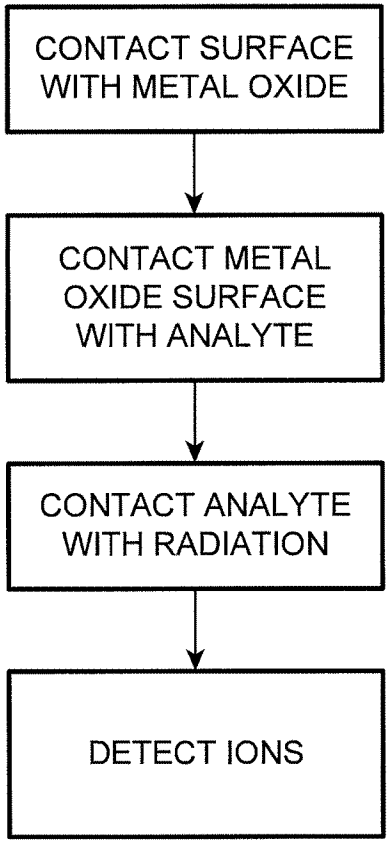
FIG. 34

METAL OXIDE LASER IONIZATION-MASS SPECTROMETRY

CROSS REFERENCE TO RELATED APPLICATIONS

This application claims benefit of priority pursuant to 35 U.S.C. § 119(e) of U.S. provisional patent application No. 61/453,617 filed Mar. 17, 2011, which is hereby incorporated herein by reference in its entirety.

FIELD

The disclosure relates to metal oxides, metal oxide surfaces, and methods of using metal oxides in laser desorption/ionization (MOLI)-mass spectrometry to analyze and characterize analytes. MOLI may be used to analyze small analytes (<1000 Da) and complex mixtures containing small analytes.

BACKGROUND

Matrix assisted laser desorption/ionization mass spectrometry (MALDI-MS) has traditionally used an organic matrix in the ionization process to obtain spectra of high molecular weight molecules such as synthetic polymers, carbohydrates, proteins, and nucleotides. Unfortunately, the application of MALDI to small molecules (MW<1000 Da) such as lipids has not been as successful due to interference from matrix peaks in this mass region of the spectrum. Several strategies have been explored to minimize this effect including the development of numerous matrix-free systems which generally involve interactions between the analyte and a functionalized surface, during laser irradiation. The most notable matrix free system is from Siuzdak and co-workers describing desorption/ionization on porous silicon (DIOS). The major problems with the silicon surfaces however, have been the lack of reproducibility in manufacturing and the inability to efficiently ionize non-basic compounds such as lipids.

The present disclosure addresses these and other needs.

BRIEF DESCRIPTION

Disclosed herein method of ionizing an analyte comprising combining the analyte with a metal oxide on a surface, pulsing one or more laser pulses onto the composition to desorb and ionize the analyte. In some embodiments, ions from the ionized analyte are detected, for example by a mass spectrometer. In some embodiments the analyte and metal oxide is combined with an organic reagent, for example a basic organic agent. In various embodiments, the metal oxide is selected from Scandium, Titanium, Vanadium, Chromium, Manganese, Iron, Cobalt, Nickel, Copper, Zinc, Magnesium, or Calcium. In further embodiments, the metal oxide is selected from Nickel Oxide, Magnesium Oxide, or Calcium Oxide. In some embodiments wherein metal oxide is Nickel Oxide. In some embodiments wherein metal oxide is Magnesium Oxide. In some embodiments wherein metal oxide is Calcium Oxide.

Also disclosed herein is an ionization source for mass spectrometry comprising a composition comprising a metal oxide and an analyte, said composition is on an surface, a pulsed laser positioned to direct laser energy onto the composition, and an electric field configured for moving ions from the ion source to a mass analyzer. In some embodiments the composition comprises a basic organic reagent. In further embodiments, the mass spectrometer comprising an ionization source is operably associated with a mass analyzer.

A method of characterizing an analyte is also disclosed, said method comprising contacting a surface with a metal oxide to create a metal oxide surface, contacting the metal oxide surface with an analyte, contacting the analyte with radiation from one or more lasers to create an analyte ion, detecting the analyte ion with a mass spectrometer. In various embodiments, the analyte is selected from the group consisting of a lipid, glycolipid, phospholipid, glycerolipid, fatty acid, carbohydrate, chemical agent, phenolic compound, lignol, pyrolysis oil, peptide, nucleic acid, cell, petroleum product, oil, crude oil, fuel, fuel constituents, lignin dimers, trimers and poly-aromatics. In various embodiments, the metal oxide of the method is selected from the group consisting of Scandium, Titanium, Vanadium, Chromium, Manganese, Iron, Cobalt, Nickel, Copper, Zinc, Magnesium, or Calcium. In further embodiments of the method, the metal oxide is selected from Nickel Oxide, Magnesium Oxide, or Calcium Oxide. In some embodiments wherein metal oxide is Nickel Oxide. In some embodiments wherein metal oxide is Magnesium Oxide. In some embodiments wherein metal oxide is Calcium Oxide.

BRIEF DESCRIPTION OF THE DRAWINGS

FIG. 4A shows analysis of C16 FAME (methyl palmitate) with NiO<100>, FIG. 4B shows traditional MALDI with 2,5-dihydroxybenzoic acid, and FIG. 4C shows the bare MALDI plate.

FIG. 34 shows two flow diagrams of the presently disclosed method. FIG. 34A is a method of ionizing and characterizing an analyte, and FIG. 34B is a method of characterizing an analyte.

DETAILED DESCRIPTION

Figure 1A:
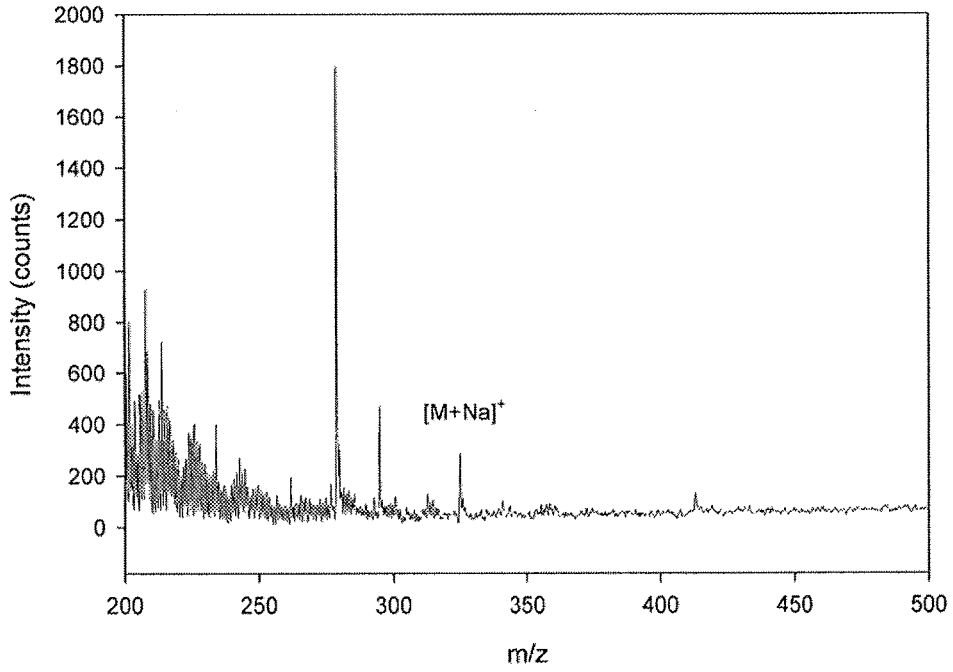
FIG. 1*a* shows a spectrum of tetra-alanine without pretreating the surface of NiO with methyl acetate and FIG. 1*b* shows the signal for tetra-alanine using a surface treated with methyl acetate.

Disclosed herein are metal oxide compounds, surfaces, and methods of using same in analysis of an analyte. In various embodiments the compounds, surfaces, and methods are used for the analysis of small molecule analytes (MW<1000 Da (Dalton)). In other embodiments the compounds, surfaces, and methods may be used to analyze analytes greater than 1000 Da.

Any analyte known in the art may be detected/analyzed by the presently disclosed compounds, surfaces, and methods. In some embodiments the analyte may be a lipid, lipid, glycolipid, phospholipid, glycerolipid, fatty acid, carbohydrate, chemical agent, phenolic compound, lignol, pyrolysis oil, peptide, nucleic acid, cell, petroleum product, oil, crude oil, fuel, fuel constituents, lignin dimers, lignin trimer, poly-aromatic, FAMEs, acylglycerides, carbolipids, or combinations thereof. Analytes may be obtained from natural, environmental, biological, or synthetic sources.

In various embodiments the metal is a d-Metal, a Transition Metal, a Group II Metal, or an Alkaline Earth Metal. In various embodiments the metal oxide may be an oxide of Scandium, Titanium, Vanadium, Chromium, Manganese, Iron, Cobalt, Nickel, Copper, Zinc, Magnesium, or Calcium. In some embodiments the metal is Nickel, Iron, Magnesium, or Calcium. In some embodiments the metal oxide is Nickel Oxide, Magnesium Oxide, or Calcium Oxide. In some embodiments the metal oxide is Magnesium Oxide. In some embodiments the metal oxide is Calcium Oxide. In some embodiments the metal oxide is Nickel Oxide.

The disclosed metal oxide compounds, metal oxide surfaces, and MOLI methods allow analysis of analytes and analyte mixtures with little or no overlap with, or interference from matrix-derived background-spectra. In some embodiments, metal oxide compounds, surfaces, and methods of using same provide for the direct, matrix-free analysis of analytes. In some cases, metal oxide laser desorption/ionization may be used with standards to produce protonated and sodiated molecular ions. MOLI can also be used with complex mixtures including vegetable oil shortening and lipid extracts derived from biological, environmental, and chemical sources, for example cell walls, membranes, fuels and fuel constituents, such as heavy crude oil.

Mechanistic insight into the mode of ionization from surface spectroscopy, negative ion laser mass spectrometry, and stable isotope studies is also presented. The metal oxide system is compared to other reported matrix-free systems.

Metal oxides replace traditional matrices for analyte analysis with laser ionization. Without wishing to be limited by a specific theory, mechanism, or mode of action, ionization can occur by proton attachment or sodiation due to analyte interactions with Lewis acid/base sites on the metal oxide. In some embodiments, MgO is used in the analysis of organophosphate esters and halogenated alkanes. In some embodiments, CaO can be used in the analysis of triacylglycerides (TAG), which in some cases are used in the production of biofuels.

Disclosed herein are metal oxides with various surface facets for use in MOLI. In some embodiments, surface facets of <100> and <111> are disclosed. <100> and it's symmetry equivalent surfaces (<010>, <001>) As well as the <111> facet Various compositions using MgO and NiO with surface facets of <100> and <111>, are also disclosed. MgO and NiO are known to have significant Lewis acid/base properties, as a matrix-free method for the ionization of a variety of compounds including FAMEs, acylglycerides, carbolipids and phospholipids.

Disclosed herein are metal oxide compounds, surfaces, and methods of using same. In various embodiments the compounds, surfaces, and methods are used for the analysis of small molecule (MW<1000 Da) analytes. The disclosed compounds, surfaces, and methods allow analysis of analytes and analyte mixtures with little or no interference from matrix-derived background-spectra. In some embodiments, metal oxide compounds, surfaces, and methods of using same provide for the direct, matrix-free analysis of analytes. In some cases, metal oxide laser desorption/ionization may be used with analyte standards to produce protonated and sodiated molecular ions. MOLI can also be used with complex mixtures including vegetable oil shortening and lipid extracts derived from biological, environmental, and chemical sources. The metal oxide system is compared to other reported matrix-free systems. Possible modes of ionization are investigated. MOLI methods with negative ion laser mass spectrometry, and stable isotopes were also performed.

In various aspect, methods of ionizing an analyte compatible with a method of mass spectrometry, are provided. The analyte is combined with a metal oxide (MO), and optionally with a methylating reagent, on a surface. One or more laser pulses is incident on the composition to desorb the analyte and the metal oxide by metal oxide desorption/ionization (MOLI), thereby analyzing the analyte. The ions can then be detected by a mass analyzer operably associated with the ionization source.

In another aspect, an ionization source for mass spectrometry is provided. A composition comprising a metal oxide, an analyte, and optionally a methylating reagent, is placed on a surface. A pulsed laser is positioned to direct laser energy onto the composition. An electric field configured for moving ions from the ion source to a mass analyzer is provided.

A mass spectrometer including an ionization source operably associated with a mass analyzer is also provided. The resulting mass spectra do not contain background peaks that overlap molecular ion peaks of low molecular weight analytes.

MOLI

In MOLI, an analyte is combined with a metal oxide (MO) on a surface. One or more laser pulses is incident on the composition to desorb and ionize the analyte.

Various metal oxides known in the art can be used. In various embodiments, MgO, NiO, CaO, $Fe_xO_y$, $Co_xO_y$, CuO, and ZnO with varied surface facets (<100> and <111>) can produce ions of compounds when irradiated in a conventional MALDI mass spectrometer.

TABLE 2

| Sc | Ti | V | Cr | Mn | Fe | Co | Ni | Cu | Zn |
|---|---|---|---|---|---|---|---|---|---|
| $Sc_2O_3$ | $TiO_2$<br>TiO<br>$Ti_2O_3$<br>$Ti_3O$<br>$Ti_2O$<br>$Ti_nO_{2n-1}$ | VO<br>$V_2O_3$<br>$VO_2$<br>$V_2O_5$ | CrO<br>$C_2O_3$<br>$CrO_2$<br>$CrO_3$ | MnO<br>$Mn_3O_4$<br>$Mn_2O_3$<br>$MnO_2$<br>$Mn_2O_3$ | FeO<br>$Fe_3O_4$<br>$Fe_2O_3$ | CoO<br>$Co_2O_3$<br>$Co_3O_4$ | NiO<br>$Ni_2O_3$ | $Cu_2O$<br>CuO | ZnO |

One or more of a variety of metal oxides can be selected. In various embodiments, the metal oxide can be one or more of MgO, CaO, SrO, and other 3d metal oxides, for example those depicted in Table 2. In one aspect, the metal oxide is an oxide of Mg, such as MgO. In one aspect, the metal oxide is an oxide of Ca, such as CaO. In one aspect, the metal oxide is an oxide of Sr, such as SrO. In one aspect, the metal oxide is an oxide of Sc, such as $Sc_2O_3$. In another aspect, the metal oxide is one or more oxides of Ti, such as $TiO_2$, TiO, $Ti_2O_3$, $Ti_3O$, and/or $TinO_{2n-1}$. In another aspect, the metal oxide is one or more oxides of V, such as VO, $V_2O_3$, $VO_2$, and/or $V_2O_5$. In another aspect, the metal oxide is one or more oxides of Cr, such as CrO, $C_2O_3$, $CrO_2$, and/or $CrO_3$. In another aspect, the metal oxide is one or more oxides of Mn, such as MnO, $Mn_3O_4$, $Mn_2O_3$, $MnO_2$, and/or $Mn_2O_3$. In another aspect, the metal oxide is one or more oxides of Fe, such as FeO, $Fe_3O_4$, and/or $Fe_2O_3$. In another aspect, the metal oxide is one or more oxides of Co, such as CoO, $Co_2O_3$, or $Co_3O_4$. In another aspect, the metal oxide is one or more oxides of Ni, such as NiO or $Ni_2O_3$. In another aspect, the metal oxide is one or more oxides of Cu, such as $Cu_2O$ and/or CuO. In another aspect, the metal oxide is one or more oxides of Zn, such as ZnO. In another aspect, the metal oxide is two, three, or four of the metal oxides recited above, in any order or combination. In various aspects, metal oxides with ion pairs spatially oriented to facilitate ionization of an analyte can be selected.

In MOLI, the MO and analyte are desorbed from the surface. The analyte is ionized either on the surface simultaneously with desorption, or subsequent to desorption.

Metal oxide surfaces have significant catalytic activity dominated by the electron donor/acceptor (Lewis acid/base) properties of coordinatively unsaturated surface sites.

In various embodiments, the MOs are powders, such as nanopowders. Without wishing to be held to a theory or mechanism, nanopowders may have higher signal to noise ratio and/or reproducibility due to their increased surface area. The MOs are suspended in an organic solvent, such as pentane, hexane, heptane, acetonitrile, or any other solvent known in the art. In various embodiments, the MO is in a concentration of 1 mg/mL, 10 mg/mL, 100 mg/mL, or 10000 mg/mL.

Nickel oxide has proven useful for directly analyzing small molecule analytes with limited background signal. NiO produced simply from burning $Ni(NO_3)_2$ gave similar results. Diffuse reflectance infrared fourier transform spectroscopy (DRIFTS) infers that the ionization of the adsorbed species likely associated with the metal oxide surface.

MOLI can be used to detect/analyze a variety of analytes, for example, MOLI-MS can be used to detect/analyze neutral and polar lipids such as fatty acid methyl esters (FAMEs), mono-, di-, triglycerides, phospholipids, sterols, and fat soluble vitamins.

A laser pulse is incident on the combination on the MO-analyte. Any laser known in the art can be used. Non-limiting examples of lasers include nitrogen, and Nd-YAG lasers. Any lasers available in commercial MALDI platforms may be used. And commercially available external lasers which may be integrated to a MALDI mass spectrometry.

Use of Organic Reagents in MOLI

Organic reagents may be used with MOLI. For example, strong organic bases such as tetramethyl ammonium hydroxide (TMAH) may aid in analyte characterization include, but are not limited to TMAH, phenytrimethylammonium hydroxide (PTMAH), trifluoromethylphenyltrimethylammonium hydroxide (TFTMAH), trimethylsulfonium hydroxide (TMSH), and combinations thereof. Non-basic organic reagents, such as methyl acetate, may also be used.

Basic organic reagents, combined with MOLI can be applied to the analysis of many analytes, for example, polymers, lipids, amino acids, carbohydrates, nucleic acids, and numerous biological species such as whole cells from a variety of sources including animals, plants, fungi, bacteria, algae, viruses, etc.

To illustrate the use of basic organic reagents in the characterization of a given analyte, NiO particles were doped with methyl acetate for analysis of the polypeptide tetra-alanine. FIG. 2*a* shows a spectrum of tetra-alanine without pre-treating the surface of NiO with methyl acetate. FIG. 2*b* shows that the signal for tetra-alanine using a surface treated with methyl acetate (proton source) is significantly increased relative to the untreated surface (No Proton Source).

The development of MOLI-MS offers a new approach for the analysis of small molecules. In some embodiments MOLI-MS may be used to characterize analyte containing samples. The disclosed method may be useful in direct, sensitive, inexpensive analysis of low molecular weight analyte compounds. In some embodiments, the disclosed method may produce protonated or sodiated species that are free from matrix background peaks, found in other methods. Complex mixtures may also be analyzed. For example, in some aspects, fuels, vegetable shortenings, and microbial lipid extracts can be analyzed with minimal sample preparation. The use of MOLI may aid in rapid screening methodologies.

Without wishing to limited by a specific theory, mechanism, or mode of action, one mode of ionization may involve Lewis acid/base interactions between cation/anion pairs of the metal oxide and the analyte. In some aspects, isotope labeling has shown that protonation of an analyte may occur from another surface-bound analyte, without involvement of either solvent or surface-adsorbed water.

In some aspects, designer metal oxides may be used. Designer metal oxides may be used in specific applications based on previously observed chemical activity. In some embodiments, the use of designer metal oxides may provide compounds, surfaces, and techniques tailored toward analysis of specific analytes, for example NiO compounds and surfaces disclosed herein are useful in the analysis of lipids.

In various embodiments, compounds and surfaces relevant to the fields of bio-energy, food, homeland defense, pharmaceutical, agrochemical, and biomedical chemistry are described, wherein the compounds and surfaces may possess specific activities.

Mass Spectrometry

MOLI can be coupled to any mass spectrometer or mass analyzer known in the art. Mass spectrometry is a sensitive and accurate technique for separating and identifying molecules. Generally, mass spectrometers have two main components, an ion source for the production of ions and a mass-selective analyzer for measuring the mass-to-charge ratio of ions, which is and converted into a measurement of mass for these ions. Several ionization methods are known in the art and described herein. In some embodiments, a mass-distinguishable product can be charged prior to, during, or after cleavage. In some embodiments, a mass-distinguishable product that will be measured by mass spectrometry does not always require a charge since a charge can be acquired through the mass spectrometry procedure. In mass spectrometry analysis, optional components of a mass-distinguishable product such as charge and detection moieties can be used to contribute mass to the mass-distinguishable product.

Mass spectrometry methods are well known in the art (see Burlingame et al. Anal. Chem. 70:647 R-716R (1998); Kinter and Sherman, Protein Sequencing and Identification Using Tandem Mass Spectrometry Wiley-Interscience, New York (2000); which is incorporated by reference in its entirety).

Different mass spectrometry methods are disclosed herein, for example, quadrupole mass spectrometry, ion trap mass spectrometry, time-of-flight mass spectrometry (TOF), and tandem mass spectrometry. This may allow for flexibility in customizing detection protocols for specific analytes and analyte mixtures. In some embodiments, mass spectrometers can be programmed to transmit all ions from the ion source into the mass spectrometer either sequentially or at the same time. In other embodiments, mass spectrometers can be programmed to select ions of a particular mass for transmission into the mass spectrometer while blocking other ions. In other embodiments, multiple mass spectrometers can be used.

The ability to precisely control the movement of ions in a mass spectrometer can aid in increasing the flexibility of detection protocols. Variable and customizable detection protocols can be aid in analyzing large number of mass-distinguishable products, for example, from a multiplex experiment or a complex mixture. For example, in a multiplex experiment with a large number of mass-distinguishable products individual reporters can be analyzed/detected separately. In some embodiments, un-cleaved or partially-cleaved analytes may be selected out of the assay, thereby reducing the background.

In many cases, mass spectrometers can resolve ions with small mass differences and measure the mass of ions with a high degree of accuracy. Therefore, mass-distinguishable products of similar masses can be used together in the same experiment since the mass spectrometer can, in many cases, differentiate the mass of closely related analytes. In some cases, the high degree of resolution and mass accuracy achieved using mass spectrometry methods allows the use of complex analyte mixtures. In some cases, know tags or probes may be added to a mixture as standards to aid in characterization of analytes.

In some embodiments, for quantification, controls can be used to provide a signal in relation to the amount of the analyte that can be present or introduced. In some cases, a control can allow conversion of relative mass signals into absolute quantities, for example by addition of a known quantity of a mass tag, mass probe, or mass label to a sample before detection of the mass-distinguishable products. Any control tag, probe, or label that does not interfere with detection of the mass-distinguishable products can be used for normalizing the mass signal. Such standards preferably have separation properties that are different from those of any of the molecular tags in the sample, and could have the same or a different mass signatures.

In some embodiments, mass spectrometers may achieve high sensitivity by using a large portion of the ions that are formed by the ion source and efficiently transmitting these ions through one or more mass analyzer(s) to one or more detector(s). This may allow the analysis of limited amounts of sample using mass spectrometry. This can be performed in a multiplex experiment where the amount of each mass-distinguishable product species may be small.

In many mass spectrometry methods, the movement of gas-phase ions can be precisely controlled using electromagnetic fields. The movement of ions in these electromagnetic fields is proportional to the m/z of the ion, allowing the measurement of m/z and the determination of mass. The movement of ions in these electromagnetic fields allows the ions to be contained and focused which accounts for the high sensitivity of mass spectrometry. During the course of m/z measurement, ions are transmitted with high efficiency to particle detectors that record the arrival of these ions. The quantity of ions at each m/z is demonstrated by peaks on a graph where the x axis is m/z and the y axis is relative abundance. Different mass spectrometers have different levels of resolution, that is, the ability to resolve peaks between ions closely related in mass. In some variations the resolution can be defined as R=m/delta m, where m is the ion mass and delta m is the difference in mass between two peaks in a mass spectrum. For example, a mass spectrometer with a resolution of 1000 can resolve an ion with a m/z of 100.0 from an ion with a m/z of 100.1.

Mass Analyzers

A wide variety of mass analyzers can be used with the disclosed compounds, surfaces, and methods. Examples of suitable mass analyzers include quadrupoles, RF multipoles, ion traps, and time-of-flight (TOF), ion cyclotron resonance (ICR), ion trap, linear ion trap, Orbitrap, and sector mass analyzers. Examples of tandem mass analyzers include TOF-TOF, trap-TOF, triple quadrupoles, and quadrupole-linear ion traps (e.g., 4000 Q TRAP® LC/MS/MS System, Q TRAP® LC/MS/MS System), a quadrupole TOF (e.g., QSTAR.RTM.® LC/MS/MS System).

Several types of mass spectrometer are available or can be produced with various configurations. In many embodiments, mass spectrometers have one or more of the following components: an ion source (in this case MOLI), a mass analyzer, a detector, a vacuum system, and instrument-control system, and a data system. Differences between these components may help define a specific mass spectrometer and its capabilities. Exemplary mass analyzers include a quadrupole mass filter, ion trap mass analyzer and time-of-flight mass analyzer.

Quadrupole mass spectrometry uses a quadrupole mass filter or analyzer. This type of mass analyzer may be composed of four rods arranged as two sets of two electrically connected rods. A combination of rf and dc voltages are applied to each pair of rods which produces fields that cause an oscillating movement of the ions as they move from the beginning of the mass filter to the end. The result of these fields is the production of a high-pass mass filter in one pair of rods and a low-pass filter in the other pair of rods. Overlap between the high-pass and low-pass filter leaves a defined m/z that can pass both filters and traverse the length of the quadrupole. This m/z is selected and remains stable in the quadrupole mass filter while all other m/z have unstable trajectories and do not remain in the mass filter. A mass spectrum results by ramping the applied fields such that an increasing m/z is selected to pass through the mass filter and reach the detector. In addition, quadrupoles can also be set up to contain and transmit ions of all m/z by applying a rf-only field. This allows quadrupoles to function as a lens or focusing system in regions of the mass spectrometer where ion transmission is needed without mass filtering. This will be of use in tandem mass spectrometry as described further below.

In many embodiments, mass analyzers described herein, can be programmed to analyze a defined m/z or mass range. This property of mass spectrometers is useful for the invention described herein. Since the mass range of cleaved mass-distinguishable products will be known prior to an assay, a mass spectrometer can be programmed to transmit ions of the projected mass range while excluding ions of a higher or lower mass range. The ability to select a mass range can decrease the background noise in the assay and thus increase the signal-to-noise ratio. In addition, a defined mass range can be used to exclude analysis of any uncleaved or un-ionized analytes. Therefore, in some embodiments, the mass spectrometer can be used as a separation step as well as detection and identification of the mass-distinguishable products.

Ion trap mass spectrometry uses an ion trap mass analyzer. In these mass analyzers, fields are applied so that ions of all m/z are initially trapped and oscillate in the mass analyzer. Ions enter the ion trap from the ion source through a focusing device such as an octapole lens system. Ion trapping takes place in the trapping region before excitation and ejection through an electrode to the detector. Mass analysis is accomplished by sequentially applying voltages that increase the amplitude of the oscillations in a way that ejects ions of increasing m/z out of the trap and into the detector. In contrast to quadrupole mass spectrometry, all ions are retained in the fields of the mass analyzer except those with the selected m/z. Ion trap mass analyzers may be used in with MOLI. In some embodiments, ion trap mass analyzers can have very high sensitivity, as long as one is careful to limit the number of ions being trapped at one time. Control of the number of ions can be accomplished by varying the time over which ions are injected into the trap. The mass resolution of ion traps is similar to that of quadrupole mass filters, although ion traps do have low m/z limitations.

Time-of-flight mass spectrometry uses a time-of-flight mass analyzer. For this method of m/z analysis, an ion is first given a fixed amount of kinetic energy by acceleration in an electric field (generated by high voltage). Following acceleration, the ion enters a field-free or "drift" region where it travels at a velocity that is inversely proportional to its m/z. Therefore, ions with low m/z travel more rapidly than ions with high m/z. The time required for ions to travel the length of the field-free region is measured and used to calculate the m/z of the ion.

One consideration in this type of mass analysis is that the set of ions being studied be introduced into the analyzer at the same time. For example, this type of mass analysis is well suited to ionization techniques like laser desorption/ionization which may, in some cases, produce ions in short well-defined pulses. Another consideration is to control velocity spread produced by ions that have variations in their amounts of kinetic energy. The use of longer flight tubes, ion reflectors, or higher accelerating voltages can help minimize the effects of velocity spread. In many cases, time-of-flight mass analyzers can have a high level of sensitivity and a wider m/z range than quadrupole or ion trap mass analyzers. In some embodiments, data can be acquired quickly with time of flight of mass analyzers because scanning of the mass analyzer is often unnecessary.

In some embodiments, tandem mass spectrometry can be used, wherein combinations of mass analyzers are employed. Tandem mass spectrometry can use a first mass analyzer to separate ions according to their m/z in order to isolate an ion of interest for further analysis. The isolated ion of interest can then be broken into fragment ions (called collisionally activated dissociation or collisionally induced dissociation) and the fragment ions analyzed by a second mass analyzer. In some cases tandem mass spectrometry systems are called tandem-in-space systems because two mass analyzers may be separated in space, for example by a collision cell. Tandem mass spectrometry systems also include tandem-in-time systems where one mass analyzer is used, however one or more mass analyzer(s) is used sequentially to isolate an ion, induce fragmentation, and perform mass analysis.

Mass spectrometers in the tandem-in-space category can have more than one mass analyzer. For example, a tandem quadrupole mass spectrometer system can have a first quadrupole mass filter, followed by a collision cell, followed by a second quadrupole mass filter and then the detector. Another arrangement is to use a quadrupole mass filter for the first mass analyzer and a time-of-flight mass analyzer for the second mass analyzer with a collision cell separating the two mass analyzers. Other tandem systems are known in the art can include reflectron-time-of-flight, tandem sector, and sector-quadrupole mass spectrometry.

Mass spectrometers in the tandem in time category have one mass analyzer that performs different functions at different times. For example, an ion trap mass spectrometer can be used to trap ions of all m/z. A series of rf scan functions are applied which ejects ions of all m/z from the trap except the m/z of ions of interest. After the m/z of interest has been isolated, an rf pulse is applied to produce collisions with gas molecules in the trap to induce fragmentation of the ions. Then the m/z values of the fragmented ions are measured by the mass analyzer. Ion cyclotron resonance instruments, also known as Fourier transform mass spectrometers, are an example of tandem-in-time systems.

Several types of tandem mass spectrometry experiments can be performed by controlling the ions that are selected in each stage of the experiment. The different types of experiments can use different modes of operation, sometimes called "scans," of the mass analyzers. In a first example, called a mass spectrum scan, the first mass analyzer and the collision cell transmit all ions for mass analysis into the second mass analyzer. In a second example, called a product ion scan, the ions of interest are mass-selected in the first mass analyzer and then fragmented in the collision cell. The ions formed are then mass analyzed by scanning the second mass analyzer. In a third example, called a precursor ion scan, the first mass analyzer is scanned to sequentially transmit the mass analyzed ions into the collision cell for fragmentation. The second mass analyzer mass-selects the product ion of interest for transmission to the detector. Therefore, the detector signal is the result of all precursor ions that can be fragmented into a common product ion. Other experimental formats include neutral loss scans where a constant mass difference is accounted for in the mass scans. The use of these different tandem mass spectrometry scan procedures can be used with the measurement of large sets of reporter tags in a single experiment, as with multiplex experiments.

Applications/Analyte Sources

Any analyte known in the art can be detected using MOLI as described herein.

In various embodiments small analytes and mixtures of small analytes may be characterized. In some embodiments the analyte is more than about 100 Da (Dalton), 200 Da, 300 Da, 400 Da, 500 Da, 600 Da, 700 Da, 800 Da, 900 Da, 1000 Da, 1100 Da, 1200 Da, 1300 Da, 1400 Da, 1500 Da, 1600 Da, 1700 Da, 1800 Da, 1900 Da, 2000 Da, 2100 Da, 2200 Da, 2300 Da, 2400 Da, 2500 Da, 2600 Da, 2700 Da, 2800 Da, 2900 Da, 3000 Da, 3100 Da, 3200 Da, 3300 Da, 3400 Da, 3500 Da, 3600 Da, 3700 Da, 3800 Da, 3900 Da, 4000 Da, 4500 Da, 5000 Da, 5500 Da, 6000 Da, 7000 Da, 8000 Da, and less than about 200 Da, 300 Da, 400 Da, 500 Da, 600 Da, 700 Da, 800 Da, 900 Da, 1000 Da, 1100 Da, 1200 Da, 1300 Da, 1400 Da, 1500 Da, 1600 Da, 1700 Da, 1800 Da, 1900 Da, 2000 Da, 2100 Da, 2200 Da, 2300 Da, 2400 Da, 2500 Da, 2600 Da, 2700 Da, 2800 Da, 2900 Da, 3000 Da, 3100 Da, 3200 Da, 3300 Da, 3400 Da, 3500 Da, 3600 Da, 3700 Da, 3800 Da, 3900 Da, 4000 Da, 4500 Da, 5000 Da, 5500 Da, 6000 Da, 7000 Da, 8000 Da, 9000 Da. In some embodiments analyztes greater than about 10 kDa may be detected/analyzed with MOLI.

In some embodiments, the disclosed compounds, surfaces, and methods may be used to analyze various analytes and samples, for example a specimen or culture (e.g., microbiological cultures) that may include lipids, proteins, carbohydrates, nucleic acids, etc.

MOLI may be used to detect/analyze any known analyte. Analytes and samples may derive from biological, environmental, or experimental sources. In some cases, the analyte or sample may be of synthetic origin. Direct detection of lipids is of significant scientific and economic importance due to their ubiquitous role in biological systems and emerging biofuels. Peptides and nucleic acids can also be detected. Biological sources include whole blood, blood products, serum, plasma, cells, umbilical cord blood, chorionic villi, amniotic fluid, cerbrospinal fluid, spinal fluid, lavage fluid (e.g., bronchoalveolar, gastric, peritoneal, ductal, ear, athroscopic), biopsy sample, urine, feces, sputum, saliva, nasal mucous, prostate fluid, semen, lymphatic fluid, bile, tears, sweat, breast milk, breast fluid, embryonic cells and fetal cells. In some embodiments, the biological sample may be derived from animals, plants, bacteria, algae, fungi, viruses, etc. In some cases the source of the biological sample is blood, and/or plasma. As used herein, the term "blood" encompasses whole blood or any fractions of blood, such as serum and plasma as conventionally defined. Blood plasma refers to the fraction of whole blood resulting from centrifugation of blood treated with anticoagulants. Blood serum refers to the watery portion of fluid remaining after a blood sample has coagulated. Environmental samples include environmental material such as surface matter, soil, water and industrial samples, as well as samples obtained from food and dairy processing instruments, apparatus, equipment, utensils, disposable and non-disposable items. These examples are not to be construed as limiting the sample types applicable to the present invention.

In various embodiments, analytes and/or samples may be derived from environmental sources, such as oil, petroleum, gas, etc. In some embodiments, the disclosed compounds, surfaces, and methods may be used to characterize processed petroleum products, such as fuel, including bio-fuel.

In various embodiments, oil or petroleum products may be characterized by MOLI, for example natural, refined, and semi-refined products, such as tar, crude, oil, refined gas, ethane, LPG, aviation gasoline, motor gasoline, jet fuels, kerosene, gas/diesel oil, fuel oil, naphtha, white spirit, lubricants, bitumen, paraffin waxes, petroleum coke, etc.

Exemplary analytes include, without limitations, esters, amides, alcohols, ethers, poly cyclic aromatics, polycyclic aromatic hydrocarbon, alkenes, thiols, monoacylglycerides (MAG), diacylglycerides (DAG), triacylglycerides (TAG), mixed fatty acids on DAGs and TAGs, phospholipids, animal, plant, bacteria, algae, viruses, nucleic acids, amino acids, peptides, carbohydrates, etc. and combinations thereof.

In some embodiments nucleic acids can be analyzed. A nucleic acid can be a deoxyribonucleotide or ribonucleotide polymer, a combination thereof, or single nucleotides or ribonucucleotides. Nucleic acids may be either single- or double-stranded form, and may be synthetic, natural, or a combination thereof. Nucleic acids include, for example, gene fragments, cDNAs, mRNAs, tRNA, iRNA, snRNA. For the purposes of the present disclosure, these terms are not to be construed as limiting with respect to the length of a nucleic acid. The terms can encompass known analogues of natural nucleotides, as well as nucleotides that are modified in the base, sugar and/or phosphate moieties. The term also encompasses nucleic acids containing modified backbone residues or linkages, which are synthetic, naturally occurring, and non-naturally occurring. Examples of such analogs include, without limitation, phosphorothioates, phosphoramidates, methyl phosphonates, chiral-methyl phosphonates, 2-O-methyl ribonucleotides, peptide-nucleic acids (PNAs).

In some embodiments peptides may be analyzed by MOLI. A peptide may be polymer in which the monomers are amino acids and are joined together through amide bonds, alternatively referred to as a polypeptide. Peptides can include natural and/or unnatural amino acids, for example without limitation, β-alanine, phenylglycine and homoarginine. Peptides may also include synthetic amino acids, as well as amino acids that have been modified to include reactive groups, glycosylation sites, polymers, therapeutic moieties, biomolecules, etc. Amino acids can be either the D- or L-isomer. In addition, other peptidomimetics are also useful in the present invention. As used herein, "peptide" refers to modified polypeptides, for example glycosylated, unglycosylated, and hemi-glycosylated peptides. For a general review, see, Spatola, A. F., in Chemistry And Biochemistry Of Amino Acids, Peptides And Proteins, B. Weinstein, eds., Marcel Dekker, New York, p. 267 (1983), incorporated by reference.

An amino acid can be naturally occurring, synthetic, an amino acid analogs, or an amino acid mimetics. Naturally occurring amino acids are those encoded by the genetic code, as well as those amino acids that are later modified, e.g., hydroxyproline, γ-carboxyglutamate, and O-phosphoserine. Amino acid analogs refers to compounds that may have the same basic chemical structure as a naturally occurring amino acid, i.e., an α carbon that is bound to a hydrogen, a carboxyl group, an amino group, and an R group, e.g., homoserine, norleucine, methionine sulfoxide, methionine methyl sulfonium. Such analogs have modified R groups (e.g., norleucine) or modified peptide backbones, but retain the same basic chemical structure as a naturally occurring amino acid. Amino acid mimetics refers to chemical compounds that have a structure that is different from the general chemical structure of an amino acid, but that function in a manner similar to a naturally occurring amino acid.

EXAMPLES

The following non-limiting examples illustrate aspects of the disclosure. Examples are provided below to illustrate the present compounds, surfaces, and methods of using the same. These examples are not meant to constrain the present invention to any particular application, mechanism, mode, or theory of operation.

Example 1

Metal oxides with similar band gaps (electronic structures) were used to analyze the C16 FAME methyl palmitate. Analysis was carried out by suspending metal oxide particles ~100 mg/ml in hexane and spotting on a traditional MALDI target. Methyl palmitate was then spotted on top of each dried metal oxide and dried. In other embodiments, the metal oxide and analyte may be combined prior to spotting on the target. In further embodiments other compounds may be added, for example, organic reagents, such as a basic organic reagent. The performance of each metal oxide was based on the calculated signal to noise ratio of the [M+H]+ ion.

Figure 2:
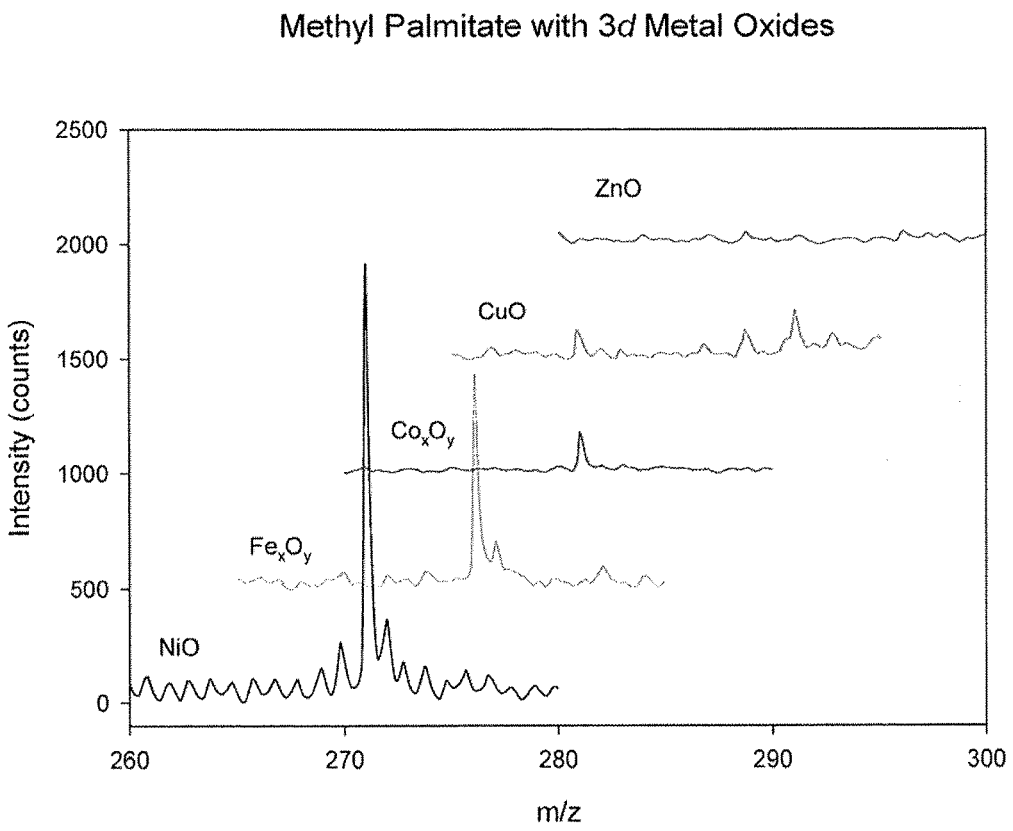
FIG. 2 shows comparative spectra for four metal oxides.

Comparative spectra for four metal oxides is depicted in FIG. 2. Table 3 illustrates the signal to noise of different metal oxides, their exposed facets, their d-spacing, and band gap. NiO had better signal to noise than other metal oxides. Without wishing to be limited to any theory or mode of action, a decrease in band gap may result in more efficient energy transfer. Electronically similar materials do not produce the same result. Geometric morphology may play an important role in MOLI-MS activity. In the case of lipid analysis metal oxides with rock salt structure may have better signal to noise.

TABLE 3

| Metal Oxide | Exposed Facet | d-Spacing Å (JCPDS) | Band Gap (eV) | S/N ratio |
|---|---|---|---|---|
| MgO | <100>, <111> | 4.21 | 8.7 | 171.4/1 |
| $Fe_xO_y$ | <100> | 4.85 | 2.14 | 198.6/1 |
| CoO | <100> | 4.26 | 2.4 | 79.6/1 |
| NiO | <100>, <111> | 4.19 | 4.3 | 278.3/1 |
| CuO | <100> | 2.75 | 1.37, 1.2 | 40.5/1 |
| ZnO | <100> | 2.603 | 3.3 | 15.2/1 |

Example 2

Figure 3:
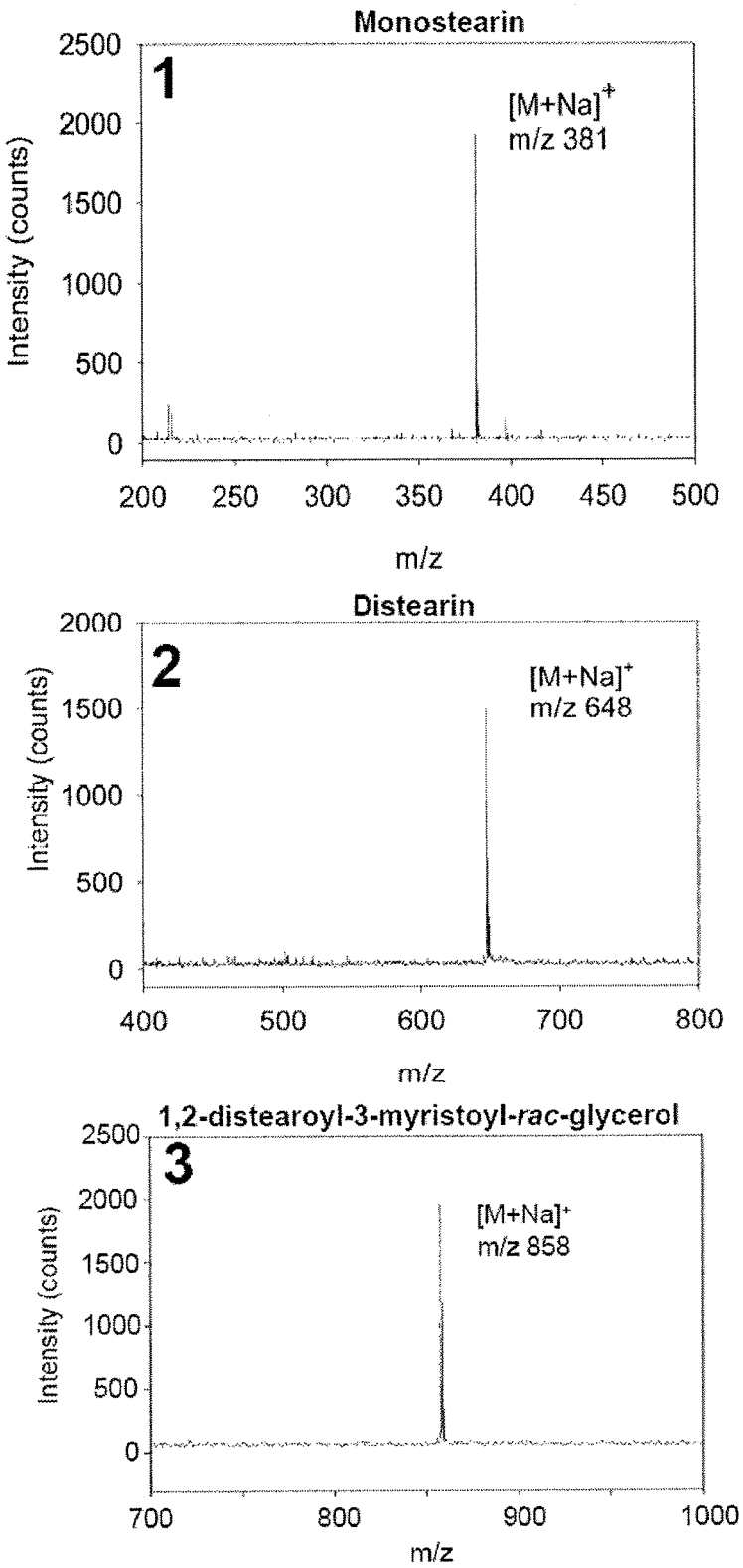
FIG. 3 is shows spectra resulting from laser desorption ionization on NiO<100> of mono-,di-, and triglycerides (1,2, and 3 respectively).

The initial step in the analysis involves spotting a metal oxide suspended in hexane onto a stainless steel MALDI plate. Solutions of lipids in hexane were then spotted onto the dried metal oxide spot. The parameters used for the mass spectrometer settings have been previously described. FIG. 3 shows the spectra for mono-, di-, and tri-glycerides. Peaks are observed as sodiated adducts [M+Na] for all three compounds. Nickelated ions are observed at higher laser fluences.

Example 3

Figure 4:
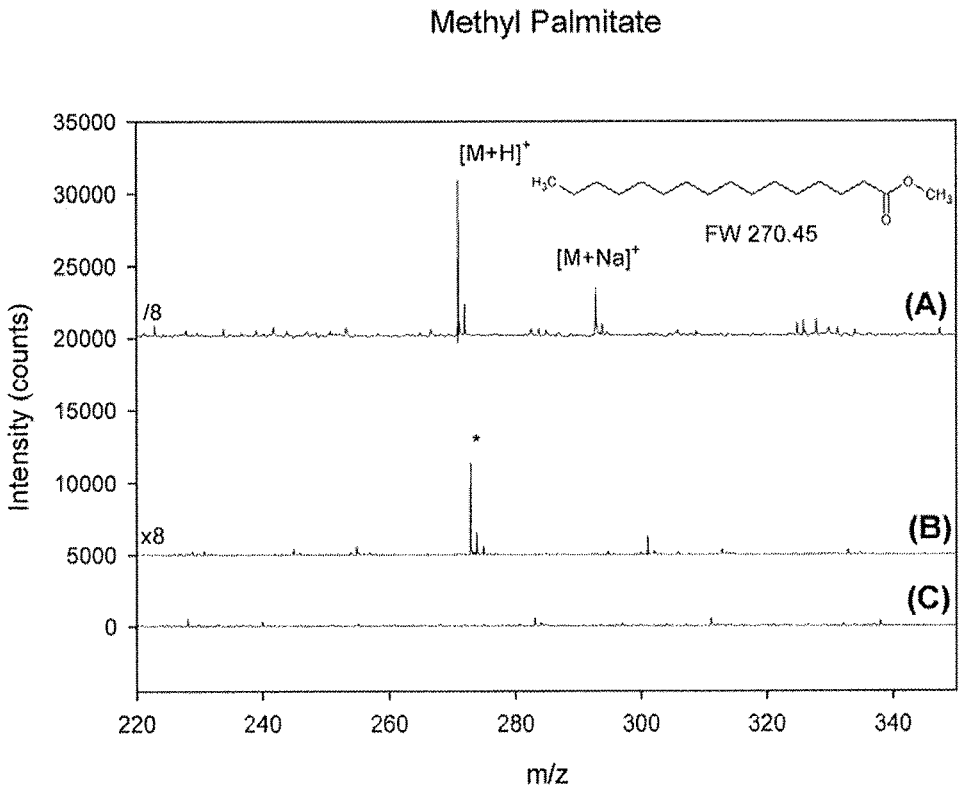
FIG. 4 shows spectra resulting from analysis of various compounds.

Similar results to those of the glyceride species, were obtained for polar lipids such as phosphatadyl choline. Fatty acid methyl esters (FAMEs) produced spectra with both the [M+H]+ peak as well as sodium adducts. The spectrum of methyl palmitate obtained with NiO is compared to traditional MALDI using 2,5-dihydroxybenzoic acid (2,5 DHB) as a matrix, and to thermal desorption (bare steel plate). The strongest peak in the traditional MALDI spectrum is the protonated dimer of 2,5 DHB.17 Background peaks were absent in methyl palmitate spectrum obtained with NiO in FIG. 4, however, peaks representing decomposition products are observed below the pseudomolecular ion. Spectra are normalized to be comparable. The peak in spectrum (B) marked with an asterisk is the protonated dimer of 2,5-DHB.

Example 4

Figure 5:
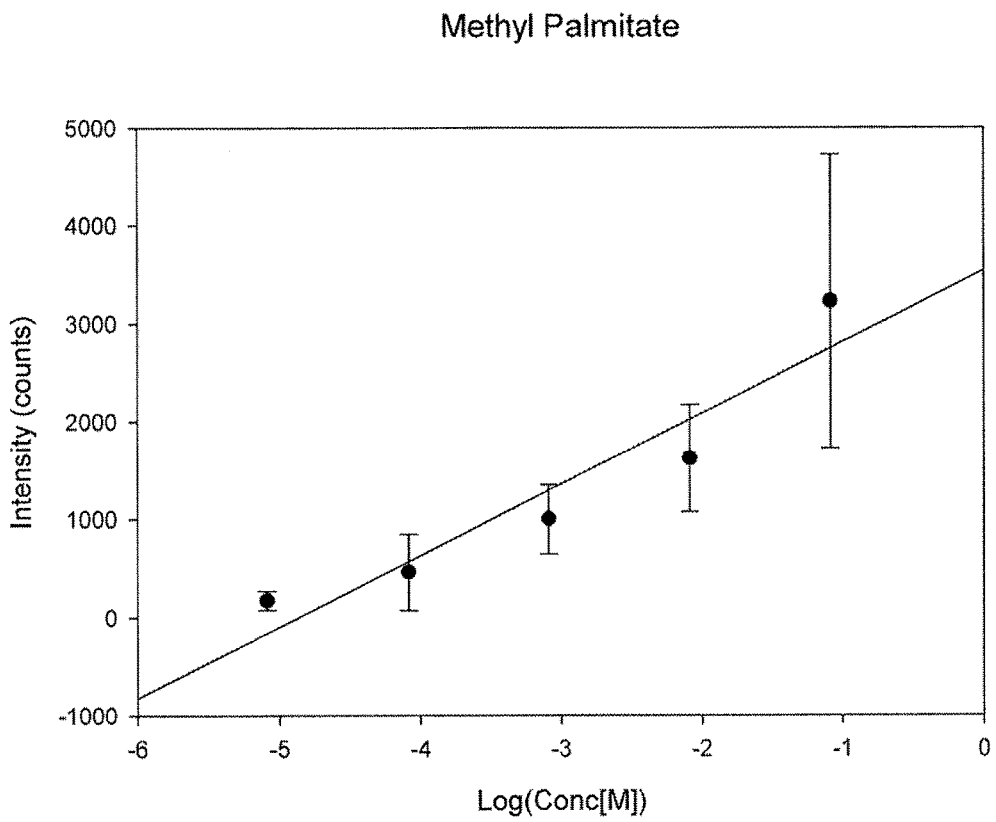
FIG. 5 shows a linear response for C16:0 FAME methyl pamlitate.

The quantitative limits of MOLI-MS were determined. The linearity of five ten-fold serial dilutions of methyl palmitate plotted against ion counts is shown in FIG. 5. The limit of detection of methyl palmitate was approximately 300 ng/mL.

Example 5

In an effort to elucidate the underlying characteristics leading to the observed MOLI-MS activity, geometrical (structural) and electronic (band gap) properties were evaluated. Initial comparison was made between NiO and MgO because both possess rock salt structure and similar d-spacings. Without wishing to be limited to a specific theory or mode of operation, the variation in MOLI-MS response between NiO and MgO surfaces suggested that geometrical similarity alone does not determine ionization efficiency, and electronic contributions are important. Thus, several 3d metal oxides, $Fe_xO_y$, $Co_xO_y$, CuO, and ZnO, with varying electronic properties were studied and the NiO system consistently produced the best signal to noise ratio 20 and sensitivity for the pseudomolecular ion [M+H]+. The results of this study showed that NiO<100> has the highest signal to noise ratio for MOs tested in MOLI-MS of lipids.

Example 6

Several experiments were conducted to determine the source of the proton in the pseudomolecular ion peak observed for the FAMES. The solvent was eliminated as the proton source by using perfluorohexane in lieu of hexane during sample preparation. The resulting mass spectrum of methyl palmitate was unaffected. The effect of surface adsorbed water was determined by heating the NiO surface to 350° C. for 4 hours in vacuum followed by exposure to a deuterium oxide atmosphere overnight. The spectrum obtained using this material with methyl palmitate did not show a $[M^+D]^+$ peak. The elimination of the solvent and absorbed water as the source of the proton left the analyte as the remaining likely source of the proton. This assumption was confirmed by analyzing a 1:100 mixture of methyl palmitate and perdeuteromethyl stearate. The methyl palmitate M+1 peak was shifted to M+2 indicating that the abstraction of a deuteron had occurred. Supporting the hypothesis that protons were originating from an adsorbed analyte molecule.

Example 7

Figure 6:
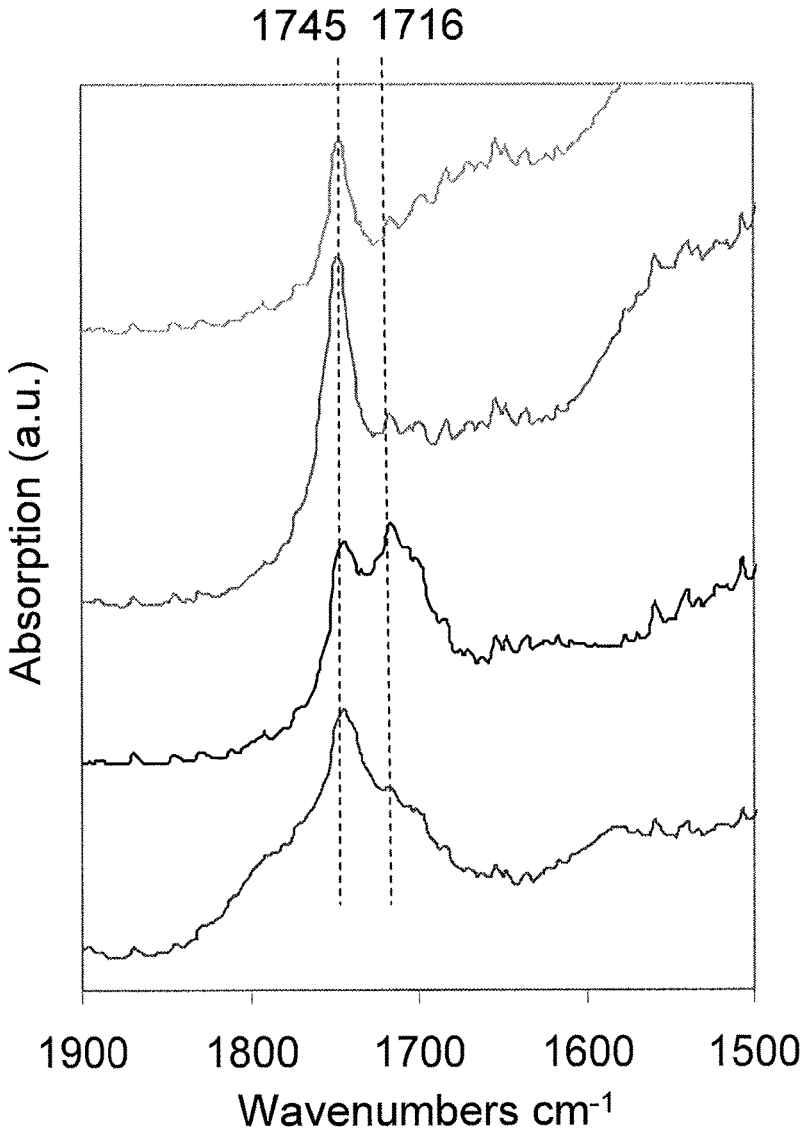
FIG. 6 shows DRIFTS peaks of, from top to bottom, MgO<100>, MgO<111>, NiO<100>, and NiO<111>.

The adsorption of methyl palmitate in hexane on a series of magnesium and nickel oxide surfaces with varying morphologies was explored using diffuse reflectance infrared spectroscopy (DRIFTS). Methyl palmitate adsorption on all of the metal oxides, regardless of morphology, resulted in a strong peak absorption around 1745 cm-1. This peak is due to carbonyl (C=O) stretching of physisorbed methyl palmitate. In addition to this peak, methyl palmitate adsorption on NiO with a <100> surface facet produced an additional peak at 1716 cm−1, as shown in FIG. 6. This peak is ascribed to chemisorption of the carbonyl oxygen of methyl palmitate to a nickel ion on the NiO surface. NiO<100> clearly exhibits the strongest peak at 1716 $cm^{-1}$ corresponding to chemisorption of the carbonyl group. Without wishing to be limited to a theory or mode of action, chemisorption through the carbonyl oxygen is likely to make the alpha proton on the adsorbed methyl palmitate more acidic, providing a source of protons to form the $[M^+H]^+$ ion. In the case of NiO, chemisorption of the carbonyl oxygen onto Ni can still create a more acidic alpha proton relative to free methyl palmitate. Since NiO has much weaker electron acceptor/donor (Lewis acid/base) sites than MgO nanostructures, the surface is less able to abstract the alpha proton, allowing the proton to be abstracted by another analyte molecule.

Example 8

Dihydroxybenzoic acid (SigmeAldrich, St. Louis, Mo.), nanoparticle calcium oxide (NanoActive Inc., Manhattan, Kans.), tetramethylammonium hydroxide (SigmaAldrich, St. Louis, Mo.), trifluoromethylphenyltrimethylammonium hydroxide as a 5% solution in methanol (TCl, Portland, Oreg.), the basic organic reagent phenyltrimethylammonium hydroxide (TCl, Portland, Oreg.) as a 20% solution in methanol were all purchased commercially. The basic organic reagents were used at 5% in methanol. Based on the supplier's product information, the CaO aggregate size was 4 μ, a crystallite size of <40 nm and a surface area of 20 m2/g. High surface area silica (SBA 15) was prepared according to the method of Stucky. BET characterization of SBA 15 showed a surface area of 901 m2/g. Lipids standards were obtained from SigmaAldrich (St. Louis, Mo.) and were prepared at 100 mg/mL in hexane.

DHB (100 mg/mL in methanol) as a matrix was applied to a stainless steel MALDI sample plate by spotting 1 μL of DHB. One μL of a triacylglyceride (TAG) standard (50 mg in 50/50 vol % hexane/chloroform) was then directly deposited in a sandwich fashion onto the spot, followed by another 1 μL of matrix solution. Vacuum drying was employed between additions.

Nano particle sample preparation consisted of first spotting 1 μL of CaO hexane suspension at ~100mg CaO/mL hexane onto a MALDI plate followed by drying. 1μL of a basic organic reagent was then spotted onto the CaO surface and dried. The analyte (1 μL) was then spotted onto the CaO/basic organic reagent spot and air dried followed by loading of the sample plate into vacuum chamber of the mass spectrometer.

A Perceptive Biosystems Voyager DE STR MALDI-TOF mass spectrometer was used for sample analysis. The operating conditions of instrument have been previously published. The Laser power was adjusted during the analysis. 75% of maximum laser power was used. Files were exported from Voyager Data Explorer software into SigmaPlot v11.0 for data workup.

Figure 7:
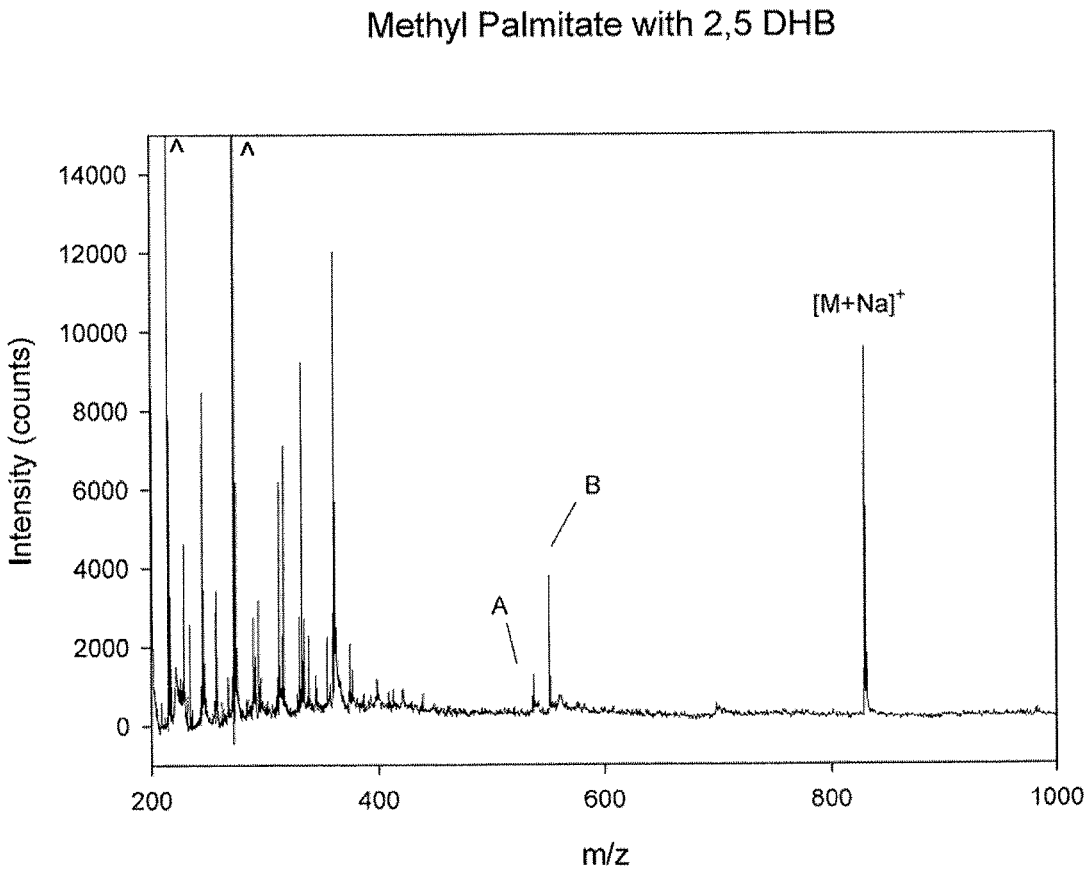
FIG. 7 shows a MALDI spectrum of tripalmitin using DHB.

FIG. 7 shows a MALDI spectrum of tripalmitin using DHB. The tripalmitin peak at m/z 830 is a sodiated molecular ion. M/z 295 is the Na adduct of the DHB dimer minus water and the peaks above m/z 300 are matrix background peaks. The overwhelming intensity of the DHB dimer makes confident assignment of the methyl palmitate peak difficult. The peaks at m/z 556 and 574 are assigned to fragment ions resulting from the pyrolysis of the tripalmitin.

Example 9

Lipids were analyzed by MOLI-MS using DHB as a matrix and TMAH as the basic organic reagent. The use of a traditional matrix with basic organic reagent was approached with some trepidation because of the strong basicity of the basic organic reagent and the acidity of DHB. A sandwich sample preparation was used to provide possible mixing between the analyte and basic organic reagent before contacting the acidic matrix. Surprisingly, a spectrum was obtained for tripalmitin that could be interpreted on the basis of saponification and methylation of the analyte. Again, the major problem with using DHB as a matrix was associated with the DHB dimer minus water peak at m/z 272 that completely overwhelmed the methyl palmitate peak at m/z 271. The peak at m/z 830 is unreacted tripalmitin.

The use of a basic organic reagent was evaluated with NiO, MgO, SBA15, and a blank MALDI plate using TMAH. The metal oxides produced spectra with poor signal-to-noise ratios for the methyl palmitate molecular ion. The use of a basic organic reagent on SBA15 and the blank plate did not produce an observable molecular ion.

Example 10

Figure 8:
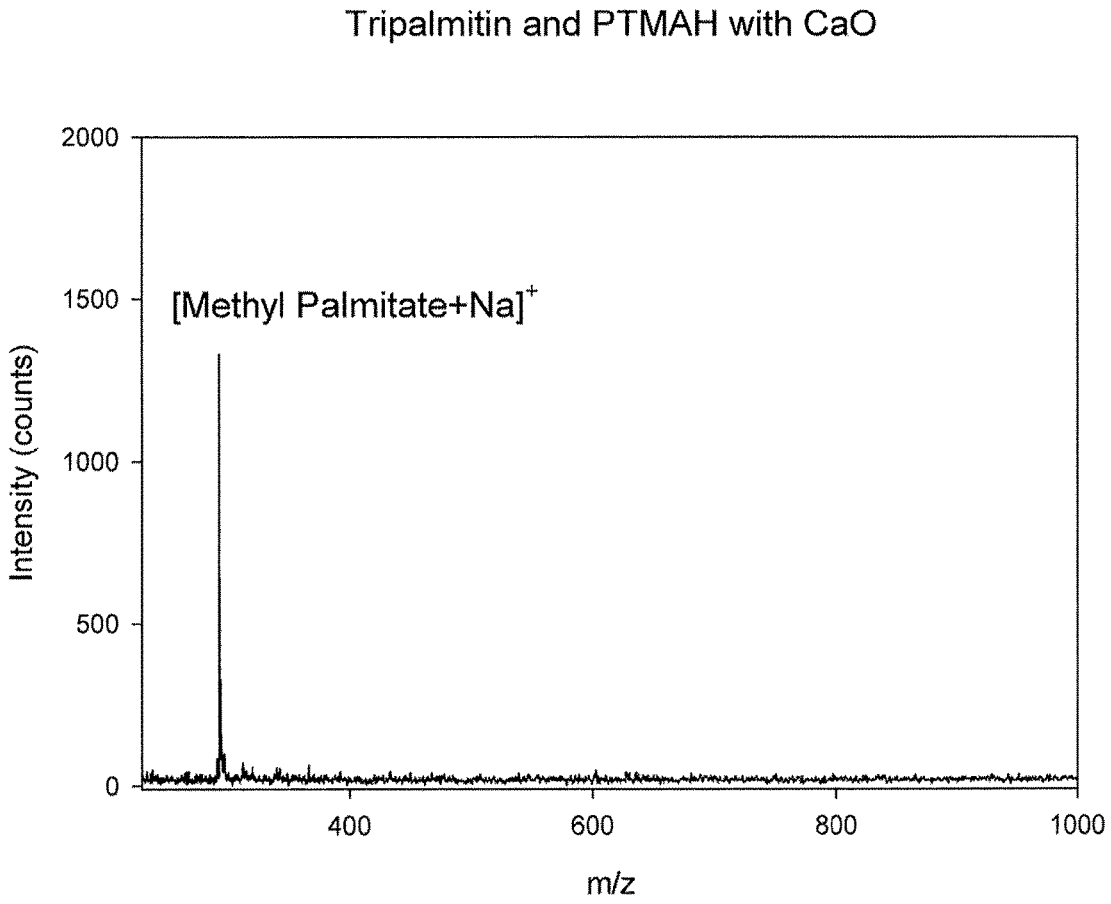
FIG. 8 shows analysis of tripalmitin using CaO and PTMAH.

FIG. 8 is the spectrum of tripalmitin with CaO and TMAH. The m/z 293 peak is the [M+Na]+ species of methyl palmitate and is present without interference of any matrix background peak. The ionization reaction was complete since no tripalmitin peak was observed.

PTMAH, TFTMAH, and TMSH were used in MOLI with CaO and tripalmitin. The results were surprising since PTMAH, a low temperature reagent, produced the best signal-to-noise ratio for the methyl palmitate peak and was used as the reagent of choice with CaO. The other two low temperature reagents, TFTMAH and TMSH, did not perform any better than TMAH.

Example 11

All lipid samples were dissolved in hexane/chloroform. Metal oxide particles tested were suspended in n-hexane and 1 μL was spotted onto a traditional stainless steel MALDI-MS target. The spots were then vacuum dried. Then 1 μL of lipid solution is spotted on top of the dried M.O. droplet. The target is then dried again and loaded into the MALDI-TOF MS mass spectrometer. Mass spectrometric measurements were made on the Voyager DE-STR MALDI-TOF MS. 25 kV accelerating voltage was used with 75% grid voltage and 10 ns delay time. Spectra consist of 100 laser shots.

*Bacillus thuringiensis* spores were purchased as in a 13% suspension sold by a local hardware store for caterpillar control. The spores were collected by centrifugation. *Escherichia coli* (BL-21) obtained from ATCC (Manassas, Va.) was grown overnight on a lysogeny broth plate at 37° C. Bacterial colonies were removed from the plate, suspended in PBS buffer and then applied to the target. Wild-type *Chlamydomonas reinhardtii* (cc-124) was grown to stationary phase in liquid tris-acetate-phosphate medium at 23° C. on a rotary shaker under continuous illumination of 150 μE(μmole photons)/$m^2$s of photosynthetically active radiation. An aliquot was removed directly from the culture and applied to the plate.

The spectrum of DPAME from BT spores using CaO and PTMAH was also determined. This spectrum contains other peaks, however, in comparison to the DART-MS spectrum, a much higher signal-to-noise was obtained for the DPAME peak at rn/z 196 [M+1]. Curie-point pyrolysis-MS (70 eV) of *B. anthracis* spores using TMAH did not show a molecular ion. A peak at rn/z 137 resulting from electron ionization sequential loss of $H_2CO$ and CO from the molecular ion was the highest mass peak in the spectrum that could be attributed to DPAME.

Example 12

Figure 9:
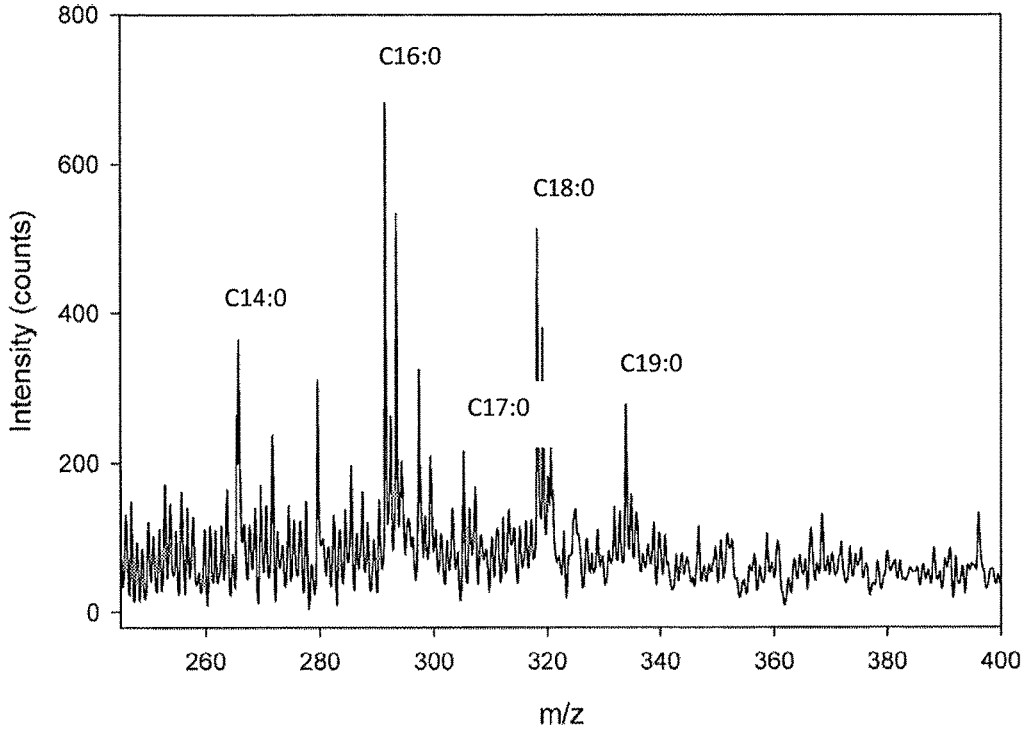
FIG. 9 shows analysis of *E. coli* with CaO and TPMAH

CaO and PTMAH have also been applied to analysis of fatty acids in *E. coli* bacteria and *C. reinhardtii* algae whole cells. Spectra for these *E. Coli* is shown in FIG. 9. The MALDI-MS spectrum of *E. coli* shows a distribution of FAMES from C14:0 to C21:0 dominated by C16:0 and C18:0. The fatty acids in *E. coli* are dependent on specie and growth conditions which makes comparison to the literature difficult. The spectrum of *C. reinhardtii* has C16:0 and C18:1 as its major fatty acids. This fatty acid distribution is similar to that reported by El-Sheekh as determined by gas chromatography. Missing from the spectrum is any significant contribution of C19:0 to C21:0 fatty acids. Algae do not produce significant quantities of odd numbered fatty acids.

Example 13

Figure 1B:
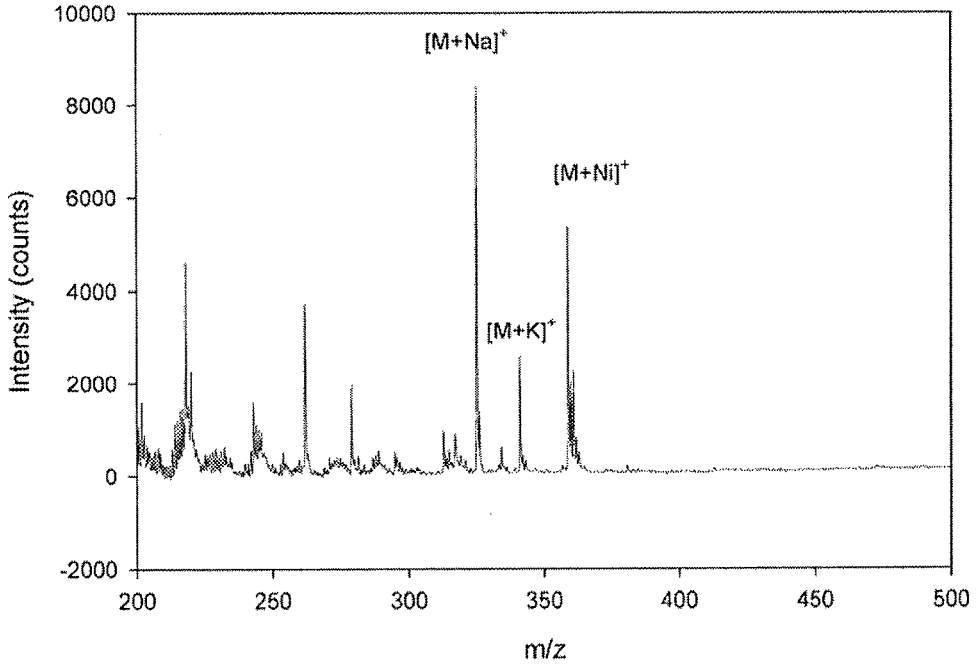

An ester compound was added to the NiO surface as a pretreatment. Methyl acetate was added to the surface and allowed to dry before a solution of tetraalanine was spotting onto the surface. FIGS. 1*a* and 1*b* show an increase in sensitivity upon modification of the surface with methyl acetate, for analysis of tetraalanine. Without wishing to be limited to any mechanism or mode of action, tetraalanine may serve as a proton source, via the ester alpha protons for analytes on the NiO surface.

Example 14

Figure 10:
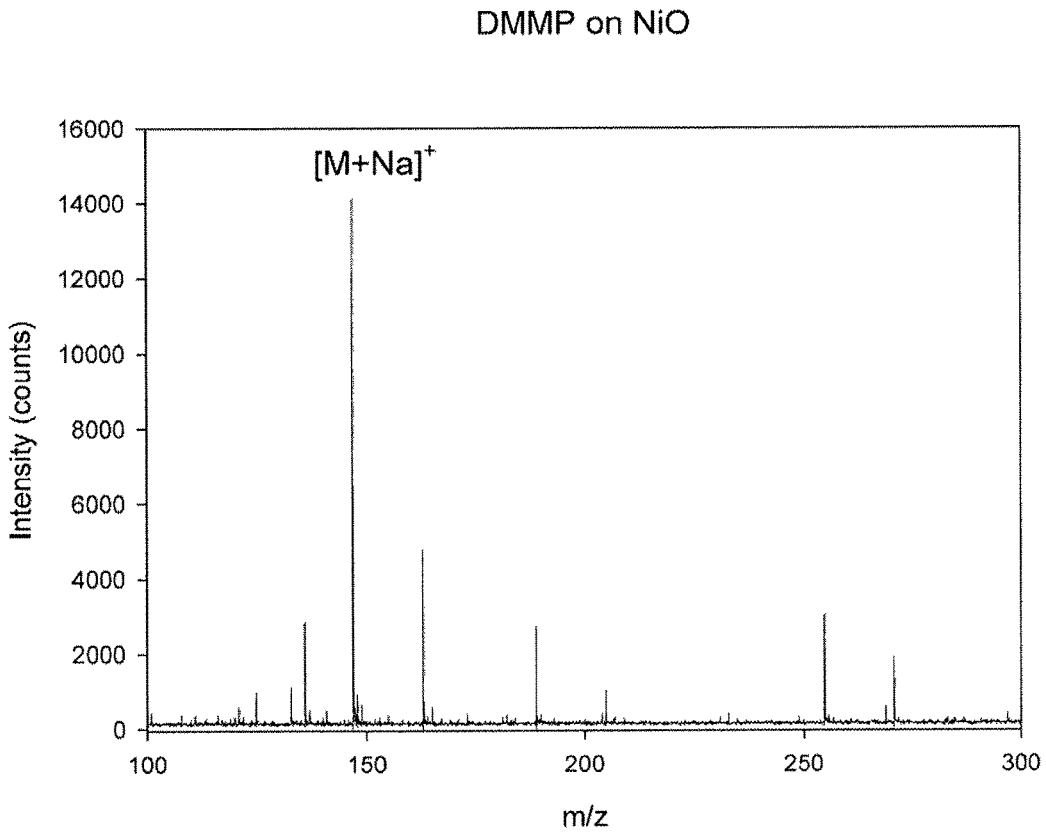
FIG. 10 shows analysis of DMMP on NiO.

MOLI-MS is used as a chemical agent binding and analysis platform. A solution of dimethyl methylphosphonate (DMMP), which is a stimulant for sarin gas, was spotted onto the NiO surface and analyzed in the same fashion as the lipid analytes the spectrum in FIG. 10.

Example 15

Magnesium oxide and NiO with both the <100> and <111> exposed surface facets along with; $Fe_xO_y$, $Co_xO_y$, CuO, and ZnO, were evaluated for their ability to produce ions for methyl palmitate upon laser irradiation. Nickel oxide, ZnO, and MgO particles were purchased from Sigma Aldrich (St. Louis Mo.) and NanoActive Inc (Manhattan, Kans.). $Fe_xO_y$, $Co_xO_y$, and CuO particles were prepared by pyrolytic decomposition of the metal's respective nitrate salt.[23] Slurries of metal oxide powders were prepared for mass spectrometric analysis by adding 100 mg of metal oxide to 1 mL of n-hexane.

Mass spectrometric measurements were made with a Perseptive Biosystems Voyager DE STR MALDI-TOF mass spectrometer equipped with a $N_2$ laser (337 nm). Positive and negative ion experiments were conducted using the reflectron mode with; 25 kV acceleration voltage, 10 ns extraction delay, and 75% grid voltage. The laser fluence was optimized between 60-70%. Mass spectral data was exported and plotted for interpretation with SigmaPlot v11.0. Mass calibration was performed using the protonated and sodiated peaks for methyl stearate and methyl behenate (m/z 299, 321 and m/z 356, 378 respectively).

Surface characterization with DRIFTS used a Thermo-Fisher Nicolet 6700 FT-IR with "Smart Collector" DRIFTS accessories. A liquid nitrogen-cooled mercury cadmium telluride (MCT) detector was used. Spectral parameters were 4 $cm^{-1}$ resolution and 500 scans with KBr (Sigma Aldrich) used as the background material. Adsorption of methyl palmitate was studied by slurrying 100 mg of metal oxide powder with 2 mL of 162 mg/mL methyl palmitate in n-hexane. The hexane was evaporated and the powder with adsorbed methyl palmitate was then placed into the DRIFTS sample cup. Spectral data was then exported from the FTIR software, OMNIC, into Microsoft Excel for interpretation. The resulting spectra were then compared to spectra of the dry powders.

Figure 11:
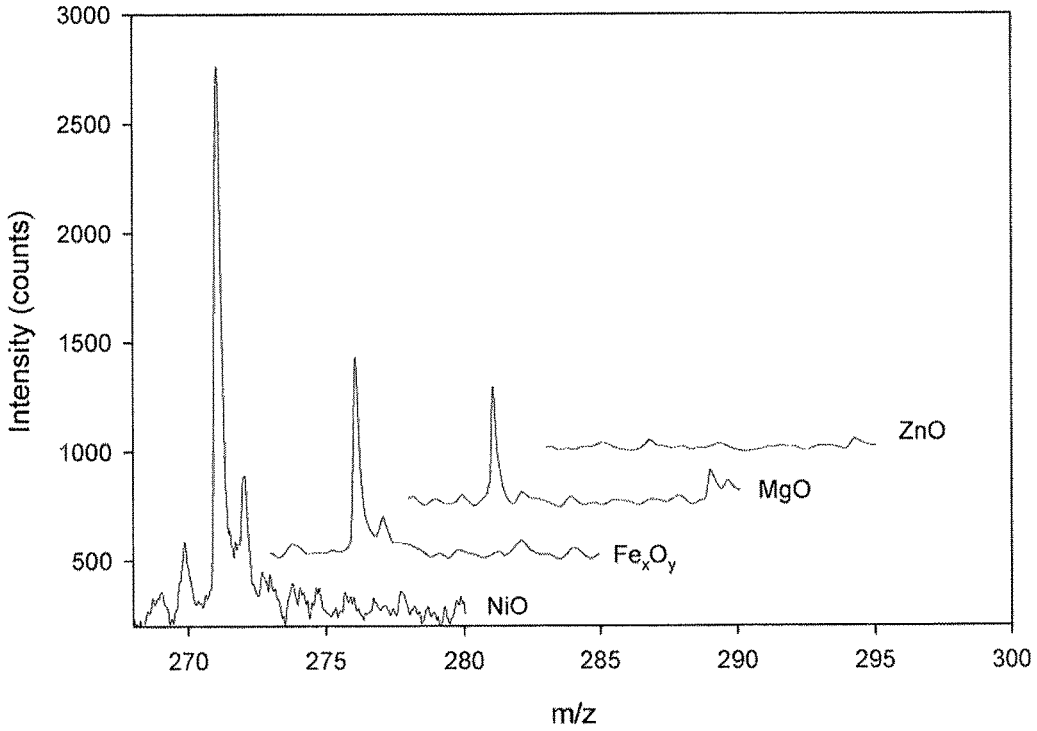
FIG. 11 shows metal oxide laser ionization (MOLI) mass spectra of selected metal oxide surfaces.

FIG. 11 presents the metal oxide laser ionization (MOLI) mass spectra of selected metal oxide surfaces. Spectra obtained for methyl palmitate $[M+H]^+$ ion at m/z 271, with NiO, $Fe_xO_y$, MgO and ZnO. The m/z axis is offset for $Fe_xO_y$, MgO, and ZnO by 5, 10 and 15 Da, while intensity is offset 250, 500, and 750 counts respectively. The results of $Fe_xO_y$, $Co_xO_y$, CuO, and ZnO known to have different geometric and electronic properties than MgO and NiO, as well as a control (a stainless steel MALDI sample plate) are reported as a comparison set. Additionally, diffuse reflectance infrared Fourier transform spectroscopy (DRIFTS), stable isotope labeling, and negative ion laser ionization mass spectrometry results are described in the elucidation of the ionization mechanism.

The protonated molecular ion (m/z 271) was observed in these spectra, and was very weak for ZnO. Sodiated ions and, at high laser fluences, cationized adducts from the metal oxide were also formed; however, these peaks were minimized upon adjustment of the laser power.

Example 16

Negative ion MS showed that in the case of C16:0, C18:0, and C22:0 FAMEs, negative ions were formed from the loss of a proton, and replacement of the methoxy group with a single surface oxygen. Methoxy replacement was verified using $^{18}O$ ester labeled methyl palmitate.

For these experiments, standards of mono-, di-, triacylglycerides and FAMEs were purchased from Sigma Aldrich. All lipid samples were dissolved in 50/50 vol % mixture of n-hexane and chloroform. For the methyl palmitate quantitative evaluaition, a stock solution was prepared by dissolving 113.4 mg in 2 mL of the 50/50 vol. % n-hexane/chloroform solvent. Serial dilutions were prepared first by adding 500 μL of stock solution to 500 μL of n-hexane/chloroform with 6 subsequent dilutions made by adding successive 500 μL hexane/chloroform aliquots to 500 μL of the previous dilution.

Figure 12:
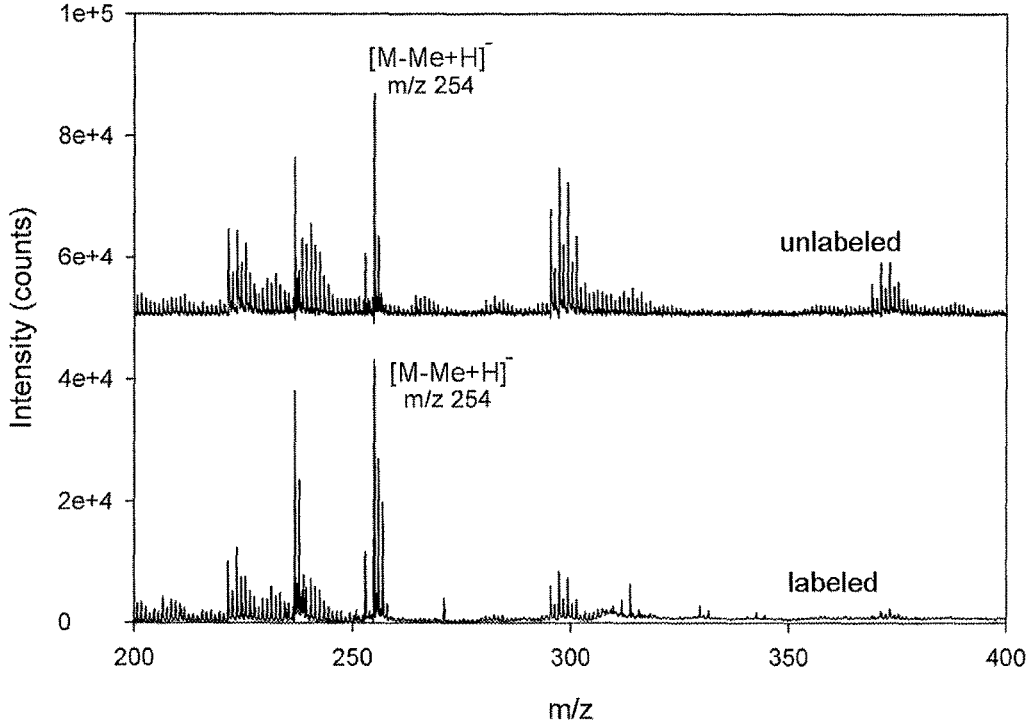
FIG. 12 shows a negative ion spectra of unlabeled and 18O ester labeled methyl palmitate with NiO.

The negative ion results for the labeled and unlabeled standard, shown in FIG. 12, were identical indicating that the labeled methoxy group had been exchanged with an unlabeled surface oxygen.

The reaction of the analyte with the metal oxide surface is similar to the phenomena observed with the stoichiometric destructive adsorption of halogenated hydrocarbons, in which a surface oxide replaces a halogen constituent.

Example 17

To further probe the analyte interaction with the metal oxide surfaces, adsorption of methyl palmitate was examined on a series of magnesium and nickel oxide surfaces with varying surface facets using DRIFTS. For experiments to determine the source of protons during ionization, NiO powder was suspended in 1 mL of perfluorohexane in lieu of n-hexane. To remove any surface bound water from the NiO, the powder was placed in a one-inch diameter Pyrex tube within a Carbolite MTF 12/38/250 tube furnace (Watertown, Wis.) at 350° C. under vacuum. The powder was then allowed to cool overnight under deuterium oxide vapor which had been drawn into the reaction tube by the vacuum.

Perduetero methyl stearate was commercially available from Sigma Aldrich. $^{18}O$ methyl alcohol (Sigma Aldrich) plus palmitic acid catalyzed with HCl was used to prepare $^{18}O$ methyl palmitate. The product was extracted from the reaction mixture with 50/50 vol % hexane chloroform (Sigma Aldrich and Fischer (Pittsburgh, Pa.) respectively). This solution was used without further purification.

Figure 13:
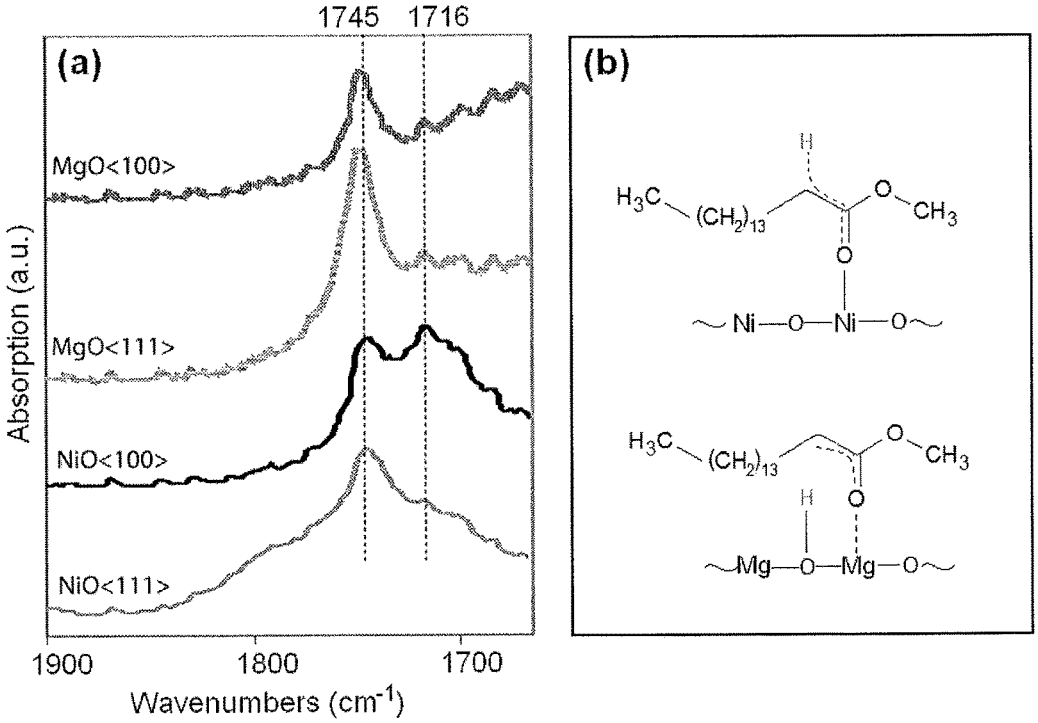
FIG. 13*a* shows the DRIFTS spectra for <100> and <111> nickel and magnesium oxides.
FIG. 13*b* shows pecies formed on the surfaces of NiO and MgO.

FIG. 13*a* shows the DRIFTS spectra for <100> and <111> nickel and magnesium oxides. FIG. 13. (a) DRIFTS analysis of MgO<100>, MgO<111>, NiO<100>, and NiO<111>: (b) Species formed on the surfaces of NiO and MgO.

The most obvious sources for the proton observed in the NiO and MgO ionization processes included: the solvent used in MS sample preparation and surface bound water. The solvent was eliminated by using a non-proton containing solvent, perfluorohexane in lieu of n-hexane. Spectra for this sample preparation contained only $[M+1]^+$ pseudomolecular ions.

Methyl palmitate adsorption on these metal oxides resulted in a strong peak at 1745 $cm^{-1}$ due to the carbonyl stretch of physisorbed methyl palmitate.[32] Based on the work of Truong and coworkers, the second carbonyl absorption at 1716 $cm^{-1}$ was assigned to a carbonyl chemisorbed to a nickel or magnesium ion on the respective surface. Chemisorption of the carbonyl on nanoscale MgO surfaces, has been shown by others to involve an acidic a-proton that was abstracted by oxide ions the surface (FIG. 3*b*). However, NiO is a much weaker electron acceptor/donor (Lewis acid/base) than MgO, therefore, the surface oxides are less likely to abstract an α-proton from an analyte molecule, potentially, allowing the proton to be available for ionization (FIG. 3*b*).

Nickel oxide <100>, MgO<100>, and $Fe_xO_y$ produced the highest signal to noise ratios-NiO 287:1, MgO 171:1, $Fe_xO_y$ 199:1, $Co_xO_y$ 80:1, CuO 41:1, and ZnO 15:1. No peaks were observed in the spectra for MgO<111> and NiO<111> whose surfaces are comprised predominantly of $O^{-2}$ anions. The band gaps for NiO (~4.0 eV), MgO (7.3 eV), and $Fe_xO_y$ (2.2 eV) differ widely from the energy of the photons from the $N_2$ laser (337 nm −3.78 eV) The detection of molecular ions with these three metal oxides, whose band gaps are so varied, suggests that the contribution of photoelectric phenomena to ionization, which was described in previous studies, may not be the only factor influencing ionization activity for metal oxides.

The differing properties, and high S/N of these metal oxides indicates that there are possibly a combination of processes contributing to ionization. Both NiO and MgO possess rock salt structure and similar d-spacings of 4.19 and 4.21 Å respectively, while $Fe_xO_y$ is predominately rhombohedral. The structural difference between $Fe_xO_y$ and NiO or MgO can interfere with ester coordination to the metal oxide surface and the subsequent reaction with the surface in a manner similar to that described by Klabunde et al. The increased ionization with NiO which is a weaker Lewis acid/base, compared to MgO, suggests that the relative strength of the Lewis acid/base pairs is a dominant factor for MOLI MS activity. ZnO produced a weak molecular ion; however, an additional intense peak from an apparent reaction between the lipid material and the surface was observed at 301 Da. The origin of this peak could not be explained based on ionization processes observed for the other metal oxides. Because of their high signal to noise ratios and the previously reported activity of MgO toward esters, NiO and MgO were the focus of further study.

Assessment of the contribution of protons by the surface bound water was achieved by its replacement with deuterium oxide. Spectra obtained for methyl palmitate using NiO treated with $D_2O$ did not show a $[M+2]^+$ peak indicating abstraction of a deuteron from surface bound water had not occurred. Elimination of the solvent and absorbed water as proton sources suggested that the protons originated from the analyte. The spectrum obtained by analyzing a 1:100 mixture of methyl palmitate and perdeuteromethyl stearate showed that the methyl palmitate M+1 peak had shifted to M+2 indicating that abstraction of a deuteron from perdeuteromethyl stearate had occurred (Supplementary Information 2). Based on fundamentals, the most likely source of protons from the ester analyte is the a-position adjacent to the carbonyl.

Example 18

Figure 14:
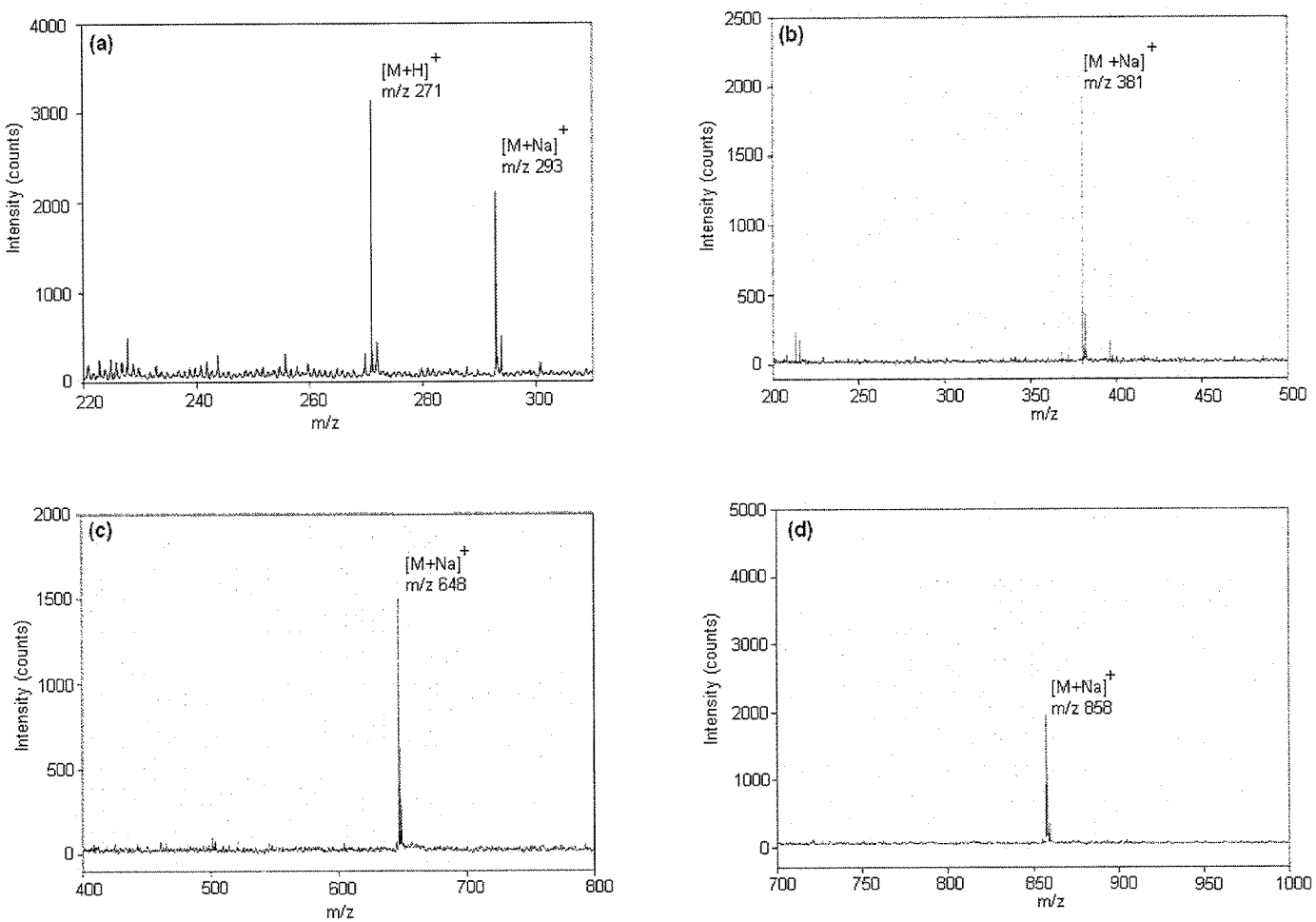
FIG. 14 shows MOLI-MS spectra of (FIG. 14*a*) methyl palmitate, (FIG. 14*b*) monostearoyl-glycerol, (FIG. 14*c*) distearoyl-glycerol, and (FIG. 14*d*) distearoyl-myristoyl-glycerol using a NiO<100> substrate.

Nickel oxide with the <100> facet was chosen for subsequent lipid analysis, based on the insight gained from mechanistic studies, and its improved ionization over the other metal oxides studied. With NiO, fatty acid methyl esters produced protonated and sodiated molecular ions while glycerolipids, carbolipids, and phospholipids were observed primarily as sodiated peaks. Mixed ionization as a consequence of proton/cation exchange within the source of a MALDI mass spectrometer is commonly observed. FIG. 14 shows MOLI mass spectra using a NiO substrate for methyl palmitate, mono-, di-, and tri-acylglycerides [(a), (b), (c), and (d) respectively]. All of these spectra were obtained without background or fragment peaks. It is also important to note that when methyl palmitate was analyzed with the traditional MALDI MS matrix 2,5-dihydroxybenzoic acid, the protonated or sodiated molecular ion were not observed either due to suppression from matrix peaks, or ineffective ionization. Instead, a dimer peak of 2,5 DHB at m/z 273 is detected. Thermal desorption was eliminated as the ionization process by analyzing methyl palmitate on a bare MALDI target which resulted in no observable peaks in the spectrum.

Example 19

Quantitative MALDI MS has been problematic. Since the metal oxide spots used for MOLI MS appeared more homogeneous than traditional MALDI MS matrices, the possibility of improving quantitative data was evaluated on NiO by assessing the linearity of six serial dilutions of methyl palmitate plotted against ion counts (correlation coefficient=0.993). Extrapolation of this data showed that the limit of detection of methyl palmitate was approximately 300 ng/mL. These findings suggest that quantitation using MOLI MS shows promise; however, further experimentation is needed to clarify the quantitative limitations of the technique.

Sample preparation for methyl palmitate quantitation consisted of adding 40-50 mg of NiO directly into 500 μL of each serial dilution and sonicating for 30 minutes to allow the maximum amount of methyl palmitate to adsorb to the NiO particles. One μL of these samples were then removed from the bottom of the suspensions and spotted onto the MALDI target, vacuum dried, and introduced into the mass spectrometer.

Figure 15:
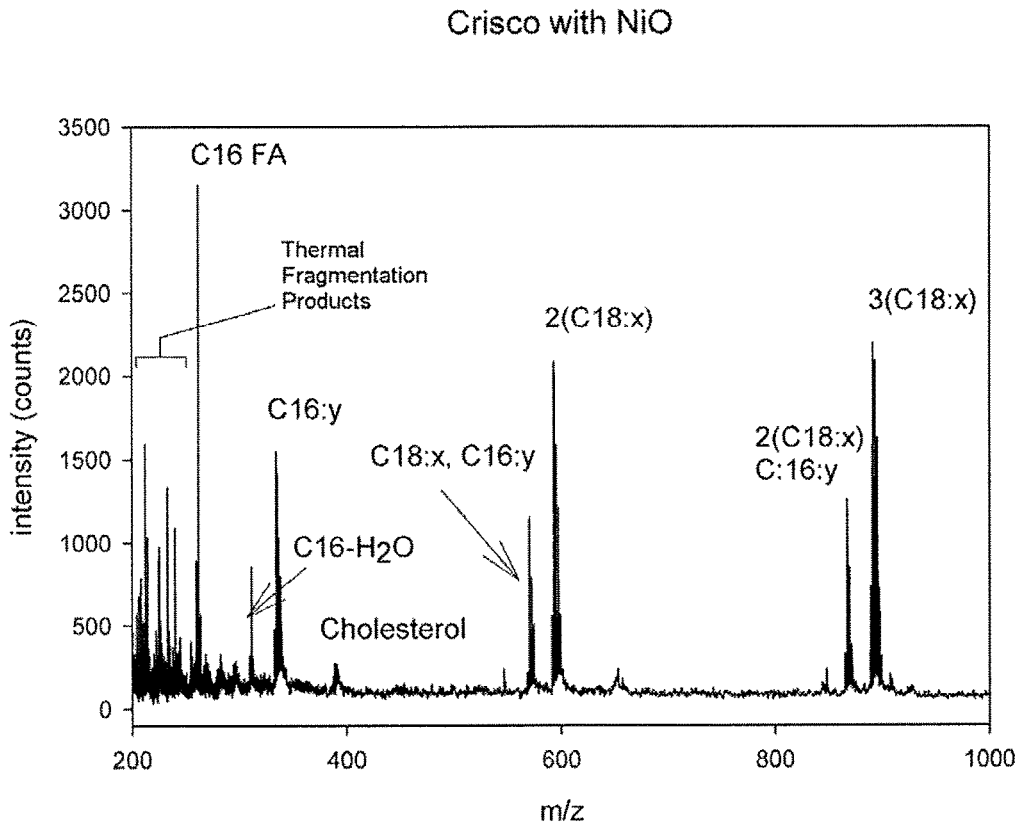
FIG. 15 shows a spectrum obtained for the analysis of vegetable oil shortening with NiO<100>.

MOLI MS has also been applied to complex mixtures of lipids from vegetable oil shortening, bacterial and algal extracts on NiO. The spectrum of vegetable oil shortening is shown in FIG. 15. Vegetable oil shortening was obtained from a local grocery store.

The spectrum shown in FIG. 15 contains peaks resulting from free fatty acids, saturated and unsaturated mono-, di-, tri-acylglycerides, and cholesterol. The exhibited resolution, in this relatively low resolution instrument, allows clear distinction between levels of unsaturation, which is important for product stability and to the food industry, and ultimately impacts societal health. At higher laser fluences, peaks representing thermal decomposition products were observed below m/z 230.

Example 20

Lipid extracts from *E. coli* and *C. reinhardtii* were analyzed with NiO MOLI MS.

*Escherichia coli* (BL-21) (ATCC, Manassas, Va.) was cultured overnight on a Luria-Bertani agar plate at 37° C. Wildtype *Chlamydomonas reinhardtii* (cc-124) (Chlamydomonas Center, St. Paul, Minn.) was grown to stationary phase in liquid tris-acetate-phosphate medium at 23° C. on a rotary shaker under continuous illumination of 150 μE (μmole photons)/$m^2$s of photosynthetically active radiation.

Mass spectrometric sample preparation involved pipetting 1 mL of metal oxide particles from the bottom of this slurry onto a MALDI sample target followed by drying in a vacuum dessicator. The solutions of lipid standards and vegetable oil shortening were applied by pipetting 1 μL of analyte solution directly onto vacuum dried metal oxide spots.

For microbial lipid profiling individual colonies of *E. coli* were removed from the agar plate and suspended in 200 μL of phosphate buffered saline, (PBS). PBS buffer was prepared by adding 8 g of NaCl (Mallinckrodt, Phillipsburg, N.J.), 0.20 g KCl (Mallinckrodt), 0.24 g $KH_2PO_4$ (Mallinckrodt), and 1.44 g $Na_2HPO_4$ (Fisher) to 800 mL of de-ionized water. The pH of the solution was then adjusted to 7.4 with 0.1 M HCl (Sigma Aldrich), and diluted to a final volume of 1 L. The lipids were extracted by adding 200 μL of 66/33 vol % chloroform/methanol (Pharmco-AAPER, Shelbyville, Ky.) to the *E. coli* colonies and vortexing for 30 seconds. The organic phase was separated with a pipette and 1 μL spotted directly onto metal oxide spots. Algal samples were prepared in the same fashion using 200 μL of liquid culture.

Figure 16:
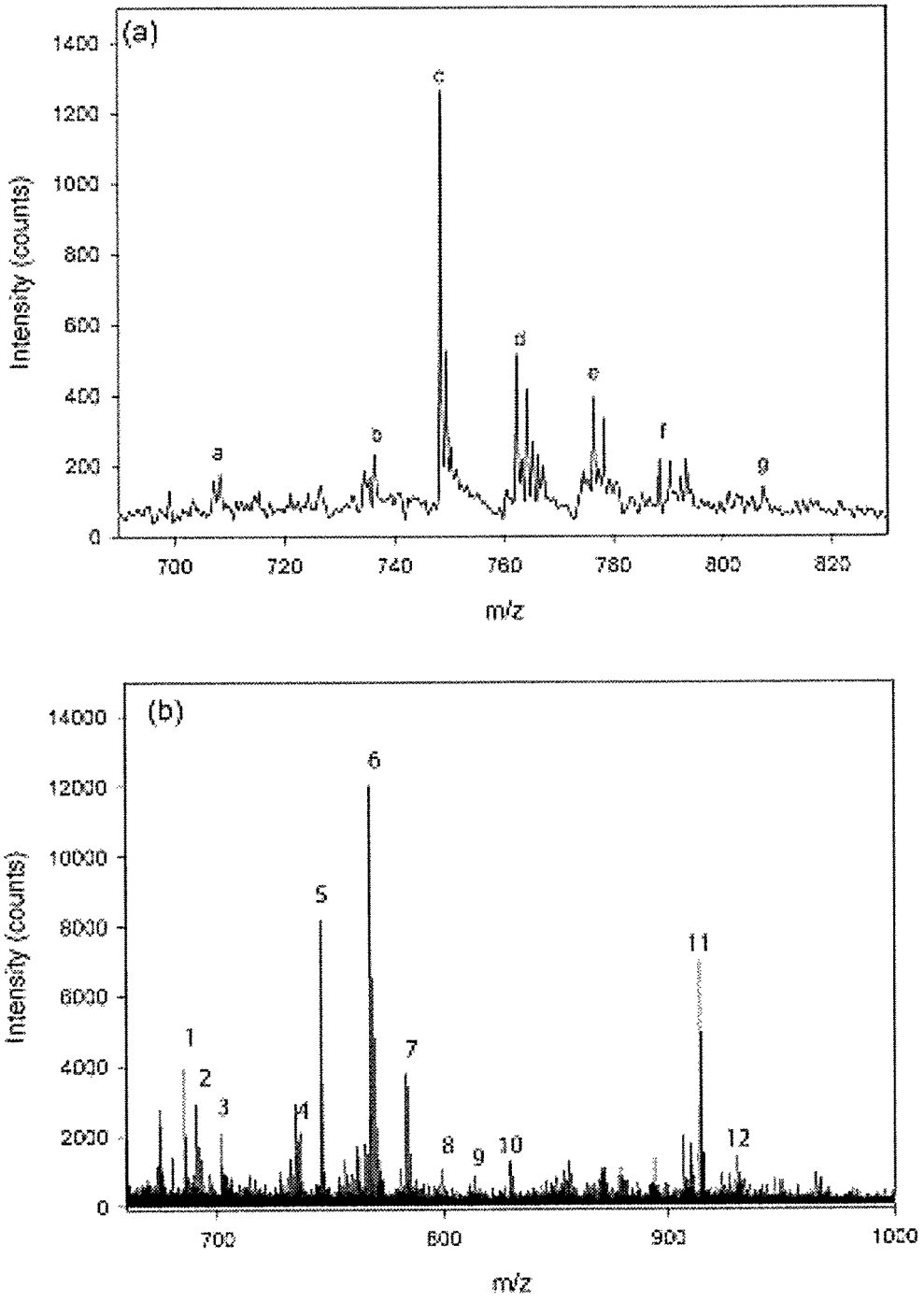
FIG. 16 shows a spectra produced from the MOLI MS analysis of lipid extracts of *E. coli* FIG. 16*a* and *C. reinhardtii* FIG. 16*b*.

FIG. 16*a* is the spectrum obtained from analysis of *E. coli* BL-21 lipid extract. The mass and intensity of the ions produced from this bacterium are in agreement with the characteristic lipids observed in previous work. FIG. 16*b* shows the spectrum of *C. reinhardtii* lipid extract. Again, the lipid species are in agreement with the lipid species previously reported for this organism. Identities for the lipid species observed are listed in Table 4. Spectra obtained for these two microorganisms demonstrate the use of MOLI MS as a rapid screening methodology, which requires minimal sample preparation and offers high sample through-put.

TABLE 4

Lipid species identified in *E. coli* and *C. reinhardtii*. Extracts based on values reported in the literature.

| *E. coli* peak | lipid compound | *C. reinhardtii* peak | lipid compound |
|---|---|---|---|
| a | PE(C30:0) + $2Na^+$—$H^+$ | 1 | impurity + $Na^+$ |
| b | PE(C32:0) + $2Na^+$—$H^+$ | 2 | DGTS(C34:3)-$CO_2$ |
| c | PE(C33:1) + $2Na^+$—$H^+$ | 3 | loss of acyl chain from DGDG(C34:3) + $Na^+$ |
| d | PE(C34:1) + $2Na^+$—$H^+$ | 4 | DGTS(C34:3) + $H^+$ |
| e | PE(C35:1) + $2Na^+$—$H^+$ | 5 | PG(C32:0) + $H^+$ |
| f | PE(C36:2) + $2Na^+$—$H^+$ | 6 | MGDG (C34:6) + $Na^+$ |
| g | PG(C35:1) + $Na^+$ | 7 | MGDG (C34:6) + $K^+$ |
| | | 8 | PC(C38:9) + $H^+$ |
| | | 9 | MGDG (C36:6) + $K^+$ |
| | | 10 | DGDG (C34:4) + $Na^+$ fragment |
| | | 11 | DGDG(C32:1) + $Na^+$ |
| | | 12 | DGDG(C34:6) + $Na^+$ |

PE = Phosphatidylethanolamine
PG = Phosphatidylglycerol
PC = Phosphatidylcholine
DGTS = Diacylglyceryl-trimethyl-homoserine
MGDG = Monogalactosyl-diacylglycerol
DGDG = Digalactosyl-diacylglycerol
(CX:Y) = X carbons present in the acyl chains with Y degrees of unsaturation.

MOLI MS EXTENDED APPLICATIONS

Example 21—Pyrolysis Oils

Figure 17:
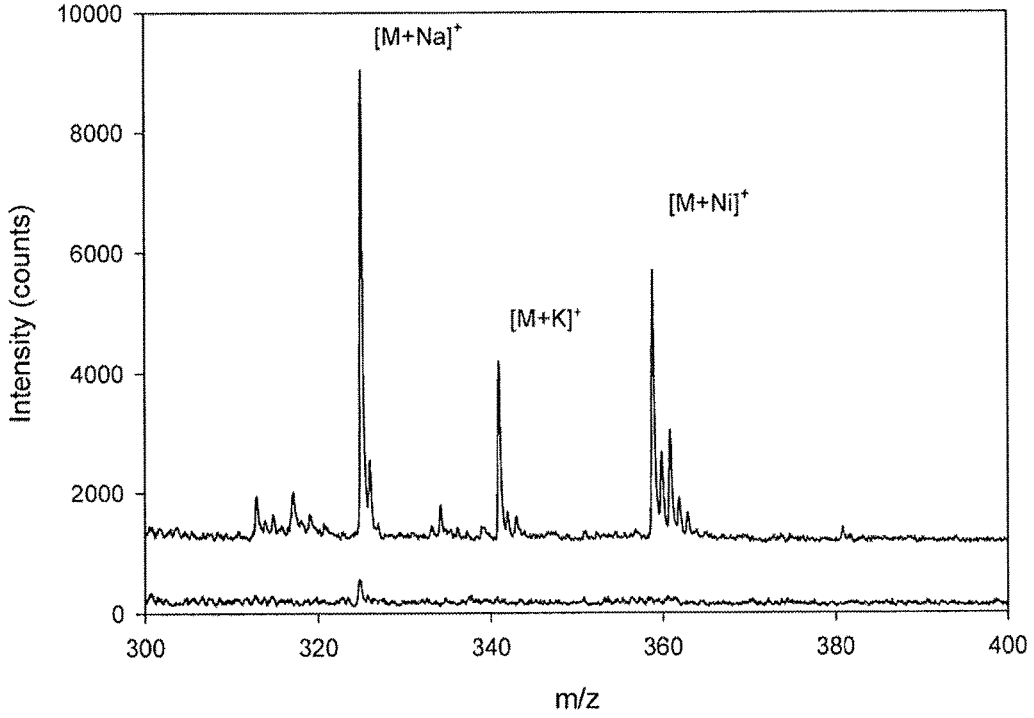
FIG. 17 shows spectra of cationized adducts of tetra-alanine whose signal is increased by the addition of methyl acetate to the NiO surface.

In the previous report, we showed that doping of the metal oxide surface with a small molecule, such as methyl acetate for NiO, results in increased sensitivity for analytes which do not contain ester functionalities. FIG. 17 below demonstrates this concept for tetra alanine. In the button spectrum weak if any ions are detected. In the top spectrum the sodiated adduct of the molecular species is observed.

Figure 18:
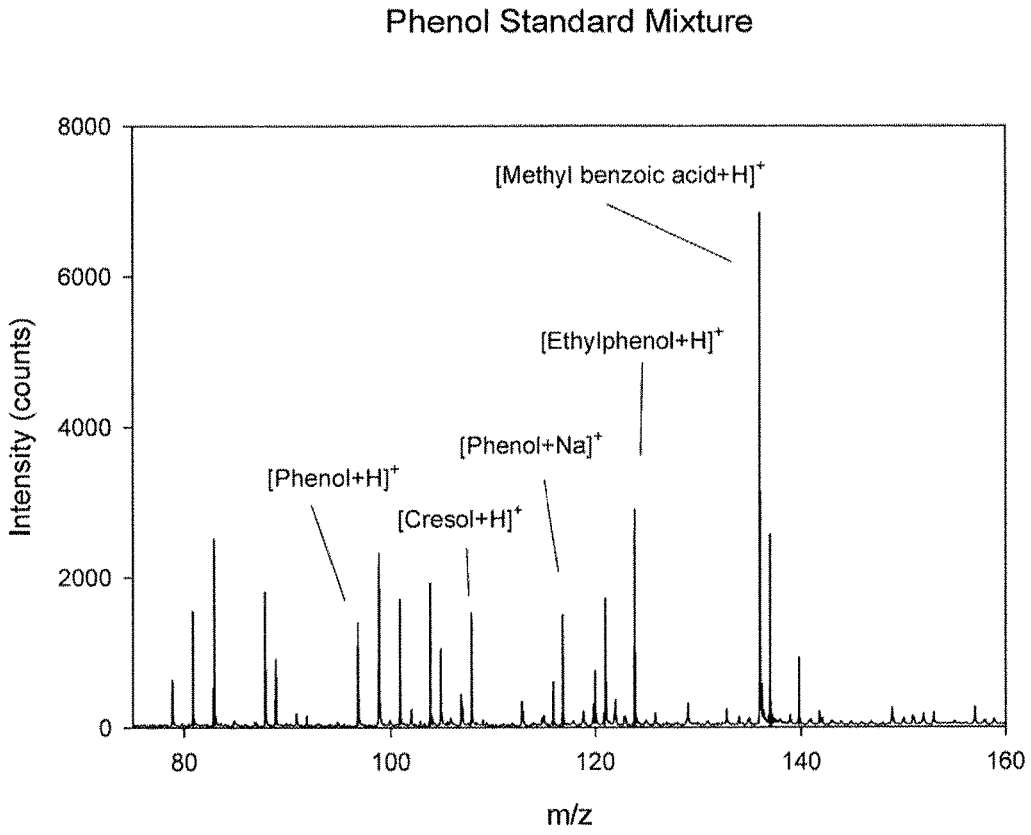
FIG. 18 shows a spectrum obtained for a mixture of phenol, p-cresol, and ethyl-/dimethylphenol, methyl benzoic acid was also detected as a bacterial metabolite of cresol.

Following development of proton source doping to the metal oxide surfaces the technique with NiO was expanded to lignol like compounds and phenolic derivatives. A mixture of four phenolic species was tested with MOLI MS to demonstrate the applicability of the technique for the analysis of pyrolysis oil constituents. The four species includes were; phenol, p-cresol, and ethyl-phenol/dimethyl-phenol. Interestingly, methyl benzoic acid was also detected. According to literature, airborne bacteria will metabolize cresol derivatives into benzoic acid derivatives over time. The spectrum shown in FIG. 18 indicates that NiO doped with a proton source offers a viable ionization strategy for oxygenated compound, which are known to exist in pyrolysis oils.

Figure 19A:
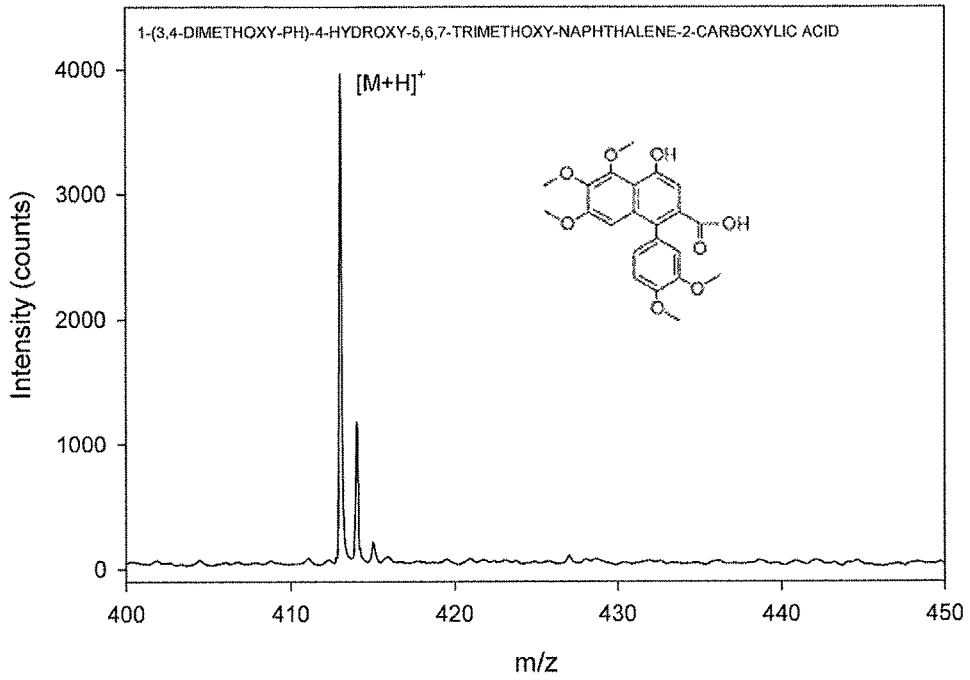
FIG. 19 shows spectra obtained for (FIG. 19*a*) 1-(3,4-Dimethoxy-ph)-4-Hydroxy-5,6,7-Trimethoxy-Napthalene-2-Carboxylic Acid, (FIG. 19*b*) 3,3-Methylene-bis(4-hydroxycoumarin), and (FIG. 19*c*) Ellagic Acid, with NiO MOLI MS and methyl acetate doping.
Figure 19B:
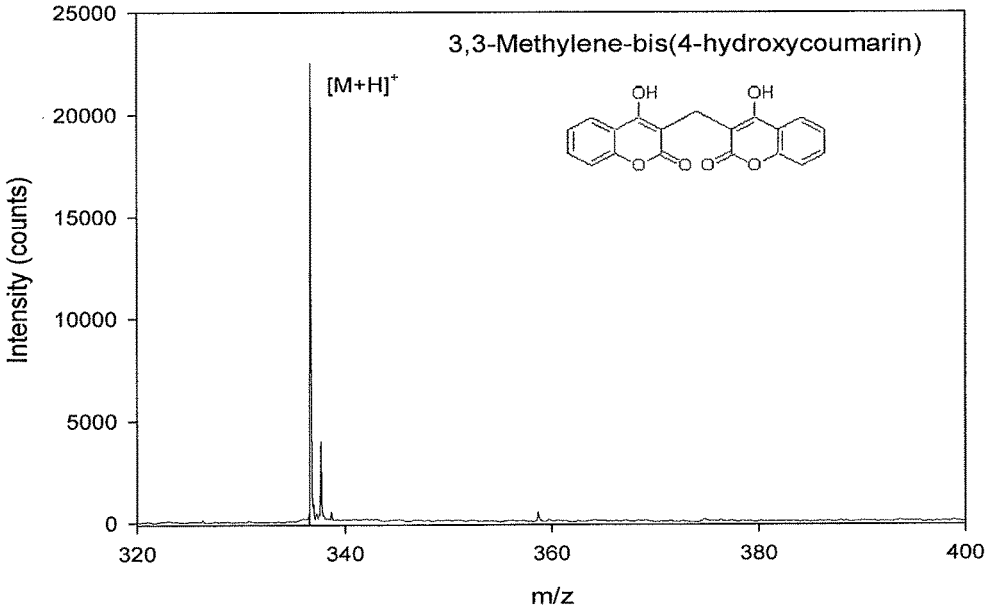
Figure 19C:
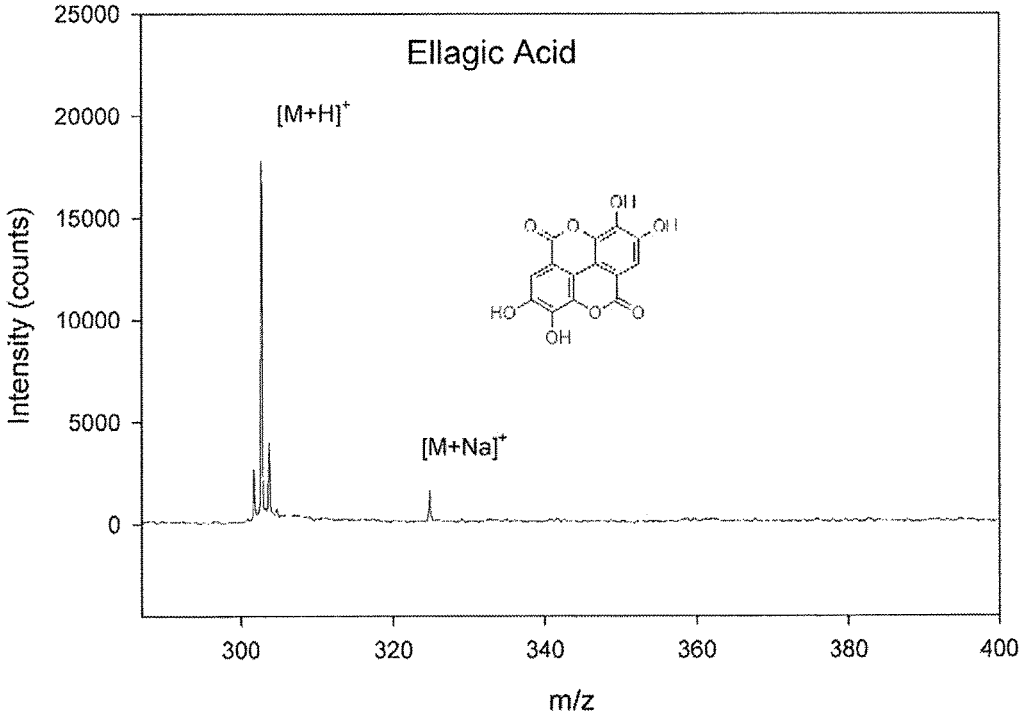

Since the technique demonstrated the ability to analyze simple phenolic compounds, slightly more complex standards representative of lignin dimers, trimers and polyaromatics were evaluated for their ability to be ionized with MOLI MS (FIG. 19).

Figure 20:
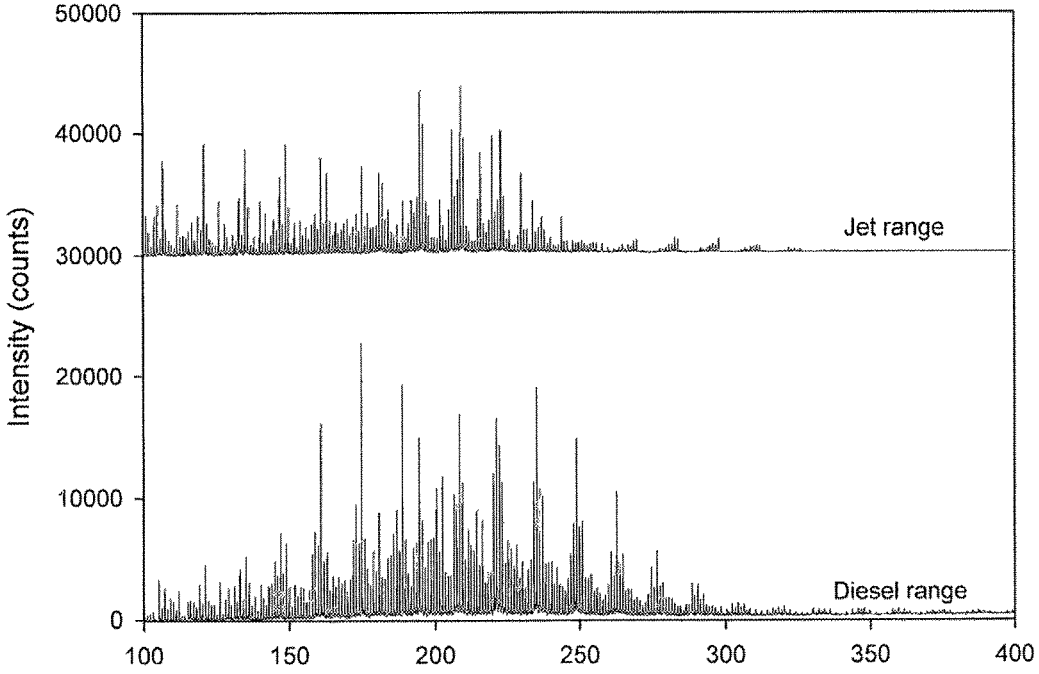
FIG. 20 shows the spectra obtained for jet range and diesel range py-oils, with NiO MOLI MS and methyl acetate doping.

The MOLI MS technique demonstrated the ability to analyze the standard components related to pyrolysis oils. The next step was to profile pyrolysis oils. The first samples to be analyzed were hydrotreated and distilled to represent compounds in the Diesel range and compounds in the jet fuel range. The spectra obtained demonstrate the ability of the technique to ready identify differences in sample processing. FIG. 20 shows the spectra obtained for these two samples.

Example 22—Petroleomic Applications

Figure 21:
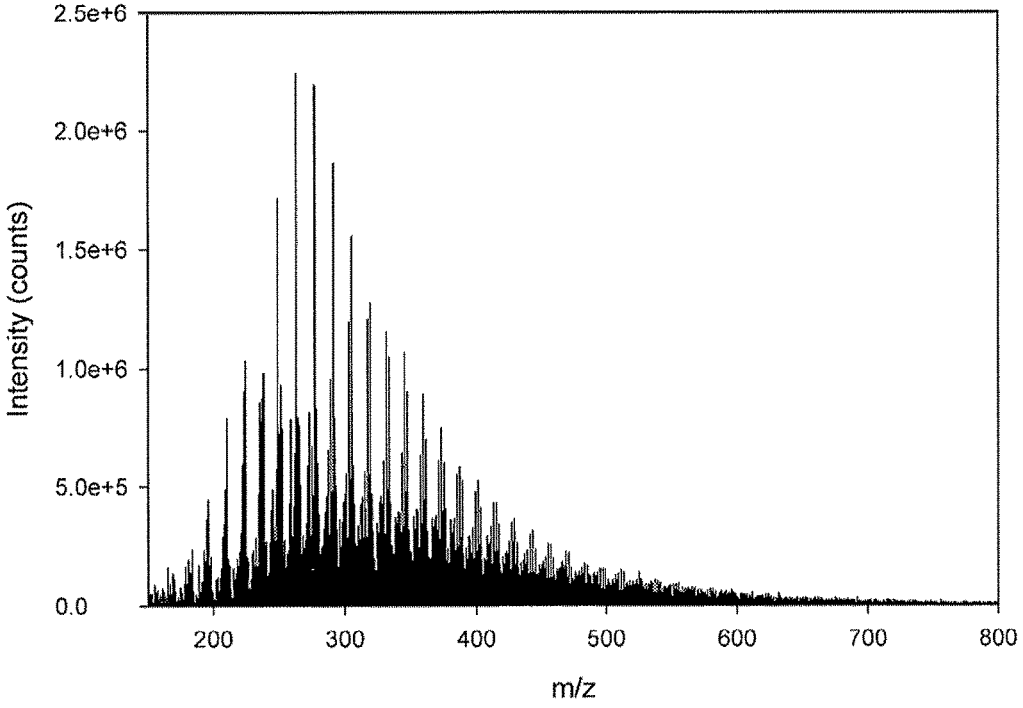
FIG. 21 shows a petroleomic profile of a heavy crude oil sample, with NiO MOLI MS and methyl acetate doping.

The use of MOLI MS for low mass profiling of heavy crude oils and asphaltenes was carried out, to demonstrate the applicability of the technique for ionizing heteroatom contain species in non-traditional hydrocarbon feedstocks such as heavy oils and asphaltenes. FIG. 21 shows the spectrum obtained for a heavy crude oil sample from the McMurray oil sands in Canada.

Figure 22:
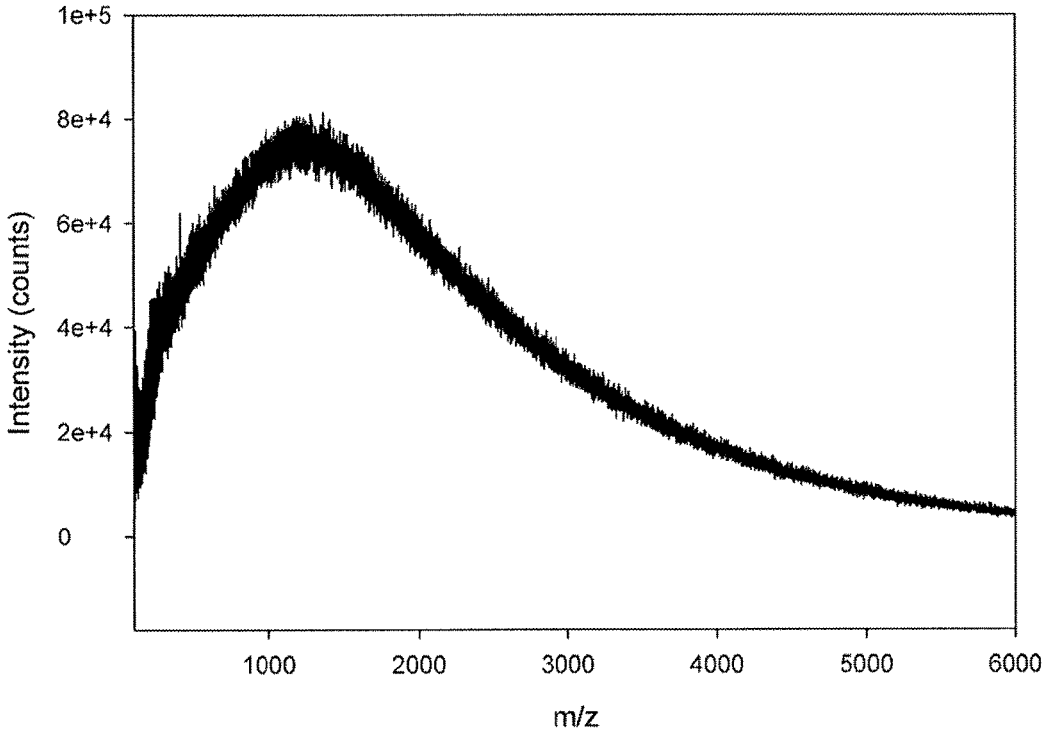
FIG. 22 shows a spectrum obtained for a typical asphaltene sample in which the Mn is ~1200 Da, with NiO MOLI MS and methyl acetate doping.

Further applicability of the technique was demonstrated for asphaltene samples, whose nominal mass could be determined following MOLI MS analysis. FIG. 22 shows a typical spectrum for asphaltene samples.

Studies with non-traditional petroleum feedstocks have confirmed that MOLI MS will ionize compounds with widely varying chemical functionalities and hetero-atoms. Additionally MOLI also was successful in ionizing hydrocarbons with de-localized $\pi$ systems such as polycyclic aromatic hydrocarbons (PAHs).

Example 23—Carbohydrates

Figure 23:
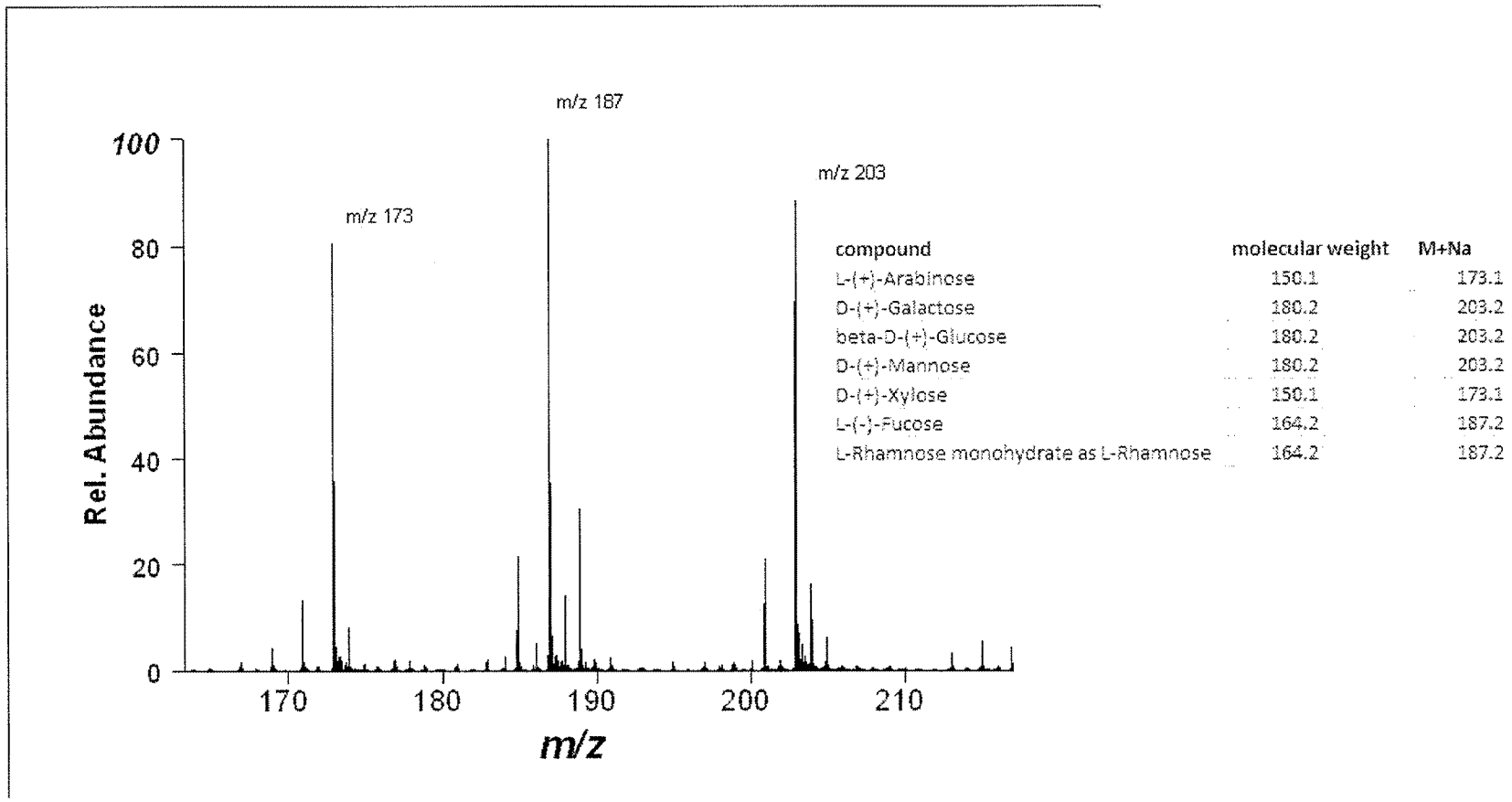
FIG. 23 shows a monosaccharide species detected with methyl acetate doped NiO.

Our success in profiling compounds with a wide variety of chemical functionalities, and our work with algal cell walls (predominantly starch based) led to the investigation of carbohydrates with MOLI MS. The spectrum shown below in FIG. 23 was obtained for the analysis of a 7-components monosaccharide standard mixture. Species were detected as either protonated or sodiated adducts.

Figure 24:
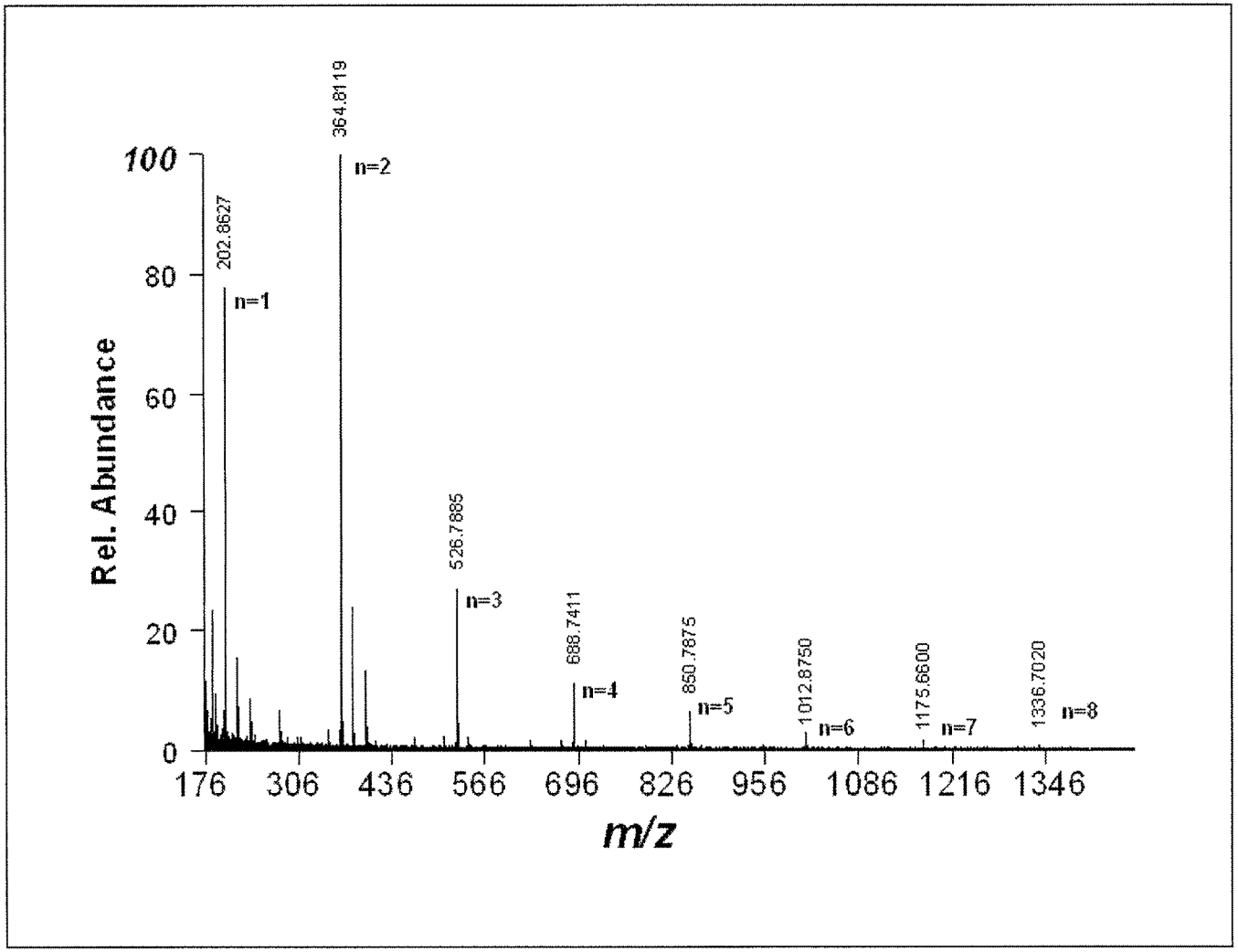
FIG. 24 shows spectra from maltose chains detected from the MOLI analysis of dissolved "gummy bear."

The success in detecting simple sugars led to profiling of more complex sugar systems. To determine if the technique could profile cross linked carbohydrates a "gummy bear" comprised predominately of cross linked maltose was dissolved in 66/33 vol % water/methanol, and spotted onto the MOLI particles. The spectrum presented in FIG. 24 shows the results from the "gummy bear" analysis in which oligomers up to 8 glucose units in length were detected free of any background interference.

Figure 25:
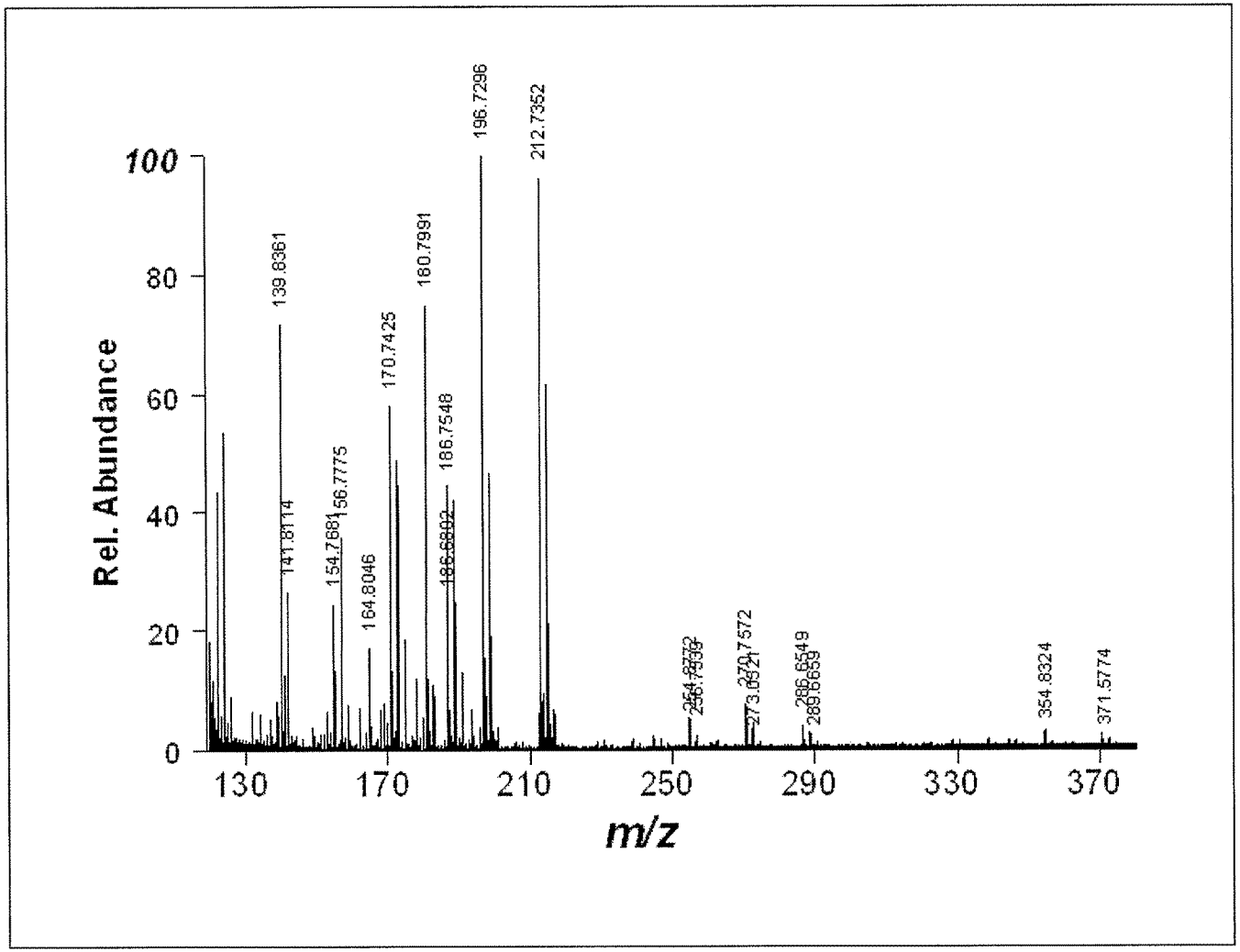
FIG. 25 shows spectra from polar extracts representing the cell wall components of a selected microalgae.

Additional efforts to characterize carbohydrates, such as those corprising the cell walls of microalgae were also carried out. Direct analysis of the polar extracts of these cells resulted in the spectrum presented in FIG. 25 in which sugar monomers, and dimmers are observed as well as various other cell wall components. The spectrum in FIG. 25 demonstrates the application of MOLI MS to profiling polar extracts of Microalgae.

Example 24—Direct Lipid Profiling

Figure 26:
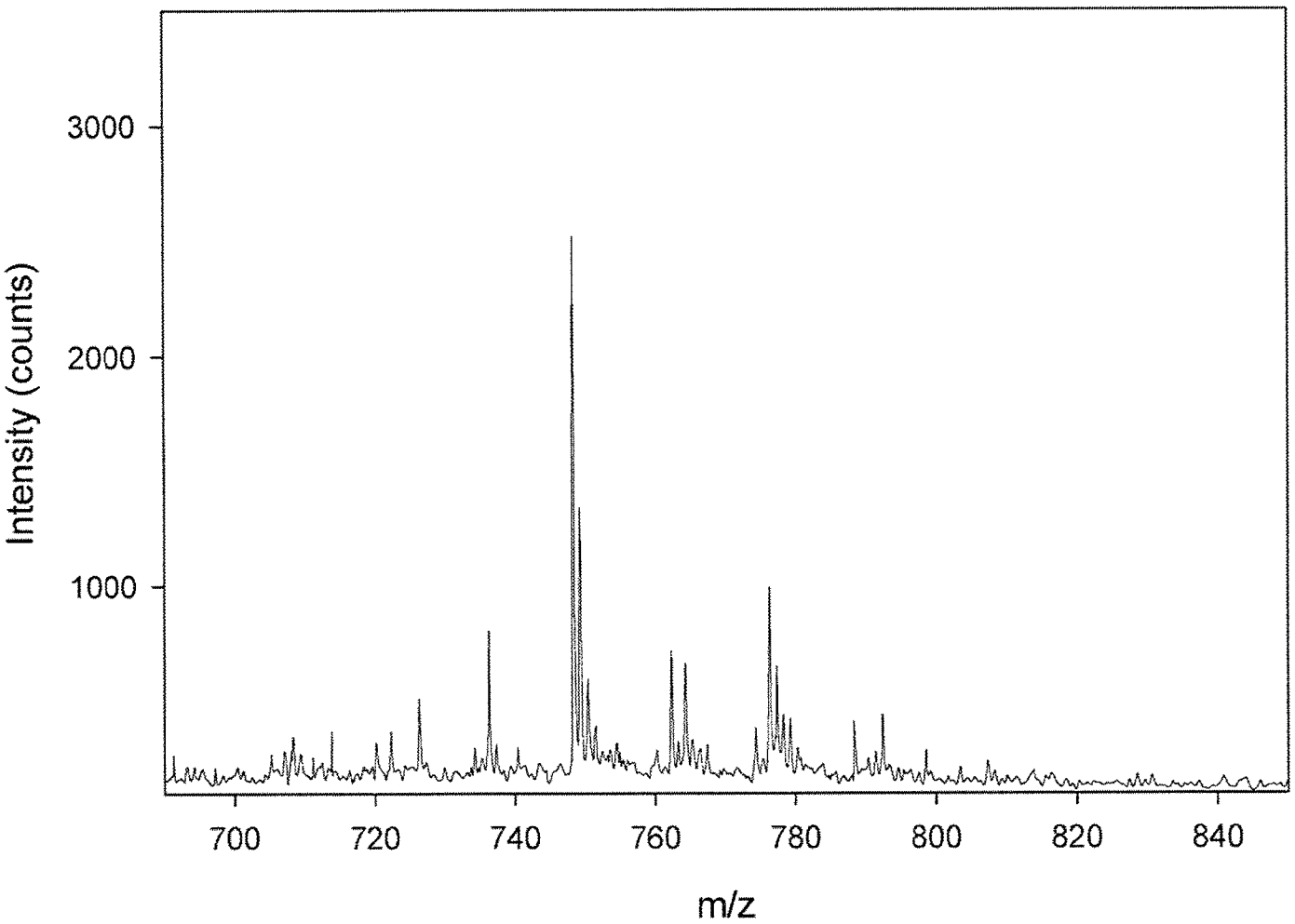
FIG. 26 shows a phospho-lipid profile of *E. coli* membrane lipids.

As shown in the supplied manuscript for submission to analytical chemistry, MOLI MS may also be used for direct profiling of non-polar lipid extracts. FIG. 26 below shows the Phospholipid profile for *E. coli* BL-21 and illustrates the ability of MOLI MS to rapidly profile intact membrane lipids of bacteria.

Example 25—CaO py-MOLI New Insights

Figure 27:
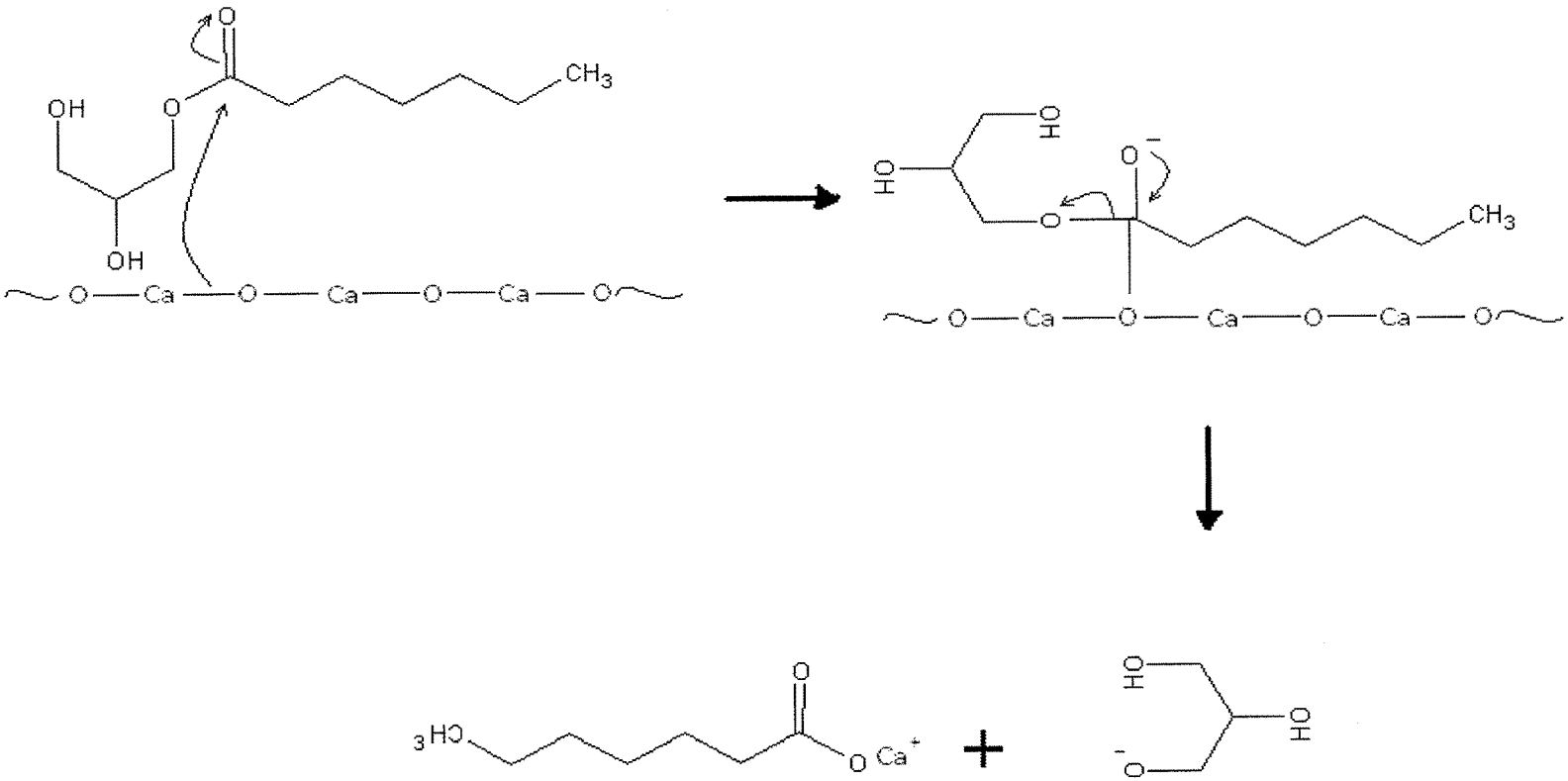
FIG. 27 shows a mechanism of surface catalyzed pyrolysis which may be used for fatty acid profiling.

While it may still be possible to carry out THM within the source of a MALDI mass spectrometer we recently discovered that our proposed mechanism was not the dominant process occurring on the metal oxide surface. Peaks observed for fatty acids methyl esters FAMEs which were believed to be the THM products were consistently 2 Da off (e.g. peaks expected at m/z 293 were detected at 295). This was initially attributed to error introduced from analyte binding to the surface. Instead it was discovered that oxide anions from the CaO surface were nucleophilically attacking the carbonyl carbon and replacing the ester alkoxy moiety which is presented in the mechanism in FIG. 27. This mechanism was confirmed by carrying out the analysis with $^{18}O$ ester labeled methyl palmitate. The detected peak at m/z 295 which is unshifted relative to the unlabeled standard confirms that the labeled methoxy group was exchanged with a surface oxide anion complexed to a Ca cation.

Presumably this mechanism could be applied to the nucleophilic attack of surface oxides to amides in proties etc. We have preliminary results to suggest this is the case, but have not interpreted the data yet.

DIRECT LIPID PROFILING USING CATALYTIC PYROLYSIS/METAL OXIDE LASER IONIZATION-MASS SPECTROMETRY

Example 26

Described herein is a procedure for lipid profiling using CaO catalytic pyrolysis-metal oxide laser ionization mass spectrometry (CP-MOLI MS) for; glycero-lipids, phospholipids, whole cell bacteria, and algae using matrix-assisted laser desorption ionization (MALDI) instrumentation is described. Insulating metal oxides have chemistries which are highly influenced by the Lewis acid/base properties of their cation/anion pairs. CaO and MgO nanocrystallites have demonstrated considerable activity for a variety of chemical functionalities including esters based on their Lewis acidity/basicity. CP-MOLI MS spectra exhibited products in the low mass region (<1000 Da) for monoacylglycerides (MAG), diacylglycerides (DAG), triacylglycerides (TAG), mixed fatty acids on DAGs and TAGs, phospholipids, algae, and bacteria without matrix background interference. CP products were observed as Ca adducts of the fatty acid constituents from the molecular species in the various spectra.

Lipid species in the presence of metal oxides will pyrolyze in a reaction which does not involve methylation. Oxide ions from the surface of the metal oxide particles attack the carbonyl carbon in lipid esters, exchanging with the ester groups and resulting in metal adducts of the fatty acid constituents. The study presented herein uses laser energy from a MALDI mass spectrometer to carry out catalytic pyrolysis metal oxide laser ionization mass spectrometry (CP-MOLI MS) of lipid analytes allowing rapid profiling without the need for methylating reagents or specialized instrumentation.

Figure 28:
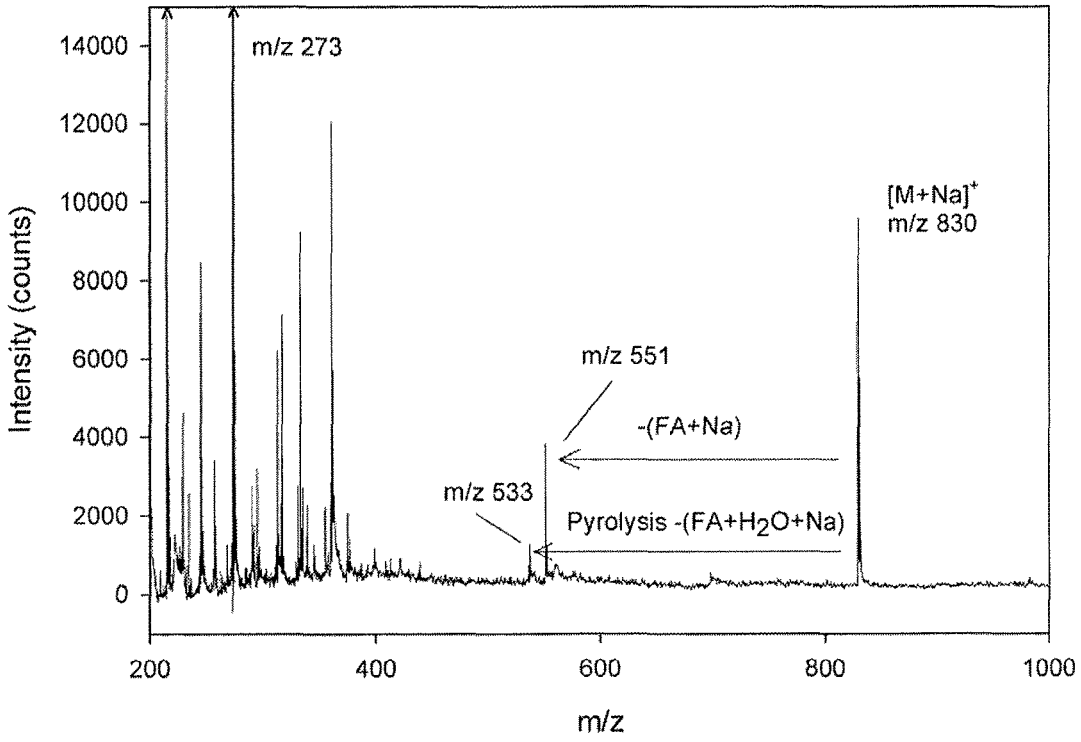
FIG. 28 shows MALDI-TOF mass spectrum of tripalmitin using DHB.

Disclosed herein are different matrices for use with MALDI-MS in lipid analysis of biodiesels and biodiesel precipitates. FIG. 28 shows a representative MALDI spectrum of tripalmitin using DHB. The peak at m/z 830 is the M+Na (sodiated) tripalmitin molecular ion . . . The signal at m/z 273 is the pseudo molecular ion of the dehydrated DHB dimer with the remainder of the peaks resulting from matrix background and analyte fragmentation. In this study, acylglycerides appear as sodiated ions while FAMEs appear as sodiated or possibly M+1 peaks. Mixed ionization from either sodiation or proton attachment are commonly observed in MALDI analysis of lipids. Interestingly, the peak at m/z 533 and 551 likely resulted from pyrolysis of tripalmitin. This observation and the work of Moon and co-workers led to the hypothesis that heat from the laser was in the appropriate temperature range for THM reactions.

Materials and Methods for Examples 26-30

Nanocrystallite calcium oxide and (NanoActive Inc., Manhattan, KS), Nanocrystallite magnesium oxide (NanoActive Inc., Manhattan, Kans.), were purchased commercially.) tetramethylammonium hydroxide (SigmaAldrich St Louis, Mo.), trifluoromethylphenyltrimethylammonium hydroxide as a 5% solution in methanol (TCl, Portland, Oreg.), phenyltrimethylammonium hydroxide (TCl) as a 20% solution in methanol were all purchased commercially. All THM reagents were used as 5% solutions in methanol. Ammonium hydroxide and hydrochloric acid were obtained from Mallinckrodt, (Phillipsburg N.J.), and Sigma Aldrich respectively, and used at concentrations of 0.44 M and 0.15 M respectively. Based on the supplier's product information, the CaO aggregate size was 4 μm with a crystallite size of <40 nm and a surface area of 20 $m^2$/g. MgO aggregate size is 12 μm with a crystallite size of <4 nm and a surface area of 600 $m^2$/g. High surface area silica (SBA-15) was prepared according to the method of Stucky [14]. BET characterization of SBA-15 showed a surface area of 901 $m^2$/g. Lipids standards were obtained from SigmaAldrich and were prepared at 100 mg/mL in hexane (SigmaAldrich). $^{18}$O methyl alcohol (Sigma Aldrich) plus palmitic acid catalyzed with HCI was used to prepare $^{18}$0 methyl palmitate. The product was extracted from the reaction mixture with 50/50 vol % hexane chloroform (Sigma Aldrich and Fischer (Pittsburgh Pa.) respectively). This solution was used without further purification.

Wildtype *Chlamydomonas reinhardtii* (cc-124) was grown to stationary phase in liquid tris-acetate-phosphate medium at 23° C. on a rotary shaker under continuous illumination of 150 μE (μmole photons)/$m^2$s of photosynthetically active radiation. One μL aliquots were then applied directly to the MALDI plates for CP-MOLI MS analysis. *Escherichia coli* (BL-21) (ATCC, Manassas, Va.) was grown overnight in Luria-Bertani (LB) broth (BD-Difco, Franklin Lakes, N.J.) at 37° C. with continuous aeration, followed by streaking onto LB agar. Culture plates were incubated overnight at 37° C. followed by storage at 4° C. Individual bacterial colonies were suspended in phosphate buffered saline (PBS), and applied to a MALDI-MS plate prepared for CP-MOLI MS analysis.

Traditional MALDI-MS analysis was performed using a DHB matrix (100 mg/mL in methanol) applied to a stainless steel MALDI sample plate by spotting 1 μL aliquots. One μL of an acylglyceride standard (50 mg in 50/50 vol % hexane/chloroform) was then directly deposited in a sandwich fashion onto the spot, followed by an additional one μL of matrix solution. Vacuum drying was employed between additions. A slightly modified version of the standard sandwich method was used for DHB THM. In this case, tetramethylammonium hydroxide (TMAH) was spotted before the final matrix addition to allow for mixing of the analyte and methylating reagent prior to the final matrix addition.

Nanoparticle sample preparation consisted of first spotting one μL from the bottom of a slurry of the nanoparticles in hexane onto a MALDI plate followed by vacuum drying. One μL of THM reagent was then spotted onto the nanoparticle surface and vacuum dried. Following this step, the analyte (one μL of 50 mg in 50/50 vol % hexane/chloroform (Fischer Scientific, Pittsburgh, Pa.)) was added. For algal and bacterial analysis, one μL of suspensions were prepared as previously described. Analytes were spotted onto the nanoparticle/THM reagent spots and vacuum dried. For investigation into the role of the THM reagent in CP-MOLI MS the metal oxide particles were treated with one μL the previously prepared ammonium hydroxide and hydrochloric acid solutions. To determine the influence of surface adsorbed water molecules on the metal oxide, particles were heated to 400° C. in a one inch diameter pyrex tube in a Carbolite MTF 12/38/250 tube furnace under vacuum. The particles were then used as a slurry for analysis, as previously described.

Ex situ saponification/methylation of algae and bacteria were accomplished using a modified version of the Microbial ID, Inc. procedure. An Agilent 7890A FID gas chromatograph equipped with an Agilent DB5-MS column temperature programmed with a 2 min hold at 30° C. followed by a 20° C/min ramp to 230° C. and with a one min hold, followed by another program of 20° C. to 310° C. and a final hold of 5 min, was employed to generate the FAME profiles. Identification of chromatographic peaks was accomplished by correlating the retention times to those of standard FAMEs.

A Perceptive Biosystems Voyager DE STR MALDI-TOF mass spectrometer was used for sample analysis. Instrument operating conditions have been previously described. Laser power was the only parameter that was adjusted during analysis. A value of 75-80% laser fluence was found to be optimal. Files were exported from Voyager Data Explorer software into SigmaPlot v11.0 for data workup.

Example 27—Evaluation of THM

Initial attempts to perform in situ THM of lipids with MALDI-MS were carried out using DHB as a matrix and TMAH as the THM reagent. The use of a traditional matrix with a THM reagent was approached with some trepidation because of its basicity and the acidity of DHB. A sandwich sample preparation was used to allow for mixing of the analyte and the THM reagent before adding the acidic matrix. Results with this sample preparation did not produce observable FAMEs. The molecular ion at m/z 830 decreased in intensity, but it was unclear whether this decrease was due to a THM reaction, or partial titration of the matrix with THM reagent. Therefore, THM with traditional MALDI matrices was not investigated further.

Based on the poor performance of MALDI THM with a traditional matrix and our recent studies using metal oxide nanoparticles as a matrix-free ionization technique, THM was evaluated with CaO, MgO, SBA-15, as well as a blank MALDI plate using TMAH. MgO was selected based on its observed propensity to produce lipid molecular ions and relatively high lewis acidity, which was hypothesized to be more resistant to treatment with a THM reagent. A blank MALDI plate was used to determine the contribution of thermal desorption to any observed THM activity, while SBA-15 was evaluated based on its extremely high surface area. In this set of experiments, MgO produced spectra with poor signal-to-noise (S/N) ratios for the methyl palmitate molecular ion and thus was deemed unsatisfactory. THM did not produce observable M+1 or sodiated molecular ion on SBA-15 or a blank MALDI plate, suggesting that additional factors must contribute to the THM reaction. The poor performance of MgO lead to consideration of other metal oxides.

Figure 29:
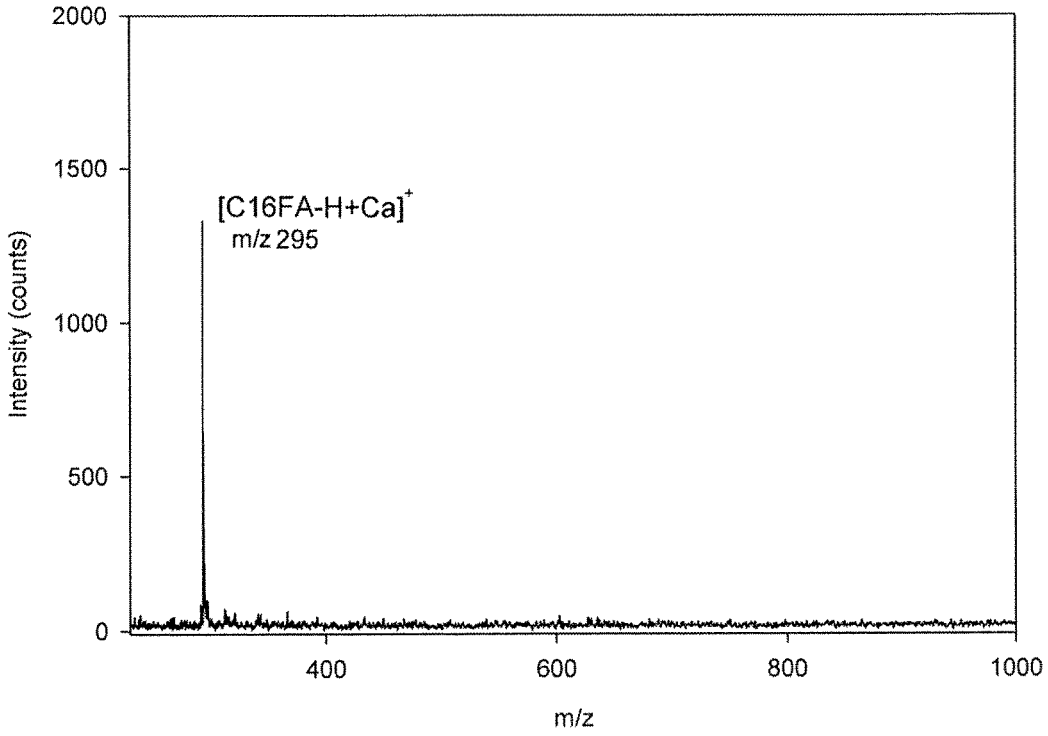
FIG. 29 shows a MOLI mass spectrum of tripalmitin using CaO and PTMAH.

Because of its increased Lewis acid and base properties over MgO, and its known surface activity, CaO was evaluated as a potential alternative. FIG. 29 illustrates a spectrum of tripalmitin obtained using CaO and PTMAH in which an ion is observed at m/z 295. The peak was observed without interference of any matrix background peaks. The absence of tripalmitin molecular species suggests that the reaction was complete. It was initially thought that the CaO had produced a sodiated molecular ion for methyl palmitate (m/z 293), and that the surface had bound the analyte strongly so that flight time was increased and a mass error of 2 Da was generated. To test this hypothesis tristearin was analyzed in the same fashion and produced an ion at m/z 323 which was again 2 Da off of the expected sodium adduct mass of m/z 321.

Example 28—Possible Ionization Mechanism

Figure 30A:
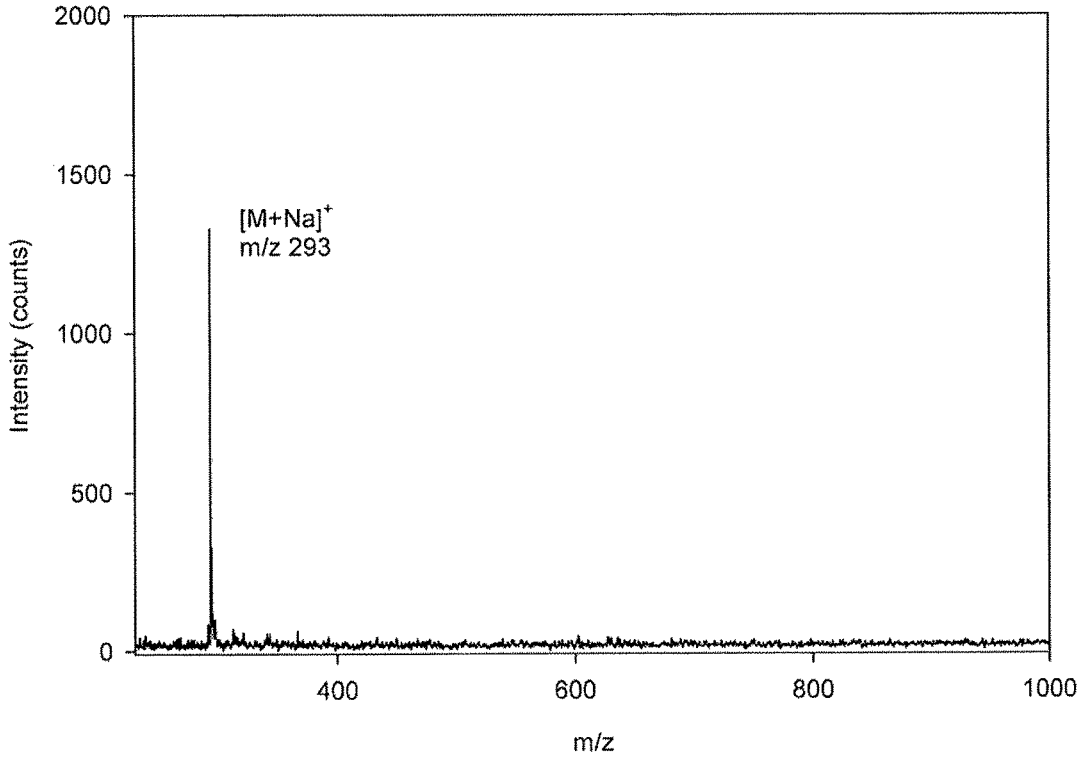
FIG. 30 shows a spectrum obtained for the analysis of $^{18}O$ ester labeled methyl palmitate (a) and the reaction mechanism of CP-MOLI MS (b)
Figure 30B:
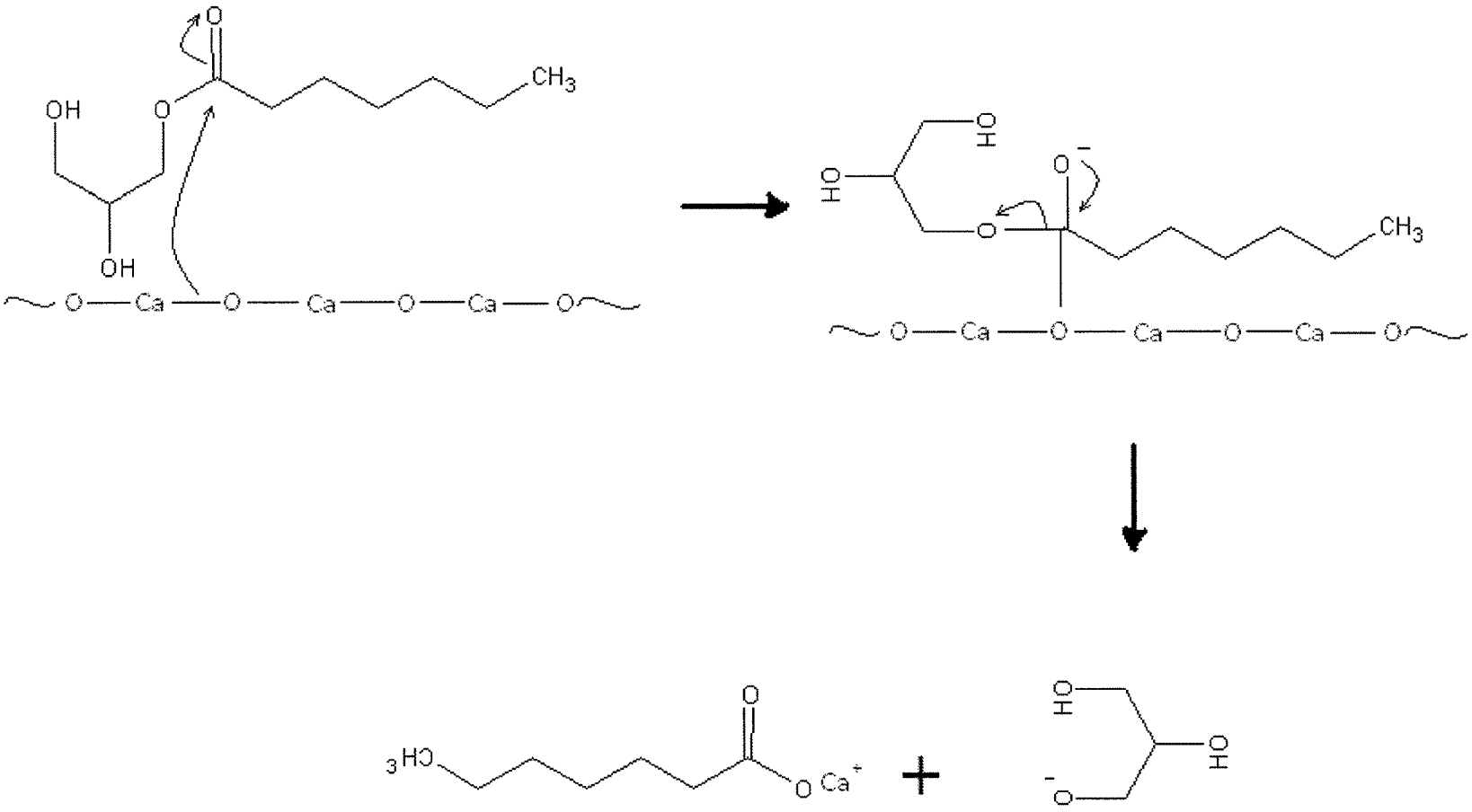

In an effort to confirm that the binding of the analyte was responsible for the mass error, collision induced dissociation (CID) experiments were carried out to elucidate the structure of the pyrolysis product. Somewhat surprisingly, a sodium ion was not observed in the resulting mass spectrum. Instead an intense peak was observed at m/z 40 which corresponded to a Ca ion. This suggested that the 2 Da shift was not an error for the expected sodium adduct of the FAME but rather the exact mass of a Ca adduct of the free fatty acid. The mechanism of ionization was investigated by analyzing $^{18}O$ ester labeled methyl palmitate. The spectrum of the labeled methyl palmitate is presented in FIG. 30*a* the peak corresponding to the methyl palmitate product was unshifted relative to the unlabeled standard indicating that the surface had reacted with the carbonyl carbon in a fashion similar to that presented in FIG. 30*b* resulting in replacement of the labeled methoxy with a surface oxygen and a $Ca^{2+}$.

Example 29—Acid or Base Pretreatment

Methyl ester derivatives of the fatty acids were not the primary observed ions suggesting that the methylating reagent was unnecessary for the catalytic pyrolysis to occur. Lipid standards analyzed with untreated CaO did not produce observable pyrolysis species indicating that pretreatment with the THM reagent was critical to the reaction. To further probe the role of the THM reagent in the reaction it was replaced with dilute solutions of HCl and $NH_4OH$ in methanol. Interestingly, pretreatment with both acidic and basic non-methylating reagents effectively produced fatty acid adduct ions. Since both acidic and basic reagents produced the same response and an increase in CP-MOLI MS activity, it was thought that the reagents may simply "clean" the surface by removing surface hydroxyls in the form of water and leaving behind more active surface oxide ions. This observation was supported when the CaO particles were heated to 400° C. under vacuum to remove surface-bound water. The heated material was then directly used for CP-MOLI MS and resulted in pyrolysis similar to that observed with the acid and base treated CaO. The pretreatment was then optimized to include pretreatment of the CaO particles with 0.15 M HCl in methanol.

Figure 31:
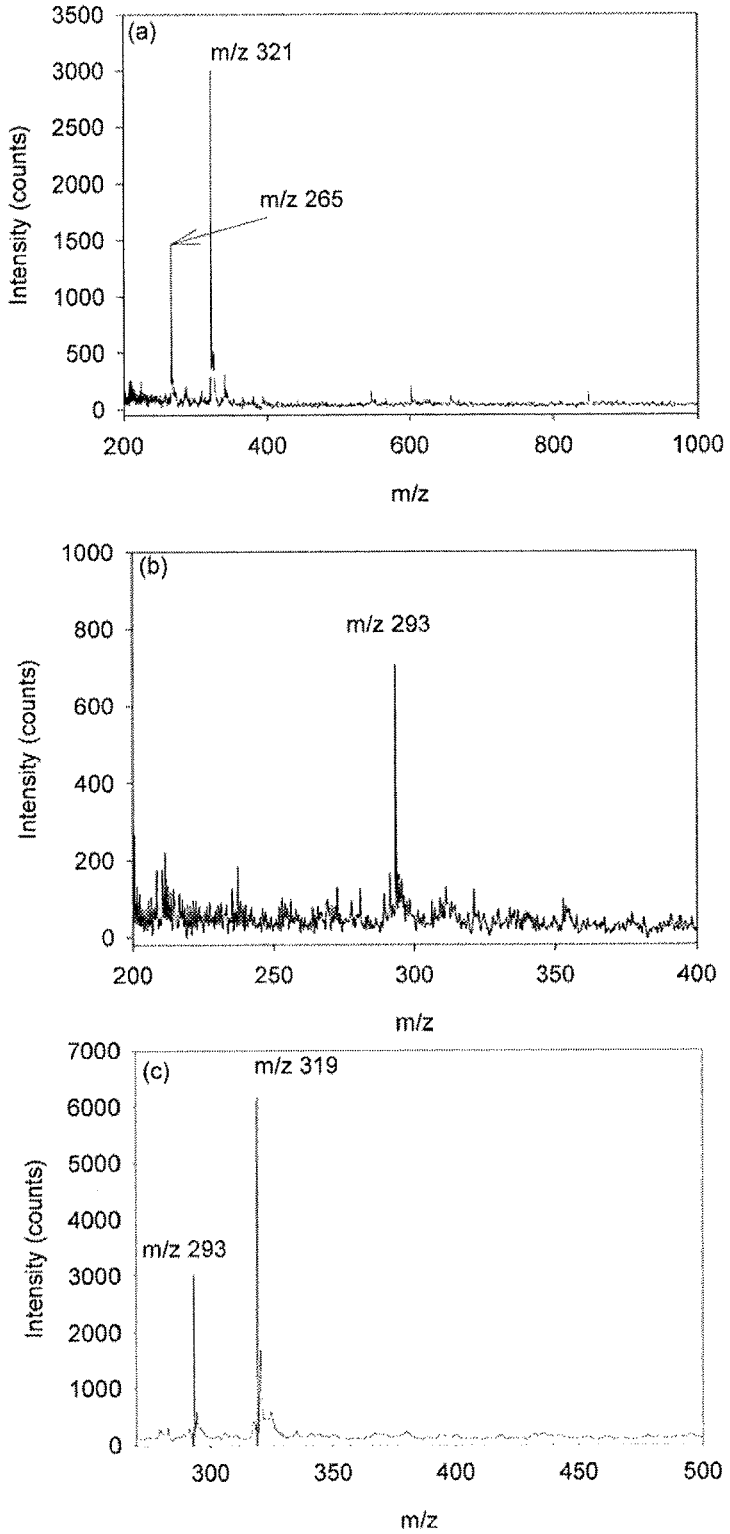
FIG. 31 shows a spectrum of *C. reinhardtii* analyzed using CaO CP-MOLI MS.

FIG. 31 shows spectra of other lipid materials investigated by CaO Cp-MOLI MS. Dipalmitoylphosphatadylethanolamine (FIG. 31*b*) was analyzed to ensure that CP-MOLI MS would be effective for phospholipid analysis and therefore useful for profiling bacterial membrane lipids. Phospholipid analysis proved to be more difficult and produced lower S/N compared to the acyl glyceride standards investigated. Mixed saturated and unsaturated fatty acid glycerides (FIGS. 31*a* and 31*c*) were also investigated for possible cross reactivity and ionization suppression. These three standards produced spectra with fatty acid methyl ester sodiated ions at the proper mass and intensity ratio without any observable catalytic exchange between the saturated and unsaturated compounds. All three spectra were free of background peaks.

Example 30—Algae and Bacterial Samples

Figure 32:
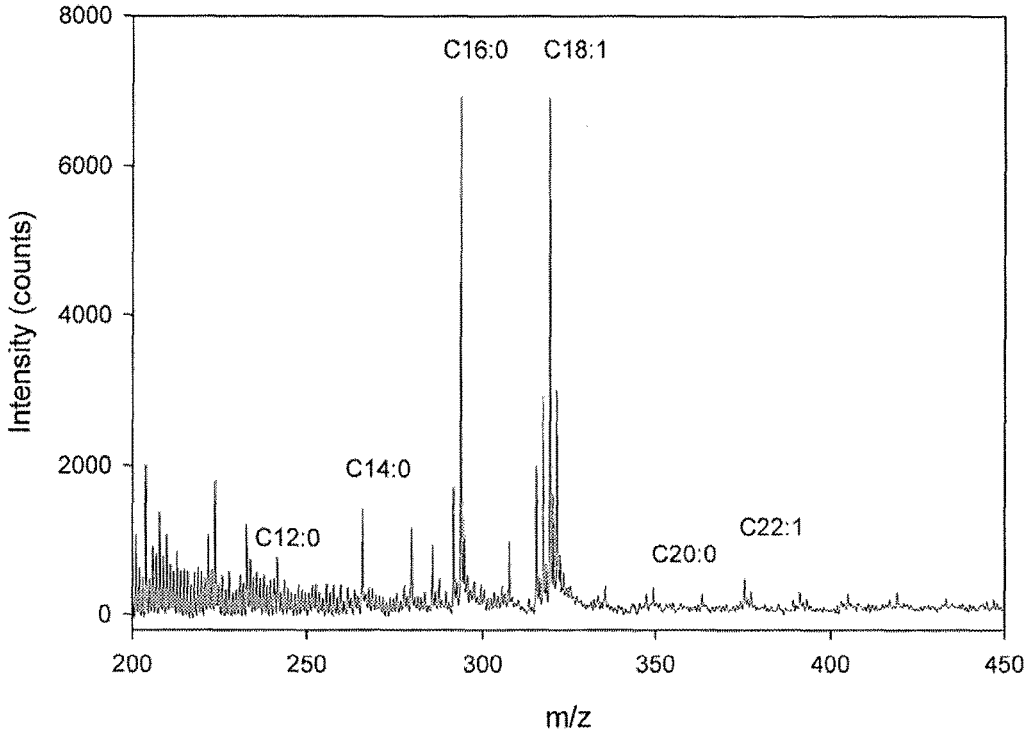
FIG. 32 shows a spectrum of *C. reinhardtii* with major peaks for C16:0 and C18:1.

A recent report suggests that fatty acid distribution is one method for microbial identification. To that end, microbial profiling with CP-MOLI MS was explored for fatty acid analysis of algae and bacterial samples. Spectra for *C. reinhardtii* and *E. coli* are illustrated in FIGS. 5 and 6. The spectrum shown in FIG. 32 of *C. reinhardtii* shows major peaks for C16:0 and C18:1, which are known major members of algal cell wall fatty acid composition. This fatty acid distribution is similar to ex situ saponification/methylation GC analysis of the same algae sample, but differs in the C16:0/C18:1 ratio (a higher C16:0/C18:1 ratio is observed by GC analysis).

Figure 33:
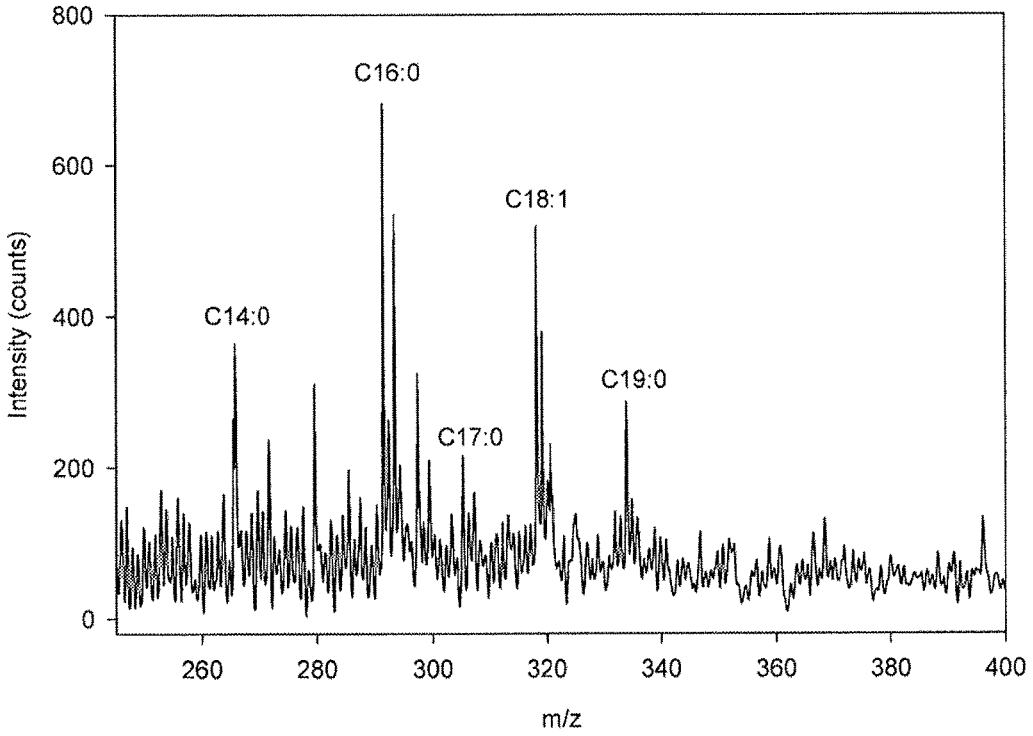
FIG. 33 shows a spectrum of *E. coli* analyzed with CaO CP-MOLI MS
Figure 35:
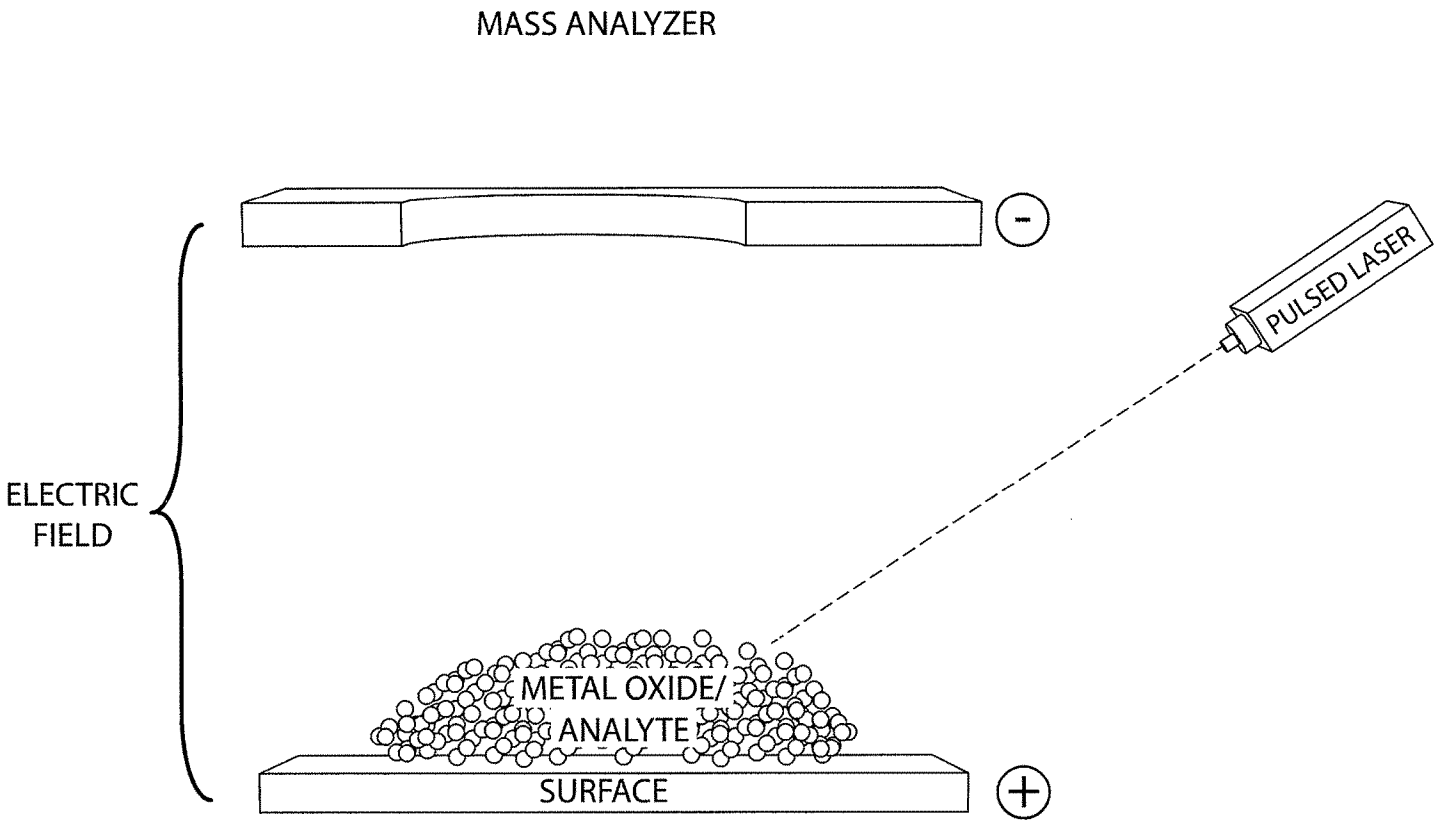
FIG. 35 is a schematic diagram showing an ionization source for mass spectrometry.

*E. coli* CP-MOLI MS results, presented at FIG. 33, show a distribution of fatty acids from C14:0 to C19:0, which is dominated by C16:0 and C18:1. Comparison of CP-MOLI MS results to ex situ saponification/methylation data consistently showed that the spectra did not entirely agree. A possible reason for this disagreement may be that the reaction of the principal C16:0 precursor is inefficient, or that ionization suppression is occurring. Fatty acid profiling of bacteria was difficult to obtain, compared to fatty acid profiling of algal cultures. Reproducible results were routinely obtained using algae samples taken directly from liquid growth media and required no further sample preparation. In contrast, liquid media cultures of *E. coli* were less consistent, in some embodiments consistency was achieved by agar-plating the liquid cultures prior to analysis.

Lipid analysis using conventional MALDI instrument with pyrolysis catalyzed on a CaO surface demonstrated that low mass spectra (<1000 Da) could be obtained without background interference from traditional MALDI matrices. In situ catalytic pyrolysis using MOLI conditions for MAGs, DAGs, TAGs, individual fatty acids, and phospholipids produced spectra with the appropriate fatty concentrations and were free from matrix interference. Spectra obtained from *C. reinhardtii* and *E. coli* both showed a lower C16:0/C18:1 ratio in comparison to those obtained from saponification/methylation GC analysis. Replacement of ester alkoxy groups with a surface oxygen and a calcium ion was the determined to be the pyrolysis mechanism. An in-depth study is in progress to better understand the C16:0/C18:1 ratio variability for whole algae and bacteria.

The following references are hereby incorporated by reference in their entirety.

Arnold, R. T., G. G. Smith, Mechanism of the Pyrolysis of Esters, J. Org. Chem., 15 (1950) 1256-60.

Barshick, S., D. A. Wolf, A. A. Vass, Differentiation of Microorganism based on Ion-trap Mass Spectrometry using Chemical Ionization, Anal. Chem., 71 (1999) 633-41.

Basile, F., M. B. Beverly, C. Abbas-Hawks, C. D. Mowry, K. J. Voorhees, T. L. Hadfield, Direct Mass Spectrometric Analysis of in situ Thermally Hydrolyzed and Methylated Lipids for Whole Cell Bacteria, Anal. Chem., 70 (1998) 1555-62.

Basile, F., T. L. Hadfield, K. J. Voorhees, Microorganism Gram-Type Differentiation based on Py-MS of Bacterial Fatty Acid Ester Extracts, J. Appl. Environ. Microbiol., 61 (1995) 1534-39.

Beverly, M. B., K. J. Voorhees, T. L. Hadfield Direct Mass Spectrometric Analysis of Bacillus Spores, Rapid Commun. in Mass Spectrom., 13 (1999) 2320-26.

Bond, J. Q.; Alonso, D. M.; Wang, D.; West, R. M. Dumesic, J. A. Science 2010, 327, 1110-1114.

Challenor, J. M., Review: the Development and Applications of Thermally Assisted Hydrolysis and Methylation Reactions, J. Anal. Appl. Pyrol., 61, (2001) 3-34.

Chen, C.; Chen, Y. Anal. Chem. 2004, 76, 1453-1457.

Cody, R. B., DART and Trace Evidence (a bag of tricks for using DART), NIJ Technology Transition Workshop, Ames, IA, 2009.

Cody, R. B., J. A. Laramee, H. D. Durst, Versatile New Ion Source for the Analysis of Materials in Open Air under Ambient Conditions, Anal. Chem., 77 (2005) 2297-2302.

Dove, A. Science 2010, 328, 920-22.

Duncan, M. W.; Roder, H.; Hunsucker, S. W. Briefings in Functional Proteomics 2008, 7, 355

Evans, J.; Nicol, G.; Munson, B. J. Am. Soc. Mass Spectrom. 2000, 11, 789-796

Fox, A., Mass Spectrometry for Species or Strain Identification after Culture or without Culture: Past, Present, and Future, J. Clin. Microbiol., 44 (2006) 2677-80.

Greedon, J. E. In Encyclopedia of Inorganic chemistry King, R. B. ed. John Wiley & Sons New York 1994

Greenwood, N. N.; Earnshaw, A. Chemistry of the Elements, 2nd Ed. Elsevier, 1997

Griest, W. H., M. B. Wise, K. J. Hart, S. A. Lammert, C. V. Thompson, A. A. Vass, Biological agent detection and identification by the Block II Chemical Biological Mass Spectrometer, Field Anal. Chem. and Tech., 5 (2001) 177-84.

Harvey, D. J. Int. J. Mass Spectrom. 2003, 226, 1-35.

Harvey, D. J., Matrix-assisted Laser Desorption/Ionization Mass Spectrometry of Carbohydrates, Mass Spectrom. Reviews, 18 (1999) 349-451.

Hübner, W.; Mantsch, H. H. Biophys. J. 1991, 59, 1261-1272

Ingólfsson, O.; Illenberger, E.; Schmidt, W. F. Int. J. Mass Spectrom. Ion Proc. 1994, 139, 103-110

Ishida, Y.; Madonna, A. J.; Rees, J. C.; Meetani, M. A.; Voorhees, K. J. Rapid Commun. Mass Spectrom. 2002, 16, 1877

JCPDS card numbers 65-2901 (MgO) and 45-0946(NiO)

Jeevanandam P.; Klabunde, K. J. Langmuir 2002, 18, 5309-5313.

Kakkar, R.; Kapoor, P. N.; Klabunde, K. J. J. Phys. Chem. B 2006, 110, 25941-25949.

Karas, M.; Bachman, D.; Bahr, U.; Hillenkamp, F. Int. J. Mass Spectrom. Ion Proc. 1987, 78, 53-68.

Kassis, C. M.; Desimone, J. M.; Linton, R. W.; Lange, G. W.; Friedman, R. M. Rapid Commun. Mass Spectrom. 2007, 11, 1462-1466.

Khaleel, A., W. Li, K. J. Klabunde, Nanocrystals as Stoichiometric Reagents with Unique Surface Chemistry: New Adsorbents for air Purification, Nanosruct. Mat., 12 (1999) 463-66.

Kinumi, T.; Saisu, T.; Takayama, M.; Niwa, H. J. Mass Spectrom. 2000, 35, 417-422.

Koper, O., Klabunde, K. J. Chem. Mater. 1997, 9, 2481-2485.

Kumari, L.; Li, W. Z.; Vannoy, C. H.; Leblanc, R. M.; Wang D. Z. Ceramics International 2009, 35, 3355-3364

Kunkes, E. L.; Simonetti, D. A.; West, R. M.; Serrano-Ruiz, J. C.; Gärtner, C. A.; Dumesic, J. A. Science, 2008, 322, 417-21.

Li, L., R. E. Golding, R. M. Whittal, Analysis of Single Mammalian Cell Lystates by Mass Spectrometry, J. Amer. Chem. Soc. 118 (1996) 11662-63.

Li. Y.; Klabunde, K. J. Langmuir 1991, 7, 1388-1393.

Lin, S.; Klabunde, K. J. Langmuir 1985, 1, 600-605.

Mackrodt, W. C.; Noguera, C. Surface Science 2000, 457, L386-L390

Madonna, A. J., S. VanCuyk, K. J. Voorhees, Detection of *E. coli* using Immunomagnetic separation and Bacteriophage Amplification Coupled with MALDI-TOF-MS, Rapid Commun. in Mass Spectrom., 17 (2003) 257-63.

McAlpin, C. R., K. J. Voorhees, R. Richards, Matrix-Free Laser Desorption/Ionization of Lipid Analytes on Metal Oxide Surfaces, American Society of Mass Spectrometry and Allied Topics, Denver, Colo. June 2011S paper no. 2472.

McAlpin, C. R., K. J. Voorhees, Teresa L. Alleman, Robert L. McCormick' "Impurities in Biodiesel by MALDI-TOF-MS Analysis" Preprints of Symposia—Amer. Chem. Soc., Division of Fuel Chemistry (2009), 54(2), 758-59.

McLean, J. A.; Stumpo, K.; Russell, D. H. J. Am. Chem. Soc. 2005, 127, 5304-5305.

Moon, J. H., S. H. Yoon and M. S. Kim, Temperature of Peptide Ions Generated by Matrix-Assisted Laser Desorption Ionization and their Dissociation kinetic Parameters, J. Phys. Chem., 113 (2009) 207176.

Nicola, A. J., A. I. Gusev, A. Proctor, E. K. Jackson, D. M. Hercules, Application of the Fast-evaporation Sample Preparation Method for Improving Quantification of Angiotensin II by Matrix-assisted Laser Desorption/ionization, Rapid Commun. Mass Spectrom., 9 (1995) 1164-71

Ostman, P.; Pakarinen, J. M. H.; Vainiotalo, P.; Franssila, S.; Kostiainen, R.; Kotiaho, T. Rapid Commun. Mass Spectrom. 2006, 20, 3669-3673.

Pierce, C. Y., J. R. Barr, R. B. Cody, R. F. Massung, A. R. Woolfitt, H. Moura, H. A. Thompson, F. M. Fernandez, Ambient Generation of Fatty Acid Methyl Ester ions from Bacterial Whole Cells by Direct Analysis in Real Time Mass Spectrometry, Chem. Commun., (2007) 807-9.

Schiller, J., J. Arnhold, S. Benard, M. Muller, S. Reichi, K. Arnold, Lipid Analysis by Matrix Assisted Desorption and Ionization Mass Spectrometry: A Methodological Approach, Anal. Biochem., 267 (1999) 46-56.

Schiller, J., R. Suss, J. Arnhold, B. Fuchs, J. Lessig, M. Muller, M. Petkovic, H. Spalteholz, O. Zschornig, K. Arnold, Matrix-assisted Desorption and Ionization Time-of-Flight (MALDI-TOF) Mass Spectrometry in Lipid and Phospholipid Research, Prog. Lipid Res., 43 (2004) 449-88.

Schiller, J.; Arnhold, J.; Benard, S.; Muller, M.; Reichi, S.; Arnold, K. Anal. Biochem. 1999, 267, 46-56

Shadkami, F., R. Helleur, Recent Applications in Analytical Thermochemolysis, J. Anal. Appl. Pyrol., 89 (2010) 2-18.

Sherman D. M. Geochimica et Cosmochimica Acta 2005, 69, 3249-3255

Sunner, J.; Dratz, E.; Chen, Y. Anal. Chem. 1995, 67, 4335-4342.

Taubes, G. Science 2001, 291, 2538.

Truong, C. M.; Wu, M.; Goodman, D. W. J. Am. Chem. Soc. 1993, 115, 3647-3653

Vieler, A.; Wilhelm, C.; Goss, R.; Süβ, R.; Schiller, J. Chem. Phys. Lipids 2007, 150, 143-155

Voorhees, K. J., S. J. DeLuca, A. Noguerola, Identification of Chemical Biomarkers in Bacteria and Other Compounds by Pyrolysis-Tandem Mass Spectrometry, J. Anal. Appl. Pyrol., 24 (1992) 1-21.

Wallace W. E.; Arnould M. A.; Knochenmuss R. Int. J. Mass Spectrom. 2005, 242, 13-22.

Wallace, M. A. Arnould, R. Knochenmuss, 2,5-Dihydroxybenzoic acid: Laser desorption/ionization as a function of elevated temperatures, Int. J. Mass Spectrom., 242 (2005) 13-22.

Watanabe, T; Kawaski, H; Yonezawa, T; Arakawa, R. J. Mass Spectrom. 2000, 43, 1063-1071

Wei, J.; Buriak, J. M.; Siuzdak, G. Nature 1999, 399, 243-246.

Wen X., Dagan S., Wysocki V. H. Anal.Chem. 2007, 79, 434-444.

Wenk, M. R. Nat Rev Drug Discov. 2005, 4, 594-610.

Wong, L. K., C. E. Costello, K. Biemann, Methylation Artifacts in Gas Chromatography of Serum Extracts, J. Chromatogr., 11 (1976) 323-31.

Work, V. H., R. Radakovits, R. E. Jinkerson, J. E. Meuser, L. G. Elliott, D. J. Vinyard, L. M. L. Laurens, C. G. Dismukes and M. C. Posewitz, Increased Lipid Accumulation in the *Chamydomonas reinhardtii* sta7-10 Starchless Isoamylase Mutant and Increased Carbohydrate Synthesis in Complemented Strains, Eukaryot. Cell, 9 (2010) 1251-61.

Work, V. H.; Radakovits, R.; Jinkerson, R. E.; Meuser, J. E.; Elliot, L. G.; Vinyard, D. J.; Laurens, L. M. L.; Dismukes G. C.; Posewitz, M. C. Eukaryot. Cell 2010, 9, 1251-1261

Wu, K. J.; Shaler T. A.; Becker, C. H. Anal. Chem. 1994, 66, 1637-1645.

Xu, M., F. Basile, K. J. Voorhees, Differentiation and Classification of User-Specified Bacterial Groups by in situ Thermal Hydrolysis/Methylation of Whole Bacterial Cells by tert-Butyl Bromide CI Ion Trap MS, Anal. Chim. Acta., 418 (2000) 119-25.

Yanes, O.; Northen, T. R.; Oppenheimer, S. R.; Shriver, L.; Apon, J.; Estrada, M. N.; Potchoiba, M. J.; Steenwyk, R.; Manchester, M.; Siuzdak, G. Anal. Chem. 2009, 81, 2969-2975.

Zhao, D., J. Peng, Q. Han, N. Melosh, G. H. Fredrickson, B. F. Chmelke, G. D. Stucky, Triblock Copolymers Synthesis of Mesoporous Silica with Periodic 50 to 300 Angstrom pores, Science, 279 (1998) 548-52

The invention claimed is:

1. A method of ionizing an analyte in a matrix-free system comprising:

contacting a non-cationic analyte with a metal oxide on a surface;

forming a composition consisting essentially of the metal oxide and the analyte, the metal oxide is selected from Nickel Oxide (NiO), Magnesium Oxide (MgO), and Calcium Oxide (CaO), without an additional proton source; and pulsing one or more laser pulses onto the composition to create a structure including the metal oxide and the analyte, before the one or more laser pulses ionize and desorb the analyte from the surface;

thereby ionizing the analyte.

2. The method according to claim 1, wherein the metal oxide is Nickel Oxide (NiO).

3. The method according to claim 1, wherein the metal oxide is Magnesium Oxide (MgO).

4. The method according to claim 1, wherein the metal oxide is Calcium Oxide (CaO).

5. The method of claim 1, wherein the forming step includes evaporating a solvent.

6. The method of claim 1, wherein the analyte comprises a carbonyl carbon.

7. The method of claim 1, wherein a first analyte fragment is detected in a mass spectrometer.

8. A method of characterizing an analyte in a matrix-free system comprising:

contacting a surface with a metal oxide to create a metal oxide surface wherein the metal oxide is selected from Nickel Oxide (NiO). Magnesium Oxide (MgO), and Calcium Oxide (CaO); contacting the metal oxide surface with a non-cationic analyte;

forming a composition consisting essentially of the metal oxide and the analyte, wherein no additional proton source is added;

contacting the composition with radiation from one or more lasers to create a structure including the metal oxide and the analyte, before the one or more laser pulses ionize and desorb the analyte from the surface; and detecting the analyte ion with a mass spectrometer.

9. The method of claim 8, wherein the non-cationic analyte is a lipid.

10. The method according to claim 8, wherein the metal oxide is Nickel Oxide (NiO).

11. The method according to claim 8, wherein the metal oxide is Magnesium Oxide (MgO).

12. The method according to claim 8, wherein the metal oxide is Calcium Oxide (CaO).

13. The method of claim 8, wherein the forming step includes evaporating a solvent.

* * * * *